US010562091B2

(12) United States Patent
Shirakami et al.

(10) Patent No.: US 10,562,091 B2
(45) Date of Patent: Feb. 18, 2020

(54) BURRING METHOD AND BURRING APPARATUS

(71) Applicant: NIPPON STEEL & SUMITOMO METAL CORPORATION, Tokyo (JP)

(72) Inventors: Satoshi Shirakami, Yokohama (JP); Masaaki Mizumura, Kisarazu (JP); Tohru Yoshida, Chiba (JP)

(73) Assignee: NIPPON STEEL CORPORATION, Tokyo (JP)

( * ) Notice: Subject to any disclaimer, the term of this patent is extended or adjusted under 35 U.S.C. 154(b) by 606 days.

(21) Appl. No.: 15/110,989

(22) PCT Filed: Jan. 29, 2015

(86) PCT No.: PCT/JP2015/052437
§ 371 (c)(1),
(2) Date: Jul. 12, 2016

(87) PCT Pub. No.: WO2015/115514
PCT Pub. Date: Aug. 6, 2015

(65) Prior Publication Data

US 2016/0339501 A1 Nov. 24, 2016

(30) Foreign Application Priority Data

Jan. 29, 2014 (JP) ..... 2014-014817

(51) Int. Cl.
*B21D 28/14* (2006.01)
*B21D 28/16* (2006.01)
(Continued)

(52) U.S. Cl.
CPC ..... *B21D 28/16* (2013.01); *B21D 28/14* (2013.01); *B21D 28/28* (2013.01); *B21D 41/025* (2013.01)

(58) Field of Classification Search
CPC ..... B21D 28/02; B21D 28/14; B21D 28/243; B21D 28/16; B21D 28/24; B21D 28/26; B21D 28/28; B21D 28/285
See application file for complete search history.

(56) References Cited

U.S. PATENT DOCUMENTS 2,325,437 A * 7/1943 Temple ..... B21D 28/28 83/194
3,124,877 A * 3/1964 Macchini ..... B21K 1/74 464/134
(Continued)

FOREIGN PATENT DOCUMENTS

CN 2759633 Y 2/2006
CN 201012375 Y 1/2008
(Continued)

OTHER PUBLICATIONS

International Search Report for PCT/JP2015/052437 dated Mar. 17, 2015.
(Continued)

*Primary Examiner* — Edward T Tolan
(74) *Attorney, Agent, or Firm* — Birch, Stewart, Kolasch & Birch, LLP

(57) ABSTRACT

In the present invention, in a piercing punch and a burring punch which are shaft members having a first axis line as the center axis lines and are provided so as to be movable along the first axis line, first, after prepared holes having the first axis line as the center axis lines with respect to the first wall portion and the second wall portion are formed using the piercing punch, burring holes having the first axis line as the center axis lines with respect to the first wall portion and the second wall portion are formed using the burring punch.

17 Claims, 38 Drawing Sheets

(51) Int. Cl.
*B21D 41/02* (2006.01)
*B21D 28/28* (2006.01)

(56) References Cited

U.S. PATENT DOCUMENTS

| | | | | | |
|---|---|---|---|---|---|
| 3,776,016 | A * | 12/1973 | Quinn | B21D 22/04 | 72/327 |
| 3,823,630 | A * | 7/1974 | Suominen | B21D 28/26 | 493/372 |
| 4,055,067 | A * | 10/1977 | Kozima | B21D 31/02 | 72/328 |
| 4,621,553 | A * | 11/1986 | Gruchalski | B21D 28/28 | 83/194 |
| 4,679,289 | A * | 7/1987 | Miller | B21D 22/04 | 29/33 T |
| 4,956,989 | A | 9/1990 | Nakajima | | |
| 5,237,849 | A * | 8/1993 | Miyazawa | B21D 28/04 | 29/890.047 |
| 6,061,909 | A * | 5/2000 | Laskowski | A47F 5/0815 | 248/220.31 |
| 2004/0112188 | A1* | 6/2004 | Oishi | B21D 28/26 | 83/13 |
| 2008/0163662 | A1* | 7/2008 | Dagan | B21D 28/28 | 72/325 |
| 2010/0212388 | A1* | 8/2010 | Oishi | B21D 28/26 | 72/327 |
| 2011/0239834 | A1* | 10/2011 | Kanie | B21D 28/16 | 83/14 |

FOREIGN PATENT DOCUMENTS

| | | | |
|---|---|---|---|
| CN | 201079810 | Y | 7/2008 |
| CN | 103157712 | A | 6/2013 |
| JP | 30-2247 | B1 | 3/1955 |
| JP | 56-84127 | A | 7/1981 |
| JP | 56-117836 | A | 9/1981 |
| JP | 58-25816 | A | 2/1983 |
| JP | 61-22218 | U | 2/1986 |
| JP | 62-72435 | A | 4/1987 |
| JP | 62-109816 | U | 7/1987 |
| JP | 63-196319 | U | 12/1988 |
| JP | 63-317221 | A | 12/1988 |
| JP | 1-254327 | A | 10/1989 |
| JP | 9-308919 | A | 12/1997 |
| JP | 10-24331 | A | 1/1998 |
| JP | 2005-246474 | A | 9/2005 |
| JP | 2007-76547 | A | 3/2007 |
| JP | 2012-24768 | A | 2/2012 |
| JP | 2015-36155 | A | 2/2015 |

OTHER PUBLICATIONS

Written Opinion of the International Searching Authority for PCT/JP2015/052437 (PCT/ISA/237) dated Mar. 17, 2015.
Notice of Reasons for Rejection dated May 9, 2017, in Japanese Patent Application No. 2015-559997, with English translation.
Office Action dated May 3, 2017, in Chinese Patent Application No. 201580005692.1, with partial English translation.

* cited by examiner

BURRING METHOD AND BURRING APPARATUS

TECHNICAL FIELD OF THE INVENTION

The present invention relates to a burring method and a burring apparatus.

Priority is claimed on Japanese Patent Application No. 2014-014817, filed on Jan. 29, 2014, the content of which is incorporated herein by reference.

RELATED ART

As is well known, as a link structure member which connects a plurality of objects to each other, a link structure member in which a joining portion is formed on an end portion or an intermediate position of a link structure member has been put into practical use. For example, the link structure member is used in various applications such as a link structure member for a construction structure, a link structure member for a suspension of an automobile, or the like.

For example, as the suspension device of an automobile, various types of suspension devices have been put into practical use, and for example, in a five-link type suspension, suspension links such as a lower link, an upper link, or a lateral link are used (for example, refer to Patent Document 1 below).

In the link structure member, for example, a suspension link shown in FIG. 1 of Patent Document 1 includes a joining portion 111 which is formed in a cylindrical shape, and a joining portion 112 having wall portions which are formed in a U shape and are disposed so as to face each other. The joining portions 111 and 112 are connected to each other by a rod portion 113. The joining portion 111 is connected to an axle by fitting and inserting a bush or the like into a hole and inserting a shaft member or the like into the fitted and inserted bush. The joining portion 112 is connected to a vehicle body by a bolt inserted into a fastening hole.

For example, in the suspension link, there is a lateral link in which a load applied from the vehicle body to the lateral link is not necessarily large and the lateral link can be thinned. However, in order to connect the joining portion to the rod portion by welding, it may be necessary to thicken the thickness so as to obtain a sufficient strength of a welded portion. As a result, there is a problem that the weight of the link structure member increases.

Meanwhile, in a case in which joining portions having wall portions which face each other on end portions of metal pipes are integrally formed in order to decrease the weight of the link structure member, the thickness of the joining portion is set depending on the thickness of the formed metal pipe.

As a result, it is necessary to stably hold a bush or the like within ranges of the thicknesses of the facing wall portions configuring the joining portions, and stably holding the bush or the like is not easy. Stably holding the bush or the like is significantly difficult in cases in which the diameter of the end portion of the metal pipe increases, the thickness of the end portion is thinned, and a busing holding portion into which a large bush can be fitted and inserted is formed.

Accordingly, in the joining portion including the bush holding portion, in order to form a rising wall portion on a peripheral edge portion such as a bush holding hole formed on each of the facing wall portions and to increase a holding area in an inner circumference of the bush holding hole, a burring technology for forming a burring shape portion in the bush holding hole or the like is widely used (for example, refer to Patent Documents 2 and 3). Hereinafter, as the bush holding hole or the like, the hole in which the rising wall portion is formed on the peripheral edge portion by burring is referred to as a burring hole.

PRIOR ART DOCUMENT

Patent Document

[Patent Document 1] Japanese Unexamined Patent Application, First Publication No. 2007-076547

[Patent Document 2] Japanese Unexamined Patent Application, First Publication No. 2005-246474

[Patent Document 3] Japanese Unexamined Patent Application, First Publication No. 2012-24768

DISCLOSURE OF THE INVENTION

Problems to be Solved by the Invention

However, for example, in a case in which the burring apparatus disclosed in Patent Document 2 is used, in order to form the burring hole with respect to each of the pair of wall portions facing each other, first, it is necessary to form one of the burring holes by burring one of the pair of wall portions, and thereafter, it is necessary to form the other burring hole by burring the other one of the pair of wall portions. Accordingly, it is necessary to perform the burring in two steps, and there is a problem that the work efficiency decreases.

In addition, as described above, in the case in which the pair of burring holes is formed in two steps, since the misalignment between a center axis line of the burring hole formed on one wall portion and a center axis line of the burring hole formed on the other wall portion easily occurs, it is difficult to form burring holes so as to have the same axis line as the center axis lines with respect to the pair of wall portions.

Meanwhile, Patent Document 3 discloses a technology which can simultaneously form the burring holes having the same axis line with respect to the pair of wall portions facing each other. However, in the technology disclosed in Patent Document 3, before burring the pair of the wall portions, it is necessary to form a prepared hole for burring with respect to each of the pair of wall portions using a general punching device such as a punching machine (refer to Paragraph [0033] of Patent Document 3).

That is, in the technology disclosed in Patent Document 3, first, after forming the prepared hole with respect to each of the pair of wall portions using the general punching device, it is necessary to burr the prepared hole using the burring apparatus. Accordingly, the misalignment between the center axis line of the finally obtained burring hole and the center axis line of the prepared hole is likely to occur.

If the misalignment between the center axis line of the burring hole and the center axis line of the prepared hole occurs, burring holes having shapes and dimensions different from design data are formed. As a result, for example, in a case in which the burring hole is the bush holding hole of the lateral link, there is a concern that attachment accuracy of a bush and a bush holding force may decrease.

In addition, if the misalignment between the center axis line of the burring hole and the center axis line of the prepared hole occurs, cracks easily occur in the rising wall portion of the burring hole, and there is a concern that productivity may decrease.

The present invention is made in consideration of the above-described circumstances, and an object thereof is to provide a burring method and a burring apparatus capable of accurately and effectively forming burring holes having the same axis line as the center axis lines with respect to a first wall portion and a second wall portion facing each other.

Means for Solving the Problem

In order to solve the above-described problems and achieve the related object, the present invention adopts the following means.

(1) According to an aspect of the present invention, a burring method for forming burring holes having a first axis line as center axis lines with respect to a first wall portion and a second wall portion facing each other, includes: a first process of disposing an internal unit of a burring apparatus between the first wall portion and the second wall portion, disposing a first external unit of the burring apparatus outside the first wall portion, and disposing a second external unit of the burring apparatus outside the second wall portion; a second process of, out of a piercing punch and a burring punch which are shaft members having the first axis line as the center axis lines provided in at least one of the internal unit, the first external unit, and the second external unit, and are provided so as to be movable along the first axis line, first, forming prepared holes having the first axis lines as the center axis lines with respect to the first wall portion and the second wall portion using the piercing punch, and thereafter, forming burring holes having the first axis line as the center axis lines with respect to the first wall portion and the second wall portion using the burring punch; and a third process of detaching the internal unit, the first external unit, and the second external unit from the first wall portion and the second wall portion.

(2) In the burring method according to (1), in the second process, after one of the prepared holes is formed on the first wall portion using a first piercing punch provided in the first external unit, one of the burring holes may be formed by bending a peripheral edge portion of the prepared hole of the first wall portion to the inside of the first wall portion using a first burring punch which is provided in the first external unit and has the first axis line as the center axis line along with the first piercing punch; and after the other prepared hole is formed on the second wall portion using a second piercing punch provided in the second external unit, the other burring hole may be formed by bending a peripheral edge portion of the prepared hole of the second wall portion to the inside of the second wall portion using a second burring punch which is provided in the second external unit and has the first axis line as the center axis line along with the second piercing punch.

(3) In the burring method according to (2), in the first process, among a first burring holder which is provided in the first external unit and has a first through hole serving as a passage of the first burring punch, the first burring punch which is disposed inside the first through hole, and the first piercing punch which is disposed inside the first burring punch, the first burring holder and the first burring punch may come into pressure contact with an outer wall surface of the first wall portion in a state where center axis lines of the first through hole, the first piercing punch, and the first burring punch coincide with the first axis line; among a second burring holder which is provided in the second external unit and has a second through hole serving as a passage of the second burring punch, the second burring punch which is disposed inside the second through hole, and the second piercing punch which is disposed inside the second burring punch, the second burring holder and the second burring punch may come into pressure contact with an outer wall surface of the second wall portion in a state where center axis lines of the second through hole, the second piercing punch, and the second burring punch coincide with the first axis line; a first burring die which is provided in the internal unit and has a first forming hole, and a first piercing die which is provided inside the first forming hole and has a first piercing hole may come into pressure contact with an inner wall surface of the first wall portion in a state where center axis lines of the first forming hole and the first piercing hole coincide with the first axis line; and a second burring die which is provided in the internal unit and has a second forming hole, and a second piercing die which is provided inside the second forming hole and has a second piercing hole may come into pressure contact with an inner wall surface of the second wall portion in a state where center axis lines of the second forming hole and the second piercing hole coincide with the first axis line.

In the second process, one of the prepared holes may be formed on the first wall portion by moving the first piercing punch from the outside of the first wall portion to the inside thereof along the first axis line such that the first piercing punch is inserted into the first piercing hole; the other prepared hole may be formed on the second wall portion by moving the second piercing punch from the outside of the second wall portion to the inside thereof along the first axis line such that the second piercing punch is inserted into the second piercing hole; the peripheral edge portion of the prepared hole of the first wall portion may be bent to the inside of the first wall portion to form one of the burring holes by moving the first burring punch from the outside of the first wall portion to the inside thereof along the first axis line such that the first burring punch is inserted into the first forming hole, and the first piercing die may be returned to a position close to a center between the first wall portion and the second wall portion; the peripheral edge portion of the prepared hole of the second wall portion may be bent to the inside of the second wall portion to form the other burring hole by moving the second burring punch from the outside of the second wall portion to the inside thereof along the first axis line such that the second burring punch is inserted into the second forming hole, and the second piercing die may be returned to a position close to the center between the first wall portion and the second wall portion; and the first burring die and the second burring die may be returned to the position close to the center between the first wall portion and the second wall portion after both of the burring holes are formed.

(4) In the burring method according to (3), in the first process, the first burring die may come into pressure contact with the inner wall surface of the first wall portion and the second burring die may come into pressure contact with the inner wall surface of the second wall portion by inserting a first stopper into a portion between the first burring die and the second burring die in the internal unit; and the first piercing die may come into pressure contact with the inner wall surface of the first wall portion and the second piercing die may come into pressure contact with the inner wall surface of the second wall portion by inserting a second stopper into a portion between the first piercing die and the second piercing die.

In the second process, after the second stopper is removed from the portion between the first piercing die and the second piercing die, one of the burring holes may be formed on the first wall portion by inserting the first burring punch into the first forming hole, and the other burring hole may be formed on the second wall portion by inserting the second burring punch into the second forming hole; and after both of the burring holes are formed, the first stopper may be removed from the portion between the first burring die and the second burring die, and the first burring die and the second burring die may be returned to the position close to the center between the first wall portion and the second wall portion by applying an external force to the first burring die and the second burring die in a direction approaching each other.

(5) In the burring method according to (1), in the second process, after one of the prepared holes is formed on the first wall portion using a first piercing punch provided in the first external unit, one of the burring holes may be formed by bending a peripheral edge portion of the prepared hole of the first wall portion to the outside of the first wall portion using a first burring punch which is provided in the internal unit and has the first axis line as the center axis line along with the first piercing punch; and after the other prepared hole is formed on the second wall portion using a second piercing punch provided in the second external unit, the other burring hole may be formed by bending a peripheral edge portion of the prepared hole of the second wall portion to the outside of the second wall portion using a second burring punch which is provided in the internal unit and has the first axis line as the center axis line along with the second piercing punch.

(6) In the burring method according to (5), in the first process, among a first burring die which is provided in the first external unit and has a first forming hole, a first piercing holder which is provided inside the first forming hole and has a first through hole serving as a passage of the first piercing punch, and the first piercing punch which is provided inside the first through hole, the first burring die and the first piercing holder may come into pressure contact with an outer wall surface of the first wall portion in a state where center axis lines of the first forming hole, the first through hole, and the first piercing punch coincide with the first axis line; among a second burring die which is provided in the second external unit and has a second forming hole, a second piercing holder which is provided inside the second forming hole and has a second through hole serving as a passage of the second piercing punch, and the second piercing punch which is provided inside the second through hole, the second burring die and the second piercing holder may come into pressure contact with an outer wall surface of the second wall portion in a state where center axis lines of the second forming hole, the second through hole, and the second piercing punch coincide with the first axis line; and after a tubular housing which is provided in the internal unit, includes the first burring punch and the second burring punch, and has both opened ends is disposed between the first wall portion and the second wall portion in a state where center axis lines of the first burring punch, the second burring punch, and the housing coincide with the first axis line, the first burring punch may come into pressure contact with an inner wall surface of the first wall portion, and the second burring punch may come into pressure contact with an inner wall surface of the second wall portion.

In the second process, one of the prepared holes may be formed on the first wall portion by moving the first piercing punch from the outside of the first wall portion to the inside thereof along the first axis line such that the first piercing punch is inserted into the first piercing hole provided in the first burring punch; the other prepared hole may be formed on the second wall portion by moving the second piercing punch from the outside of the second wall portion to the inside thereof along the first axis line such that the second piercing punch is inserted into the second piercing hole provided in the first burring punch; the peripheral edge portion of the prepared hole of the first wall portion may be bent to the outside of the first wall portion to form one of the burring holes by moving the first burring punch from the inside of the first wall portion to the outside thereof along the first axis line such that the first burring punch is inserted into the first forming hole; the peripheral edge portion of the prepared hole of the second wall portion may be bent to the outside of the second wall portion to form the other burring hole by moving the second burring punch from the inside of the second wall portion to the outside thereof along the first axis line such that the second burring punch is inserted into the second forming hole; and the first burring punch and the second burring punch may be returned to the position close to the center between the first wall portion and the second wall portion after both of the burring holes are formed.

(7) In the burring method according to (6), in the first process, the first burring punch may come into pressure contact with the inner wall surface of the first wall portion and the second burring punch may come into pressure contact with the inner wall surface of the second wall portion by inserting a stopper into a portion between the first burring punch and the second burring punch in the internal unit.

In the second process, the first burring punch may move from the inside of the first wall portion to the outside thereof along the first axis line to form one of the burring holes on the first wall portion and the second burring punch may move from the inside of the second wall portion to the outside thereof along the first axis line to form the other burring hole on the second wall portion by inserting the stopper deeper into the portion between the first burring punch and the second burring punch; and after both of the burring holes are formed, the stopper may be removed from the portion between the first burring punch and the second burring punch, and the first burring die and the second burring die may be returned to the position close to the center between the first wall portion and the second wall portion by applying an external force to the first burring die and the second burring die in a direction approaching each other.

(8) In the burring method according to (6), in the first process, the first burring punch may come into pressure contact with the inner wall surface of the first wall portion and the second burring punch may come into pressure contact with the inner wall surface of the second wall portion by inserting a stopper into a portion between the first burring punch and the second burring punch in the internal unit.

In the second process, after the prepared hole is formed on each of the first wall portion and the second wall portion using the first piercing punch and the second piercing punch, by moving the second piercing punch toward the first wall portion along the first axis line in a state where a front end of the second piercing punch comes into contact with a bottom portion of the second piercing hole of the second burring punch, the second burring punch, a separable separation block provided in the stopper, and the first burring punch may simultaneously move toward the outside of the first wall portion along the first axis line to form one of the burring holes on the first wall portion; by moving the first piercing punch toward the second wall portion along the first axis line in a state where a front end of the first piercing punch comes into contact with a bottom portion of the first piercing hole of the first burring punch, the first burring punch, the separation block provided in the stopper, and the second burring punch may simultaneously move toward the outside of the second wall portion along the first axis line to form the other burring hole on the second wall portion; and by moving the second piercing punch toward the first wall portion along the first axis line in a state where the front end of the second piercing punch comes into contact with the bottom portion of the second piercing hole of the second burring punch, the separation block may be returned into the stopper.

(9) In the burring method according to (1), in the second process, after one of the prepared holes is formed on the first wall portion using a first piercing punch provided in the first external unit, one of the burring holes may be formed by bending a peripheral edge portion of the prepared hole of the first wall portion to the inside of the first wall portion using a first burring punch which is provided in the first external unit and has the first axis line as the center axis line along with the first piercing punch; and after the other prepared hole is formed on the second wall portion using a second piercing punch provided in the internal unit, the other burring hole may be formed by bending a peripheral edge portion of the prepared hole of the second wall portion to the outside of the second wall portion using a second burring punch which is provided in the internal unit and has the first axis line as the center axis line along with the second piercing punch.

(10) In the burring method according to (9), in the first process, among a first burring holder which is provided in the first external unit and has a first through hole serving as a passage of the first burring punch, the first burring punch which is disposed inside the first through hole, and the first piercing punch which is attached to a front end of the first burring punch, the first burring holder may come into pressure contact with an outer wall surface of the first wall portion in a state where center axis lines of the first through hole, the first burring punch, and the first piercing punch coincide with the first axis line; a first burring die which is provided in the internal unit and has a first forming hole, and a first piercing die which is provided inside the first forming hole and has a first piercing hole may come into pressure contact with an inner wall surface of the first wall portion in a state where center axis lines of the first forming hole and the first piercing hole coincide with the first axis line; among a second burring holder which is provided in the internal unit and has a second through hole serving as a passage of the second burring punch, the second burring punch which is disposed inside the second through hole, and the second piercing punch which is attached to a front end of the second burring punch, the second burring holder may come into pressure contact with an inner wall surface of the second wall portion in a state where center axis lines of the second through hole, the second burring punch, and the second piercing punch coincide with the first axis line; and a second buffing die which is provided in the second external unit and has a second forming hole, and a second piercing die which is provided inside the second forming hole and has a second piercing hole may come into pressure contact with an outer wall surface of the second wall portion in a state where center axis lines of the second forming hole and the second piercing hole coincide with the first axis line.

In the second process, one of the prepared holes may be formed on the first wall portion by moving the first burring punch and the first piercing punch from the outside of the first wall portion to the inside thereof along the first axis line such that the first piercing punch is inserted into the first piercing hole; by moving the first burring punch from the outside of the first wall portion to the inside thereof along the first axis line such that the first burring punch is inserted into the first forming hole after the prepared hole is formed on the first wall portion, the peripheral edge portion of the prepared hole of the first wall portion may be bent to the inside of the first wall portion to form one of the burring holes; by moving the first burring punch toward the second wall portion in a state where the front end of the first piercing punch comes into contact with the bottom portion of the first piercing hole, the second burring punch and the second piercing punch may move from the inside of the second wall portion to the outside thereof along the first axis line to form the other prepared hole on the second wall portion such that the second piercing punch is inserted into the second piercing hole; by further moving the first burring punch toward the second wall portion after the prepared hole is formed on the second wall portion, the second burring punch may move from the inside of the second wall portion to the outside thereof along the first axis line such that the second burring punch is inserted into the second forming hole, and a peripheral edge of the prepared hole of the second wall portion may be bent to the outside of the second wall portion to form the other burring hole; and by moving the second burring punch to the inside of the second wall portion after the burring hole is formed on the second wall portion, the first burring die and the first piercing die may be returned to a position close to the center between the first wall portion and the second wall portion.

(11) In the burring method according to (10), in the first process, by inserting a stopper into a portion between the first burring holder and the second burring die in the internal unit, the first burring die and the first piercing die disposed inside the first burring die may come into pressure contact with the inner wall surface of the first wall portion, and the second burring holder and the second piercing punch disposed inside the second burring holder may come into pressure contact with the inner wall surface of the second wall portion.

In the second process, by moving the first burring punch toward the second wall portion along the first axis line in a state where a front end of the first piercing punch comes into contact with a bottom portion of the first piercing hole of the first piercing die, the first piercing die, a separable separation block provided in the stopper, and the second burring punch to which the second piercing punch is attached may simultaneously move toward the outside of the second wall portion along the first axis line, and after the burring hole of the first wall portion and the prepared hole of the second wall portion are simultaneously formed, finally, the burring hole of the second wall portion may be formed; after the separation block is returned into the stopper by moving the first piercing die, the separation block, and the second burring punch to the inside of the second wall portion, the stopper may be removed from the portion between the first burring die and the second burring holder; and the first burring die may be returned to the position close to the center between the first wall portion and the second wall portion by applying an external force to the first burring die in a direction toward the second wall portion.

(12) According to another aspect of the present invention, a burring apparatus for forming burring holes having a first axis line as center axis lines with respect to a first wall portion and a second wall portion facing each other, includes: an internal unit which is disposed between the first wall portion and the second wall portion; a first external unit which is disposed outside the first wall portion; and a second external unit which is disposed outside the second wall portion, in which at least one of the internal unit, the first external unit, and the second external unit includes a piercing punch and a burring punch which are shaft members having the first axis line as the center axis lines and are provided so as to be movable along the first axis line.

(13) In the burring apparatus according to (12), the first external unit may include: a first piercing punch which forms a prepared hole on the first wall portion; and a first burring punch which has the first axis line as the center axis line along with the first piercing punch, and bends a peripheral edge portion of the prepared hole of the first wall portion to the inside of the first wall portion to form the burring hole.

The second external unit may include: a second piercing punch which forms a prepared hole on the second wall portion; and a second burring punch which has the first axis line as the center axis line along with the second piercing punch, and bends a peripheral edge portion of the prepared hole of the second wall portion to the inside of the second wall portion to form the burring hole.

(14) In the burring apparatus according to (13), the first external unit may further include a first burring holder which has a first through hole serving as a passage of the first burring punch and is provided so as to be movable outside the first wall portion in a state where a center axis line of the first through hole coincides with the first axis line.

The first burring punch may be provided so as to be movable between the outside and the inside of the first wall portion along the first axis line in a state where a center axis line of the first burring punch coincides with the first axis line inside the first through hole of the first burring holder.

The first piercing punch may be provided so as to be movable between the outside and the inside of the first wall portion along the first axis line in a state where a center axis line of the first piercing punch coincides with the first axis line inside the first burring punch.

The second external unit may further include a second burring holder which has a second through hole serving as a passage of the second burring punch and is provided so as to be movable outside the second wall portion in a state where a center axis line of the second through hole coincides with the first axis line.

The second burring punch may be provided so as to be movable between the outside and the inside of the second wall portion along the first axis line in a state where a center axis line of the second burring punch coincides with the first axis line inside the second through hole of the second burring holder.

The second piercing punch is provided so as to be movable between the outside and the inside of the second wall portion along the first axis line in a state where a center axis line of the second piercing punch coincides with the first axis line inside the second burring punch.

The internal unit may include: a first burring die which has a first forming hole into which the first burring punch is inserted, and is provided so as to be movable inside the first wall portion along the first axis line in a state where a center axis line of the first forming hole coincides with the first axis line; a first piercing die which has a first piercing hole into which the first piercing punch is inserted, and is provided so as to be movable inside the first wall portion along the first axis line in a state where a center axis line of the first piercing hole coincides with the first axis line inside the first forming hole of the first burring die; a second burring die which has a second forming hole into which the second burring punch is inserted, and is provided so as to be movable inside the second wall portion along the first axis line in a state where a center axis line of the second forming hole coincides with the first axis line; and a second piercing die which has a second piercing hole into which the second piercing punch is inserted, and is provided so as to be movable inside the second wall portion along the first axis line in a state where a center axis line of the second piercing hole coincides with the first axis line inside the second forming hole of the second burring die.

(15) In the burring apparatus according to (14), in a case where a center position between the first wall portion and the second wall portion on the first axis line is defined as a reference point, the first burring die and the second burring die may be disposed so as to face each other in a state where the reference point is interposed therebetween, and the first piercing die and the second piercing die may be disposed so as to face each other in a state where the reference point is interposed therebetween.

The internal unit may further include a first stopper and a second stopper which pass through the reference point and are provided so as to be movable along a second axis line orthogonal to the first axis line.

The first stopper may have a shape which causes the first burring die to move toward the first wall portion and the second burring die to move toward the second wall portion in a process in which the first stopper passes through the reference point along the second axis line.

The second stopper may have a shape which causes the first piercing die to move toward the first wall portion and the second piercing die to move toward the second wall portion in a process in which the second stopper passes through the reference point along the second axis line.

(16) In the burring apparatus according to (15), the internal unit may further include a die return mechanism which separately applies an external force toward the reference point to each of the first burring die and the second burring die.

(17) In the burring apparatus according to (12), the first external unit may include a first piercing punch which forms a prepared hole on the first wall portion.

The second external unit may include a second piercing punch which forms a prepared hole on the second wall portion.

The internal unit may include: a first burring punch which has the first axis line as the center axis line along with the first piercing punch, and bends a peripheral edge portion of the prepared hole of the first wall portion to the outside of the first wall portion to form the burring hole; and a second burring punch which has the first axis line as the center axis line along with the second piercing punch, and bends a peripheral edge portion of the prepared hole of the second wall portion to the outside of the second wall portion to form the burring hole.

(18) In the burring apparatus according to (17), the first external unit may further include: a first burring die which has the first forming hole into which the first burring punch is inserted, and is provided so as to be movable along the first axis line outside the first wall portion in a state where a center axis line of the first forming hole coincides with the first axis line; and a first piercing holder which has the first through hole serving as a passage of the first piercing punch and is provided so as to be movable along the first axis line outside the first wall portion in a state where a center axis line of the first through hole coincides with the first axis line inside the first forming hole of the first burring die.

The first piercing punch may be provided so as to be movable between the outside and the inside of the first wall portion along the first axis line inside the first through hole of the first piercing holder in a state where a center axis line of the first piercing punch coincides with the first axis line.

The second external unit may further include: a second burring die which has the second forming hole into which the second burring punch is inserted, and is provided so as to be movable along the first axis line outside the second wall portion in a state where a center axis line of the second forming hole coincides with the first axis line; and a second piercing holder which has the second through hole serving as a passage of the second piercing punch and is provided so as to be movable along the first axis line outside the second wall portion in a state where a center axis line of the second through hole coincides with the first axis line inside the second forming hole of the second burring die.

The second piercing punch may be provided so as to be movable between the outside and the inside of the second wall portion along the first axis line inside the second through hole of the second piercing holder in a state where a center axis line of the second piercing punch coincides with the first axis line.

The internal unit may further include a tubular housing which includes the first burring punch and the second burring punch and has both opened end surfaces, in which the housing may be configured such that one end surface of the housing comes into surface contact with an inner wall surface of the first wall portion and the other end surface of the housing comes into surface contact with an inner wall surface of the second wall portion.

The first burring punch may include a first piercing hole into which the first piercing punch is inserted, and is provided so as to be movable between the outside and the inside of the first wall portion along the first axis line inside the housing in a state where a center axis line of the first piercing hole coincides with the first axis line.

The second burring punch may include a second piercing hole into which the second piercing punch is inserted, and is provided so as to be movable between the outside and the inside of the second wall portion along the first axis line inside the housing in a state where a center axis line of the second piercing hole coincides with the first axis line.

(19) In the burring apparatus according to (18), in a case where a center position between the first wall portion and the second wall portion on the first axis line is defined as a reference point, the first burring punch and the second burring punch may be disposed so as to face each other in a state where the reference point is interposed therebetween.

The internal unit may further include a stopper which passes through the reference point and is provided so as to be movable along a second axis line orthogonal to the first axis line.

The stopper may have a shape which causes the first burring punch to move to the outside of the first wall portion and the second burring punch to move to the outside of the second wall portion in a process in which the stopper passes through the reference point along the second axis line.

(20) In the burring apparatus according to (19), the internal unit may further include a burring punch return mechanism which separately applies an external force toward the reference point to each of the first burring punch and the second burring punch.

(21) In the burring apparatus according to (18), each of the first piercing hole of the first burring punch and the second piercing hole of the second burring punch may include a bottom portion.

In a case where a center position between the first wall portion and the second wall portion on the first axis line is defined as a reference point, the first burring punch and the second burring punch may be disposed so as to face each other in a state where the reference point is interposed therebetween, and the internal unit may further include a stopper which passes through the reference point and is provided so as to be movable along a second axis line orthogonal to the first axis line.

The stopper may have a shape which causes the first burring punch to move toward the first wall portion and the second burring punch to move toward the second wall portion in a process in which the stopper passes through the reference point along the second axis line.

The stopper may include a separation block which is separated from the stopper when the stopper stops in a state where the first burring punch comes into pressure contact with an inner wall surface of the first wall portion and the second burring punch comes into pressure contact with an inner wall surface of the second wall portion, and which is movable inside the housing along the first axis line along with the first burring punch and the second burring punch.

(22) In the burring apparatus according to (12), the first external unit may include: a first piercing punch which forms a prepared hole on the first wall portion; and a first burring punch which has the first axis line as the center axis line along with the first piercing punch, and bends a peripheral edge portion of the prepared hole of the first wall portion to the inside of the first wall portion to form the burring hole.

The internal unit may include: a second piercing punch which forms a prepared hole on the second wall portion; and a second burring punch which has the first axis line as the center axis line along with the second piercing punch, and bends a peripheral edge portion of the prepared hole of the second wall portion to the outside of the second wall portion to form the burring hole.

(23) In the burring apparatus according to (22), the first external unit may further include a first burring holder which has a first through hole serving as a passage of the first burring punch and is provided so as to be movable outside the first wall portion in a state where a center axis line of the first through hole coincides with the first axis line.

The first burring punch may be provided so as to be movable along the first axis line inside the first through hole of the first burring holder in a state where a center axis line of the first burring punch coincides with the first axis line.

The first piercing punch may be attached to a front end of the first burring punch while having the first axis line as the center axis line along with the first burring punch.

The internal unit may further include: a first burring die which has a first forming hole into which the first burring punch is inserted, and is provided so as to be movable along the first axis line in a state where a center axis line of the first forming hole coincides with the first axis line; a first piercing die which has a first piercing hole into which the first piercing punch is inserted, and is provided so as to be movable along the first axis line inside the first forming hole of the first burring die in a state where a center axis line of the first piercing hole coincides with the first axis line; and a second burring holder which has a second through hole serving as a passage of the second burring punch, and is provided so as to be movable along the first axis line in a state where a center axis line of the second through hole coincides with the first axis line.

The second burring punch may be provided so as to be movable along the first axis line inside the second through hole of the second burring holder in a state where a center axis line of the second burring punch coincides with the first axis line.

The second piercing punch may be attached to a front end of the second burring punch while having the first axis line as the center axis line along with the second burring punch.

The second external unit may include: a second burring die which has a second forming hole into which the second burring punch is inserted, and is provided so as to be movable outside the second wall portion along the first axis line in a state where a center axis line of the second forming hole coincides with the first axis line; and a second piercing die which has a second piercing hole into which the second piercing punch is inserted, and is provided so as to be movable outside the second wall portion along the first axis line in a state where a center axis line of the second piercing hole coincides with the first axis line inside the second forming hole of the second burring die.

(24) In the burring apparatus according to (23), the first piercing hole of the first piercing die may include a bottom portion.

In a case where a center position between the first wall portion and the second wall portion on the first axis line is defined as a reference point, the first burring die and the second burring holder may be disposed so as to face each other in a state where the reference point is interposed therebetween, the first piercing die and the second burring punch may be disposed so as to face each other in a state where the reference point is interposed therebetween, and the internal unit may further include a stopper which passes through the reference point and is provided so as to be movable along a second axis line orthogonal to the first axis line.

The stopper may have a shape which causes the first burring die and the first piercing die to move toward the first wall portion and the second burring holder and the second burring punch to move toward the second wall portion in a process in which the stopper passes through the reference point along the second axis line.

The stopper may include a separation block which is separated from the stopper when the stopper stops in a state where the first burring die and the first piercing die come into pressure contact with an inner wall surface of the first wall portion, and the second piercing punch attached to front ends of the second burring holder and the second burring punch come into pressure contact with an inner wall surface of the second wall portion, and which is movable along the first axis line along with the first piercing die and the second burring punch.

(25) In the burring apparatus according to (24), the internal unit may further include a die return mechanism which applies an external force toward the reference point to the first burring die.

Effects of the Invention

According to the aspects, it is possible to accurately and effectively form burring holes having the same axis line as center axis lines with respect to a first wall portion and a second wall portion facing each other.

EMBODIMENTS OF THE INVENTION

Hereinafter, embodiments of the present invention will be described in detail with reference to the drawings.

First, for easy understanding of a burring apparatus and a burring method according to the present embodiment, an example (for example, a lateral link which is a link structure member used in a suspension of a vehicle) of a product, in which a burring hole is formed, is described.

Figure 1:
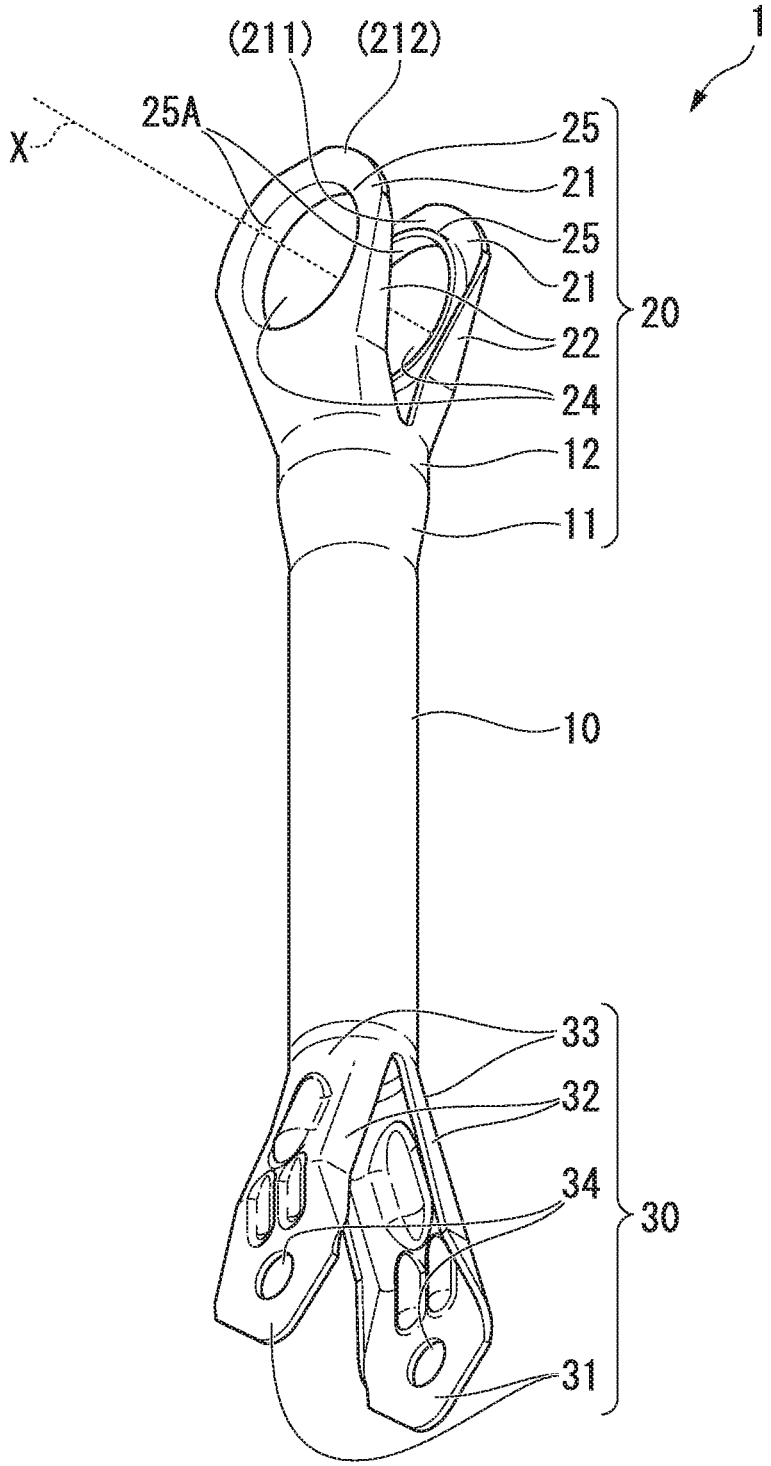
FIG. 1 is a perspective view showing a schematic configuration of a lateral link 1 which is an example of a product in which burring holes are formed on a pair of wall portions facing each other.
Figure 2:
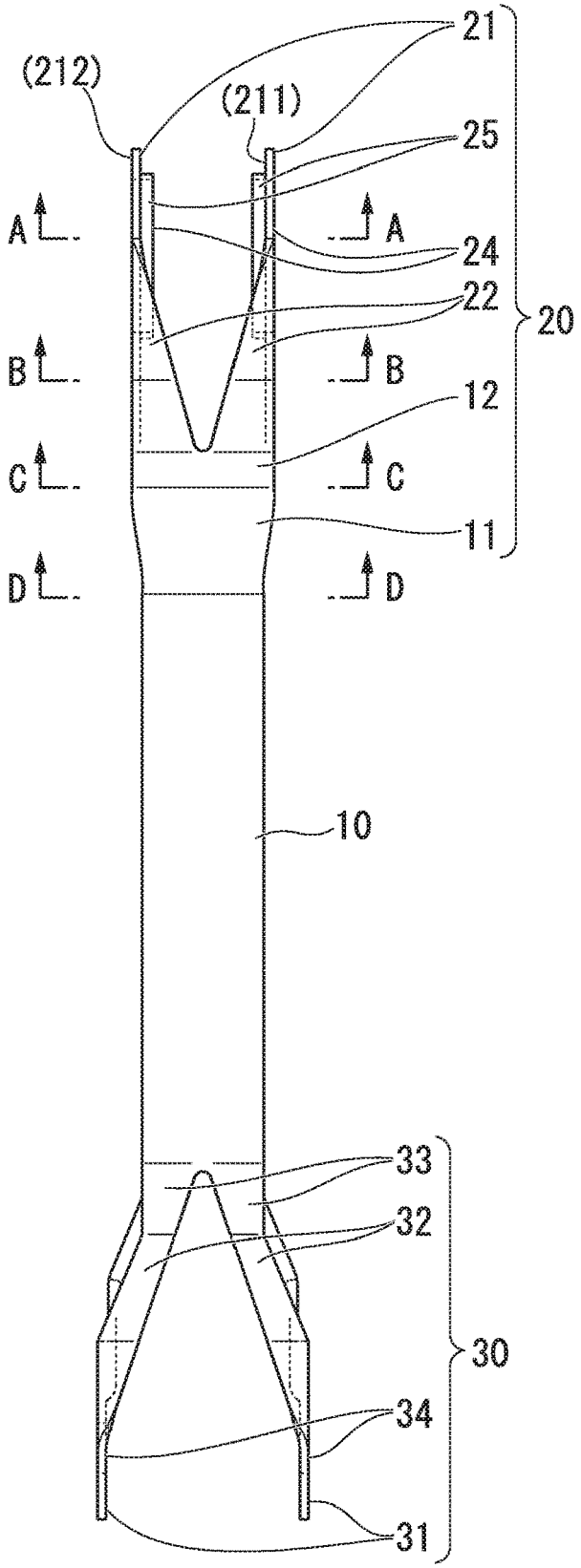
FIG. 2 is a front view showing the schematic configuration of the lateral link 1.
Figure 3A:
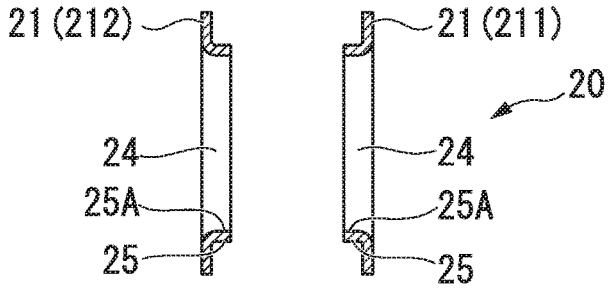
FIG. 3A is a sectional view taken along line A-A in FIG. 2.
Figure 3B:
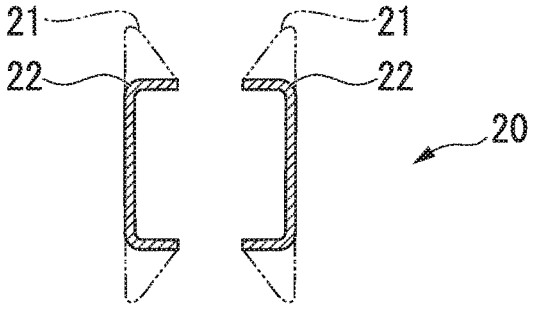
FIG. 3B is a sectional view taken along line B-B in FIG. 2.
Figure 3C:
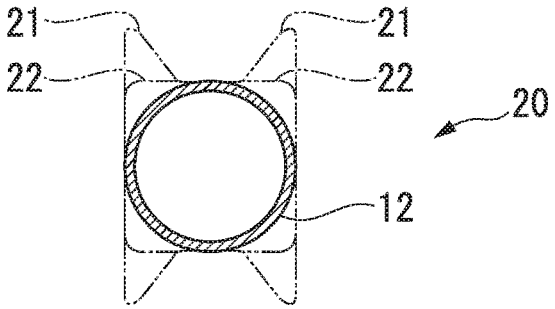
FIG. 3C is a sectional view taken along line C-C in FIG. 2.
Figure 3D:
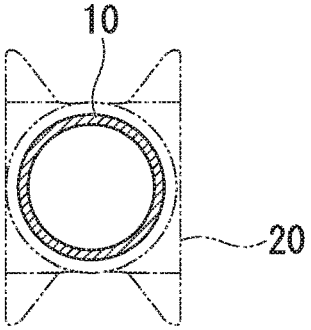
FIG. 3D is a sectional view taken along line D-D in FIG. 2.

FIG. 1 is a perspective view showing a schematic configuration of a lateral link 1 in which a bush holding portion 20 is formed on an end portion of a steel pipe (metal pipe). FIG. 2 is a front view showing the schematic configuration of the lateral link 1. FIG. 3A is a sectional view taken along line A-A in FIG. 2. FIG. 3B is a sectional view taken along line B-B in FIG. 2. FIG. 3C is a sectional view taken along line C-C in FIG. 2. FIG. 3D is a sectional view taken along line D-D in FIG. 2.

As shown in FIGS. 1 and 2, the lateral link 1 includes a rod portion 10, the bush holding portion 20 which is connected to one end of the rod portion 10, and a fastening portion 30 which is connected to the other end of the rod portion 10.

For example, the bush holding portion 20 can be connected to an axle by a shaft member or the like which is fitted and inserted via a bush (not shown). The fastening portion 30 can be connected to a vehicle body (not shown) by a bolt or the like.

The rod portion 10 is configured of a hollow steel pipe (metal pipe) in which a cross section orthogonal to a longitudinal direction is a closed cross section. The bush holding portion 20 and the fastening portion 30 are formed integrally with the rod portion 10 by plastically deforming both ends of the rod portion 10 by press forming.

For example, in the rod portion 10, the cross section orthogonal to the longitudinal direction has a circular peripheral wall section.

The bush holding portion 20 includes an expanded and tapered pipe portion 11, a straight portion 12, bush holding wall portions 21, and widening connection portions 22.

For example, the bush holding wall portions 21 are connected to the rod portion 10 via the widening connection portions 22. Each of the widening connection portions 22 is a connection shape portion which connects each of the bush holding wall portions 21 and the rod portion 10.

The expanded and tapered pipe portion 11 includes a conical taper in which a diameter gradually increases from a base end side toward a front end side by plastically deforming one end of the rod portion 10. The inner diameter of a front end opening portion of the expanded and tapered pipe portion 11 is larger than the inner diameter of the rod portion 10. The thickness of a peripheral wall section of the expanded and tapered pipe portion 11 is thinner than the thickness of a peripheral wall section of the rod portion 10.

The straight portion 12 is connected to the front end side of the expanded and tapered pipe portion 11. The inner diameter of the straight portion 12 is the same as the inner diameter of the front end opening portion of the expanded and tapered pipe portion 11. The thickness of a peripheral wall section of the straight portion 12 is the same as the thickness of the peripheral wall section of the expanded and tapered pipe portion 11.

The pair of bush holding wall portions 21 is flat portions which extend toward the outside in the longitudinal direction from the straight portion 12 so as to face each other and to be parallel to each other.

In a case in which the front end sides of the bush holding wall portions 21 are viewed from the base end side (rod portion 10 side), as shown in FIG. 3A, flat portions are formed on the front end sides of the bush holding wall portions 21 over the entire widths of the bush holding wall portions 21.

Hereinafter, one of the pair of bush holding wall portions 21 facing each other may be referred to as a first wall portion 211, and the other may be referred to as a second wall portion 212.

In addition, a bush holding hole 24 is formed at the center in a width direction of each of the bush holding wall portions 21. A burring shape portion 25 is formed on a peripheral edge portion of the bush holding hole 24.

The burring shape portions 25 mutually extend from the bush holding wall portions (first wall portion 211 and second wall portion 212) 21 toward the inside (opposite wall portion), and rising lengths of the burring shape portions 25 from the first wall portion 211 and the second wall portion 212 are the same as each other, and inner circumferential diameters of the burring shape portions 25 are the same as each other.

Hereinafter, as described above, the bush holding hole 24, in which the burring shape portion 25 (rising wall portions) is formed on the peripheral edge portion by burring, may be referred to as a burring hole.

As shown in FIG. 1, the pair of burring holes (bush holding holes 24) formed on the first wall portions 211 and the second wall portion 212 has a first axis line X orthogonal to the first wall portion 211 and the second wall portion 212 as the center axis lines. In other words, the center axis line of one of the pair of burring holes and the center axis line of the other one of the pair of burring holes coincide with the first axis line X.

A bush (not shown) is inserted into each of bush holding surfaces 25A (refer to FIG. 3A) which are formed on inner circumferences of the burring shape portions 25 and the bush holding holes 24, a shaft member or the like is inserted into the bushes, and the bush holding portion 20 is connected to an axle via the bushes. In addition, since an area (that is, area of the bush holding surface 25A) on the inner circumferential surface of the bush holding hole 24 formed on the peripheral edge portion can be largely secured, the burring shape portion 25 which is the rising wall portion can stably hold the bush or the like.

As shown in FIGS. 2 and 3B, the widening connection portion 22 includes a pair of wall portions, which includes bent portions in which cross sections orthogonal to the rod portion 10 approach each other and has an approximately channel shape, on both ends. The front end side of the widening connection portion 22 is connected to the bush holding wall portion 21, and the base end side of the widening connection portion 22 is connected to the front end section of the straight portion 12.

In addition, the widening connection portion 22 is plastically deformed such that a V-shaped gap is formed from the base end side toward the front end side in the front view, the bent portions on both ends are shortened, and the widths of the flat portions increase.

As a result, the cross section of the widening connection portion 22 is formed in an approximately channel shape, and the widening connection portion 22 is formed such that the shape is gradually changed from the channel-shaped cross section to the flat portion while the width increases from the base end side toward the front end side.

FIG. 3C shows a cross section when the bush holding portion 20 is viewed from the straight portion 12 in the longitudinal direction of the rod portion 10. In addition, FIG. 3D shows a cross section when the bush holding portion 20 is viewed from the rod portion 10 in the longitudinal direction of the rod portion 10.

In addition, in the pair of wall portions configuring the bush holding wall portions 21 and the widening connection portions 22, the length in the cross section orthogonal to the rod portion 10 is the same as the circumference of the peripheral wall section of the straight portion 12 (except for the width of the slit which is formed during the manufacturing process) in which the steel pipe is expanded.

As shown in FIG. 2, the fastening portion 30 includes fastening wall portions 31, first separation connection portions 32, and second separation connection portions 33.

The fastening wall portions 31 are connected to the rod portion 10 via the first separation connection portions 32 and the second separation connection portions 33. The first separation connection portions 32 and the second separation connection portions 33 are connection shape portions which connect the fastening wall portions 31 and the rod portion 10.

The fastening wall portions 31 include a pair of facing wall portions having flat portions facing each other on the front end sides. For example, in a case in which the front end sides of the fastening wall portions 31 are viewed from the base end sides (rod portion 10 sides), flat portions are formed over the entire widths of the fastening wall portions 31. In addition, attachment holes 34 are formed at the centers of the fastening wall portions 31 in the width direction.

For example, the first separation connection portions 32 include a pair of channel-shaped wall portions which has bent portions in which cross sections orthogonal to the rod portion 10 approach each other on both ends. The fastening wall portions 31 are connected to the front end sides of the first separation connection portions 32, and the second separation connection portions 33 are connected to the base end sides of the first separation connection portions 32.

In addition, the first separation connection portions 32 are plastically deformed such that a V-shaped gap in a front view is formed from the base end side toward the front end side and widths of flat portions increase while bent portions on both ends decrease. In addition, reinforcing beads which swell inward from the inside and extend in the longitudinal direction are formed at the centers of the first separation connection portions 32 in the width direction.

The second separation connection portions 33 include a pair of approximately channel-shaped wall portions which has bent portions in which cross sections orthogonal to the rod portion 10 approach each other on both ends. The first separation connection portions 32 are connected to the front end sides of the second separation connection portions 33 and the rod portion 10 is connected to the base end sides of the second separation connection portions 33.

In addition, in the second separation connection portions 33, the cross sections are formed in approximately channel shapes in which bent portions formed on both ends approach each other, and in a front view, the second separation connection portions 33 are formed in a V shape in which the pair of wall portions is gradually separated from each other from the base end side toward the front end side.

In addition, one reinforcing bead which swells inward from the inside and extends in the longitudinal direction is formed at the centers of the second separation connection portions 33 in the width direction.

According to this configuration, the cross sections of the second separation connection portions 33 are formed in approximately channel shapes, and the second separation connection portions 33 are connected to the first separation connection portions 32 while being separated from each other from the base end sides toward the front end sides. The cross sections of the first separation connection portions 32 are formed in approximately channel shapes, and the first separation connection portions 32 are formed such that the cross sections are gradually changed from channel shapes to flat portions.

In addition, in the pair of wall portions configuring the fastening wall portions 31, the first separation connection portions 32, and the second separation connection portions 33, the length in the cross section orthogonal to the rod portion 10 is the same as the circumference of the peripheral wall section (except for the width of the slit which is formed during the manufacturing process) of the steel pipe.

Figure 4:
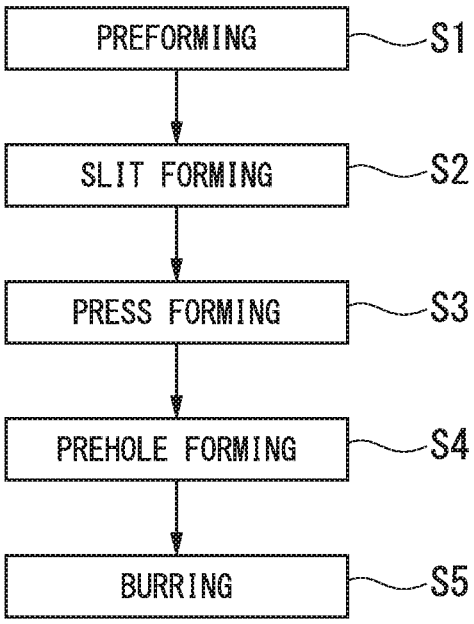
FIG. 4 is a flowchart showing a manufacturing process of the lateral link 1.

Next, with reference to FIGS. 4 and 5A to 5E, a method for forming the bush holding portion 20 will be described. FIG. 4 is a diagram showing an example of a flowchart showing a manufacturing process of a lateral link by integrally forming the bush holding portion 20 on the end portion of the steel pipe.

In addition, FIGS. 5A to 5E are views showing the manufacturing process in which the bush holding portion 20 is integrally formed.

(1) First, for example, a pipe expansion punch (not shown) is inserted into a steel pipe 10M configuring the rod portion 10, and a formation planned portion 20A for forming the bush holding portion 20 is formed (Step S1 shown in FIG. 4).

Figure 5A:
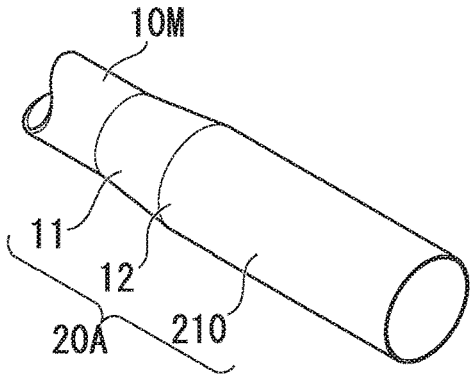
FIG. 5A is a first explanatory view with respect to the manufacturing process of the lateral link 1 in detail.

As shown in FIG. 5A, the formation planned portion 20A includes the expanded and tapered pipe portion 11 in which the diameter is conically increased from the base end side of the steel pipe 10M toward the front end side by a pipe expansion punch or the like, the straight portion 12, and a formation planned portion 210 in which the bush holding portion 20 is formed, and the circumference of the formation planned portion 20A is longer than that of the steel pipe 10M, and the thickness of the formation planned portion 20A is thinner than that of the steel pipe 10M.

(2) Next, two slits 210S extending in the longitudinal direction are formed on the steel pipe 10M, two wall portions 210A before press forming in which lengths in the circumferential direction are the same as each other are provided, and a division wall portion 20B corresponding to the bush holding portion 20 is formed (Step S2 shown in FIG. 4).

Figure 5B:
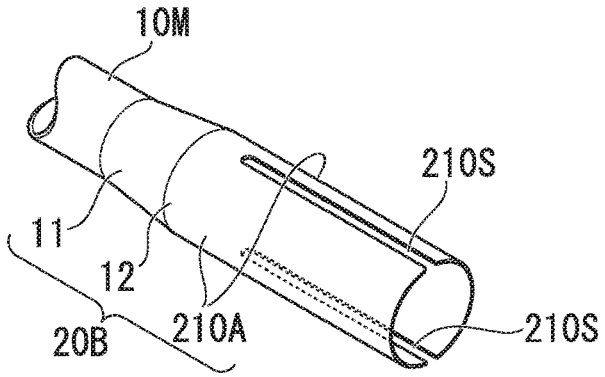
FIG. 5B is a second explanatory view with respect to the manufacturing process of the lateral link 1 in detail.

For example, as shown in FIG. 5B, the pair of facing wall portions 210A before press forming having the same shape is formed by forming two slits 210S at circumferential positions symmetrical to the center axis of the formation planned wall portion 210.

(3) Next, the wall portions 210A before press forming are plastically deformed into the bush holding wall portions 210C after press forming by press-forming the wall portions 210A before press forming (Step S3 shown in FIG. 4).

Figure 5C:
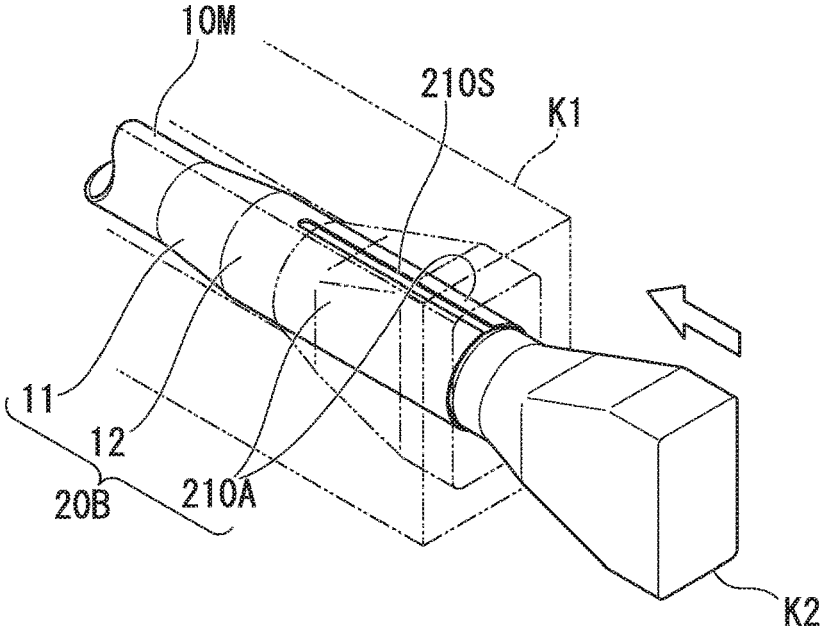
FIG. 5C is a third explanatory view with respect to the manufacturing process of the lateral link 1 in detail.
Figure 5D:
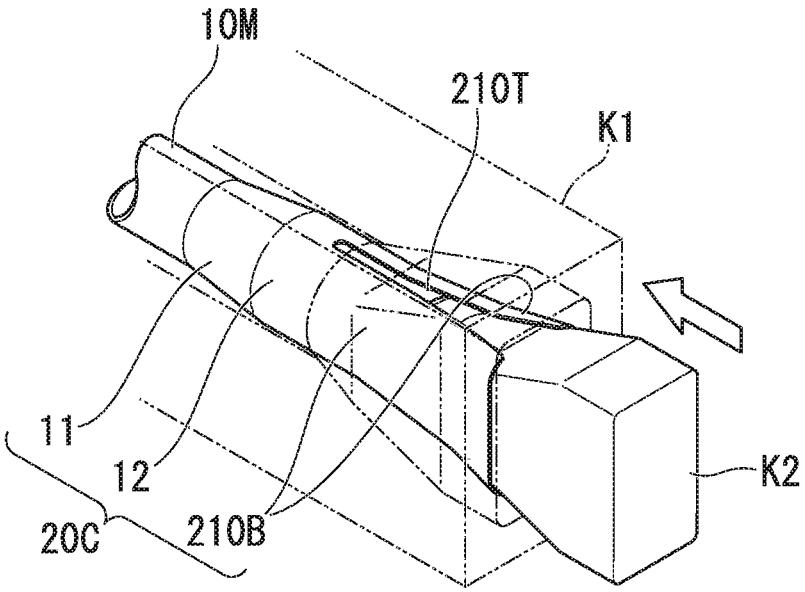
FIG. 5D is a fourth explanatory view with respect to the manufacturing process of the lateral link 1 in detail.
Figure 5E:
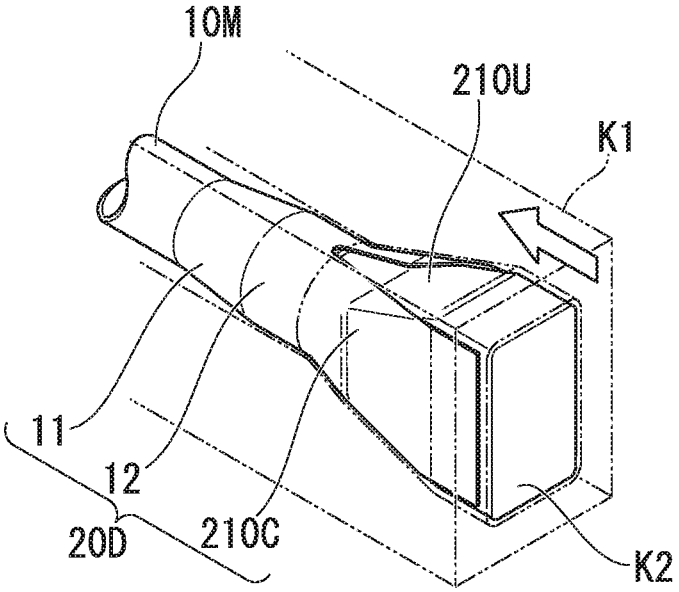
FIG. 5E is a fifth explanatory view with respect to the manufacturing process of the lateral link 1 in detail.

For example, the press forming is performed according to procedures shown in FIGS. 5C to 5E.

1) First, as shown in FIG. 5C, the steel pipe 10M is set by a press mold K1, and a punch K2 advances in the axial direction of the steel pipe 10M and is inserted into the wall portions 210A before press forming.

2) Next, as shown in FIG. 5D, each of the slits 210S is formed in an approximately V-shaped slit 210T by advancing the punch K2, the wall portions 210A before press forming are plastically deformed into intermediate shape wall portions 210B in which bent portions are formed on both ends in the width direction and the bent portions are shortened toward the front end sides such that the shapes are changed to the flat portions, and an intermediate wall portion 20C of the bush holding portion 20 is formed.

3) Next, as shown in FIG. 5E, each of the slits 210T is formed to a slit 210U by advancing the punch K2 to the advance end, the intermediate shape wall portions 210B are formed to the bush holding wall portions 210C after press forming, and a bush holding portion 20D before trimming is formed, which corresponds to the bush holding portion 20 in which the front ends are separated from each other at approximately the same interval as the outer diameter of the expanded steel pipe 10M.

According to the processes, the pair of bush holding wall portions 21 (first wall portion 211 and second wall portion 212) is formed, which face each other and extends from the straight portion 12 to the outside in the longitudinal direction so as to be parallel to each other.

(4) Next, prepared holes are formed, which have the first axis line X as the center axis lines with respect to the first wall portion 211 and the second wall portion 212 using a burring apparatus and a burring method of the present embodiment described below (Step S4 shown in FIG. 4).

(5) Finally, the bush holding holes 24 having the burring shape portions 25 which are the rising wall portions are formed by bending the peripheral edge portions of the prepared holes formed on the first wall portion 211 and the second wall portion 212 in the direction along the first axis line X using the burring apparatus and the burring method of the present embodiment (Step S5 shown in FIG. 4).

According to the processes, the lateral link 1 is completed, in which the burring holes (bush holding holes 24) having the first axis line X as the center axis lines are formed with respect to the first wall portion 211 and the second wall portion 212 (the pair of bush holding wall portions 21).

Hereinafter, the burring apparatus and the burring method of the present embodiment used in the above-described steps S4 and S5 will be described in detail.

First Embodiment

First, a burring apparatus and a burring method according to a first embodiment of the present invention will be described. In the first embodiment, as shown in FIGS. 1 and 2, a burring apparatus and a burring method for forming the burring hole having the rising wall portion which is bent toward the inside of the first wall portion 211 on the first wall portion 211, and the burring hole having the rising wall portion which is bent toward the inside of the second wall portion 212 on the second wall portion 212 will be described.

Moreover, in both sides of the first wall portion 211 on the first axis line X, the side on which the second wall portion 212 exists is defined as an "inside of the first wall portion 211", and the opposite side is defined as an "outside of the first wall portion 211". In addition, in both sides of the second wall portion 212 on the first axis line X, the side on which the first wall portion 211 exists is defined as an "inner side of the second wall portion 212", and the opposite side is defined as an "outer side of the second wall portion 212".

Figure 6A:
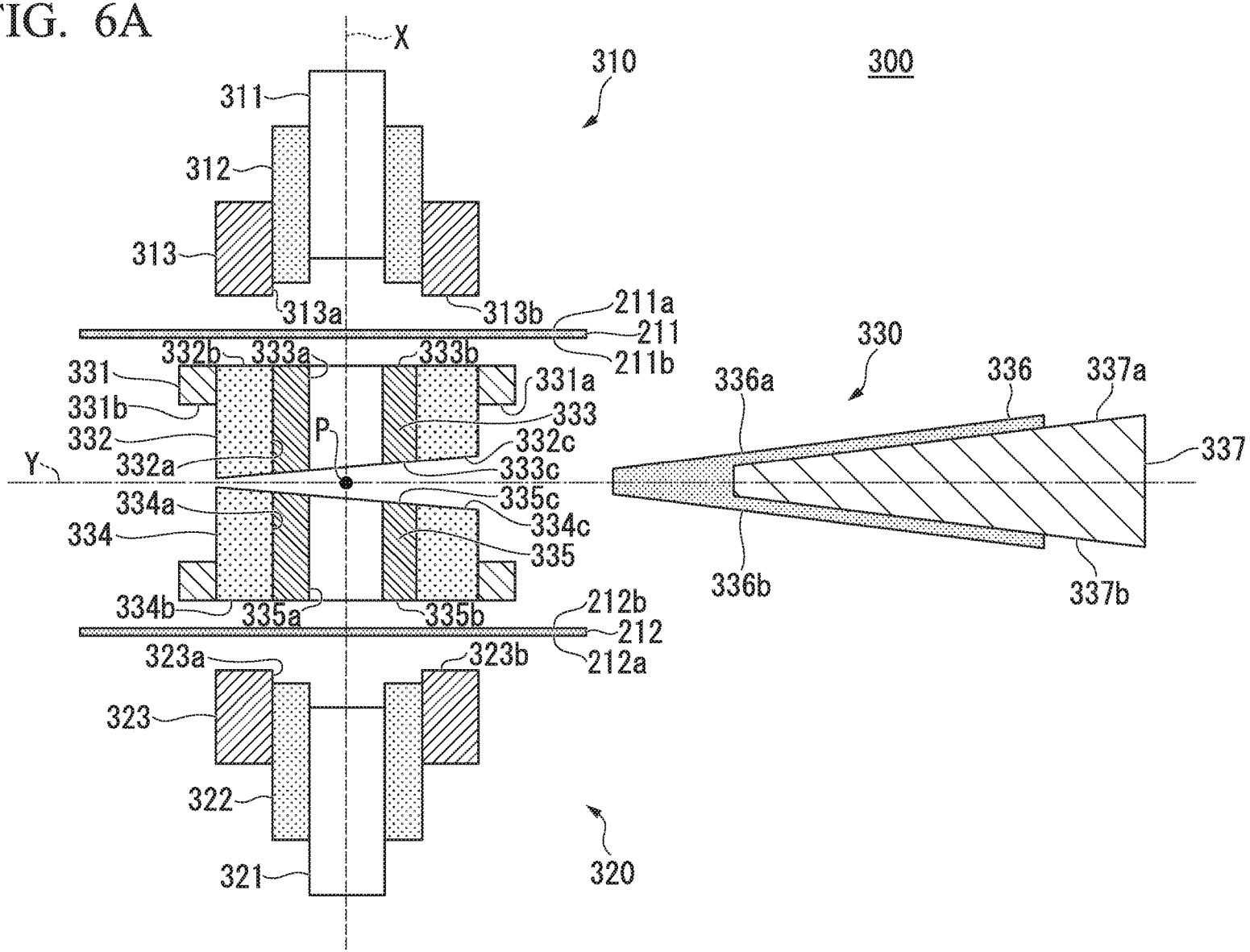
FIG. 6A is a side sectional view of a burring apparatus 300 according to a first embodiment of the present invention.
Figure 6B:
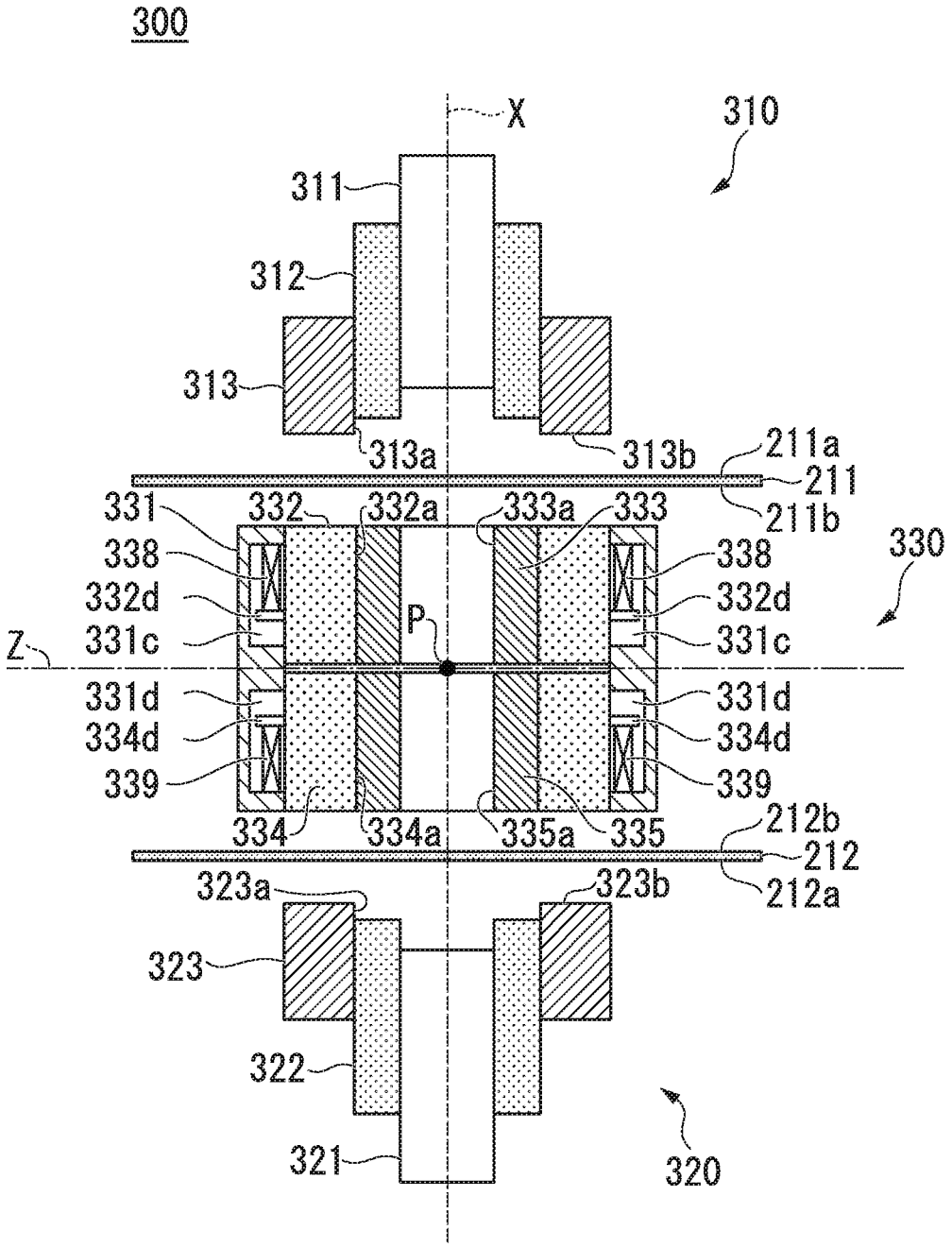
FIG. 6B is a front sectional view of the burring apparatus 300 according to the first embodiment of the present invention.

FIG. 6A is a side sectional view of a burring apparatus 300 according to the first embodiment. FIG. 6B is a front sectional view of the burring apparatus 300 according to the first embodiment.

As shown in FIG. 6A, a center position between the first wall portion 211 and the second wall portion 212 on the first axis line X is defined as a reference point P, and an axis line which is orthogonal to the first axis line X through the reference point P and is parallel to the extension directions of the first wall portion 211 and the second wall portion 212 is defined as a second axis line Y. The second axis line Y coincides with the center axis line of the lateral link 1. That is, FIG. 6A is a view when the burring apparatus 300 is viewed along a cross section including the first axis line X and the second axis line Y.

In addition, as shown in FIG. 6B, an axis line which is orthogonal to the first axis line X and the second axis line Y through the reference point P is defined as a third axis line Z. The third axis line Z is parallel to the width directions of the first wall portion 211 and the second wall portion 212. That is, FIG. 6B is a view when the burring apparatus 300 is viewed along a cross section (cross section orthogonal to the second axis line Y) including the first axis line X and the third axis line Z.

As shown in FIGS. 6A and 6B, the burring apparatus 300 includes a first external unit 310 which is disposed outside the first wall portion 211, a second external unit 320 which is disposed outside the second wall portion 212, and an internal unit 330 which is disposed between the first wall portion 211 and the second wall portion 212.

In the descriptions below, a piercing punch is a shaft member for forming a prepared hole for burring on the first wall portion 211 and the second wall portion 212. In addition, a burring punch is a shaft member for forming burring holes having rising wall portions by bending the peripheral edge portions of the prepared holes in the direction along the first axis line X.

The first external unit 310 includes a first piercing punch 311, a first burring punch 312, and a first burring holder 313.

The first piercing punch 311 is a columnar shaft member for forming the prepared holes on the first wall portion 211. The first burring punch 312 has the first axis line X as the center axis line along with the first piercing punch 311 and is a cylindrical shaft member for forming the burring holes on the first wall portion 211 by bending the peripheral edge portion of the prepared hole of the first wall portion 211 to the inside of the first wall portion 211. Both end surfaces of the first burring punch 312 are open such that the first piercing punch 311 can be inserted into the first burring punch 312.

The first burring holder 313 is a circular thick plate member which has a first through hole 313*a* serving as a passage of the first burring punch 312. The first through hole 313*a* is a circular hole which penetrates in a plate thickness direction of the first burring holder 313 and has the same center axis line as the center axis line of the first burring holder 313.

The first burring holder 313 is provided so as to be movable outside the first wall portion 211 along the first axis line X in a state where the center axis line of the first through hole 313*a* coincides with the first axis line X. In addition, the first burring holder 313 has a flat surface 313*b* which can come into surface contact with an outer wall surface 211*a* of the first wall portion 211.

The first burring punch 312 is provided so as to be movable between the outside and the inside of the first wall portion 211 along the first axis line X inside the first through hole 313*a* of the first burring holder 313 in a state where the center axis line of the first burring punch 312 coincides with the first axis line X.

The first piercing punch 311 is provided so as to be movable between the outside and the inside of the first wall portion 211 along the first axis line X inside the first burring punch 312 in a state where the center axis line of the first piercing punch 311 coincides with the first axis line X. That is, an internal space of the first burring punch 312 having a cylindrical shape is used as a passage of the first piercing punch 311.

As described above, in the first external unit 310, the first piercing punch 311, the first burring punch 312, and the first burring holder 313 have the first axis line X as the center axis lines.

In addition, in the first external unit 310, preferably, an inner circumferential surface of the first burring holder 313 (a surface of the first through hole 313*a*) and an outer circumferential surface of the first burring punch 312 come into close contact with each other. In addition, preferably, an inner circumferential surface of the first burring punch 312 and an outer circumferential surface of the first piercing punch 311 come into close contact with each other.

Accordingly, when the first piercing punch 311 and the first burring punch 312 move along the first axis line X, it is possible to prevent the center axis lines of the first piercing punch 311 and the first burring punch 312 from being deviated from the first axis line X.

The second external unit 320 includes a second piercing punch 321, a second burring punch 322, and a second burring holder 323.

The second piercing punch 321 is a columnar shaft member for forming the prepared holes on the second wall portion 212. The second burring punch 322 has the first axis line X as the center axis line along with the second piercing punch 321 and is a cylindrical shaft member for forming the burring holes on the second wall portion 212 by bending the peripheral edge portion of the prepared hole of the second wall portion 212 to the inside of the second wall portion 212. Both end surfaces of the second burring punch 322 are open such that the second piercing punch 321 can be inserted into the second burring punch 322.

The second burring holder 323 is a circular thick plate member which has a second through hole 323*a* serving as a passage of the second burring punch 322. The second through hole 323*a* is a circular hole which penetrates in a plate thickness direction of the second burring holder 323 and has the same center axis line as the center axis line of the second burring holder 323.

The second burring holder 323 is provided so as to be movable outside the second wall portion 212 along the first axis line X in a state where the center axis line of the second through hole 323*a* coincides with the first axis line X. In addition, the second burring holder 323 has a flat surface 323*b* which can come into surface contact with an outer wall surface 212*a* of the second wall portion 212.

The second burring punch 322 is provided so as to be movable between the outside and the inside of the second wall portion 212 along the first axis line X inside the second through hole 323*a* of the second burring holder 323 in a state where the center axis line of the second burring punch 322 coincides with the first axis line X.

The second piercing punch 321 is provided so as to be movable between the outside and the inside of the second wall portion 212 along the first axis line X inside the second burring punch 322 in a state where the center axis line of the second piercing punch 321 coincides with the first axis line X. That is, an internal space of the second burring punch 322 having a cylindrical shape is used as a passage of the second piercing punch 321.

As described above, in the second external unit 320, the second piercing punch 321, the second burring punch 322, and the second burring holder 323 have the first axis line X as the center axis lines.

In addition, in the second external unit 320, preferably, an inner circumferential surface of the second burring holder 323 (a surface of the second through hole 323*a*) and an outer circumferential surface of the second burring punch 322 come into close contact with each other. In addition, preferably, an inner circumferential surface of the second burring punch 322 and an outer circumferential surface of the second piercing punch 321 come into close contact with each other.

Accordingly, when the second piercing punch 321 and the second burring punch 322 move along the first axis line X, it is possible to prevent the center axis lines of the second piercing punch 321 and the second burring punch 322 from being deviated from the first axis line X.

The internal unit 330 includes a housing 331, a first burring die 332, a first piercing die 333, a second burring die 334, a second piercing die 335, a first stopper 336, and a second stopper 337.

The housing 331 is a cylindrical member which includes the first burring die 332, the first piercing die 333, the second burring die 334, and the second piercing die 335 and in which both end surfaces are open. The housing 331 is disposed between the first wall portion 211 and the second wall portion 212 in a state where the center axis line of the housing coincides with the first axis line X. In addition, the housing 331 includes a first opening portion 331*a* and a second opening portion 331*b* which are open to have sizes of the openings through which the first stopper 336 and the second stopper 337 can pass along the second axis line Y.

The first burring die 332 is a circular thick plate member having a first forming hole 332*a* into which the first burring punch 312 is inserted. The first forming hole 332*a* is a circular hole which penetrates along the plate thickness direction of the first burring die 332 and has the same center axis line as the center axis line of the first burring die 332. Preferably, the diameter of the first forming hole 332*a* has the same value as the sum of the outer diameter of the first burring punch 312 and the thickness of the first wall portion 211.

The first burring die 332 is provided so as to be movable inside the first wall portion 211 along the first axis line X inside the housing 331 in a state where the center axis line of the first forming hole 332*a* coincides with the first axis line X. In addition, the first burring die 332 includes a flat surface 332*b* which can come into surface contact with an inner wall surface 211*b* of the first wall portion 211 and an inclined surface 332*c* which is inclined in a direction toward the first wall portion 211 with respect to the second axis line Y.

The first piercing die 333 is a circular thick plate member having a first piercing hole 333*a* into which the first piercing punch 311 is inserted. The first piercing hole 333*a* is a circular hole which penetrates along the plate thickness direction of the first piercing die 333 and has the same center axis line as the center axis line of the first piercing die 333. Preferably, the diameter of the first piercing hole 333*a* is the same as the outer diameter of the first piercing punch 311.

The first piercing die 333 is provided so as to be movable inside the first wall portion 211 along the first axis line X inside the first forming hole 332*a* of the first burring die 332 in a state where the center axis line of the first piercing hole 333*a* coincides with the first axis line X. In addition, the first piercing die 333 includes a flat surface 333*b* which can come into surface contact with an inner wall surface 211*b* of the first wall portion 211 and an inclined surface 333*c* which is inclined in the direction toward the first wall portion 211 with respect to the second axis line Y. The inclination angle of the inclined surface 333*c* of the first piercing die 33 is the same as the inclination angle of the inclined surface 332*c* of the first burring die 332.

The second burring die 334 is a circular thick plate member having a second forming hole 334*a* into which the second burring punch 322 is inserted. The second forming hole 334*a* is a circular hole which penetrates along the plate thickness direction of the second burring die 334 and has the same center axis line as the center axis line of the second burring die 334. Preferably, the diameter of the second forming hole 334*a* has the same value as the sum of the outer diameter of the second burring punch 322 and the thickness of the second wall portion 212.

The second burring die 334 is provided so as to be movable inside the second wall portion 212 along the first axis line X inside the housing 331 in a state where the center axis line of the second forming hole 334*a* coincides with the first axis line X. In addition, the second burring die 334 includes a flat surface 334*b* which can come into surface contact with an inner wall surface 212*b* of the second wall portion 212 and an inclined surface 334*c* which is inclined in a direction toward the second wall portion 212 with respect to the second axis line Y.

The second piercing die 335 is a circular thick plate member having a second piercing hole 335*a* into which the second piercing punch 321 is inserted. The second piercing hole 335*a* is a circular hole which penetrates along the plate thickness direction of the second piercing die 335 and has the same center axis line as the center axis line of the second piercing die 335. Preferably, the diameter of the second piercing hole 335*a* is the same as the outer diameter of the second piercing punch 321.

The second piercing die 335 is provided so as to be movable inside the second wall portion 212 along the first axis line X inside the second forming hole 334*a* of the second burring die 334 in a state where the center axis line of the second piercing hole 335*a* coincides with the first axis line X. In addition, the second piercing die 335 includes a flat surface 335*b* which can come into surface contact with an inner wall surface 212*b* of the second wall portion 212 and an inclined surface 335*c* which is inclined in the direction toward the second wall portion 212 with respect to the second axis line Y. The inclination angle of the inclined surface 335*c* of the second piercing die 335 is the same as the inclination angle of the inclined surface 334*c* of the second burring die 334.

The first burring die 332 and the second burring die 334 are disposed so as to face each other in a state where the reference point P is interposed therebetween. The first burring die 332 is movable between the first wall portion 211 and the reference point P along the first axis line X. The second burring die 334 is movable between the second wall portion 212 and the reference point P along the first axis line X.

The first piercing die 333 and the second piercing die 335 are disposed so as to face each other in a state where the reference point P is interposed therebetween. The first piercing die 333 is movable between the first wall portion 211 and the reference point P along the first axis line X. The second piercing die 335 is movable between the second wall portion 212 and the reference point P along the first axis line X.

When the entire first piercing die 333 is included inside the first burring die 332 (inside the first forming hole 332*a*), the flat surface 332*b* of the first burring die 332 and the flat surface 333*b* of the first piercing die 333 are flush with each other, and the inclined surface 332*c* of the first burring die 332 and the inclined surface 333*c* of the first piercing die 333 are flush with each other.

When the entire second piercing die 335 is included inside the second burring die 334 (inside the second forming hole 334*a*), the flat surface 334*b* of the second burring die 334 and the flat surface 335*b* of the second piercing die 335 are flush with each other, and the inclined surface 334*c* of the second burring die 334 and the inclined surface 335*c* of the second piercing die 335 are flush with each other.

The inclination angle of the inclined surface 332*c* of the first burring die 332 (the inclined surface 333*c* of the first piercing die 333) is the same as the inclination angle of the inclined surface 334*c* of the second burring die 334 (the inclined surface 335*c* of the second piercing die 335).

The first stopper 336 is a thick plate member which is provided so as to be movable along the second axis line Y. The first stopper 336 includes a first inclined surface 336*a* which is inclined toward the first wall portion 211 with respect to the second axis line Y, and a second inclined surface 336*b* which is inclined toward the second wall portion 212 with respect to the second axis line Y.

The inclination angle of the first inclined surface 336*a* is the same as the inclination angle of the inclined surface 332*c* of the first burring die 332 (the inclined surface 333*c* of the first piercing die 333). The inclination angle of the second inclined surface 336*b* is the same as the inclination angle of the inclined surface 334*c* of the second burring die 334 (the inclined surface 335*c* of the second piercing die 335). That is, the inclination angle of the first inclined surface 336*a* is the same as the inclination angle of the second inclined surface 336*b*.

Although the details will be described below, in a process in which the first stopper 336 passes through the reference point P along the second axis line Y, the first inclined surface 336*a* of the first stopper 336 comes into surface contact with the inclined surface 332*c* of the first burring die 332, and the second inclined surface 336*b* of the first stopper 336 comes into surface contact with the inclined surface 334*c* of the second burring die 334.

In the state where the first stopper 336 comes into surface contact with the first burring die 332 and the second burring die 334, if the first stopper 336 advances deeper from the reference point P, the first burring die 332 moves toward the first wall portion 211, and the second burring die 334 moves toward the second wall portion 212.

As a result, the flat surface 332*b* of the first burring die 332 comes into surface contact with the inner wall surface 211*b* of the first wall portion 211, and the flat surface 334*b* of the second burring die 334 comes into surface contact with the inner wall surface 212*b* of the second wall portion 212.

In this way, in the process in which the first stopper 336 passes through the reference point P along the second axis line Y, the first stopper 336 has a shape which causes the first burring die 332 to move toward the first wall portion 211 and the second burring die 334 to move toward the second wall portion 212.

The second stopper 337 is a thick plate member which is provided so as to be movable along the second axis line Y. The second stopper 337 includes a third inclined surface 337*a* which is inclined toward the first wall portion 211 with respect to the second axis line Y, and a fourth inclined surface 337*b* which is inclined toward the second wall portion 212 with respect to the second axis line Y.

The inclination angle of the third inclined surface 337*a* is the same as the inclination angle of the inclined surface 332*c* of the first burring die 332 (the inclined surface 333*c* of the first piercing die 333). The inclination angle of the fourth inclined surface 337*b* is the same as the inclination angle of the inclined surface 334*c* of the second burring die 334 (the inclined surface 335*c* of the second piercing die 335). That is, the inclination angle of the third inclined surface 337*a* is the same as the inclination angle of the fourth inclined surface 337*b*.

Although the details will be described below, in a process in which the second stopper 337 passes through the reference point P along the second axis line Y, the third inclined surface 337*a* of the second stopper 337 comes into surface contact with the inclined surface 333*c* of the first piercing die 333, and the fourth inclined surface 337*b* of the second stopper 337 comes into surface contact with the inclined surface 335*c* of the second piercing die 335.

In the state where the second stopper 337 comes into surface contact with the first piercing die 333 and the second piercing die 335, if the second stopper 337 advances deeper from the reference point P, the first piercing die 333 moves toward the first wall portion 211, and the second piercing die 335 moves toward the second wall portion 212.

As a result, the flat surface 333*b* of the first piercing die 333 comes into surface contact with the inner wall surface 211*b* of the first wall portion 211, and the flat surface 335*b* of the second piercing die 335 comes into surface contact with the inner wall surface 212*b* of the second wall portion 212.

In this way, in the process in which the second stopper 337 passes through the reference point P along the second axis line Y, the second stopper 337 has a shape which causes the first piercing die 333 to move toward the first wall portion 211 and the second piercing die 335 to move toward the second wall portion 212.

As shown in FIG. 6B, in the inner circumferential surface of the housing 331, a first groove 331*c* which has a predetermined depth in the direction along the third axis line Z and a predetermined width in the direction along the first axis line X is formed on a region facing the first burring die 332. A first protruding portion 332*d* which protrudes toward the first groove 331*c* is provided on the outer circumferential surface of the first burring die 332. A first spring 338 is disposed between the side wall surface of the first wall portion 211 side of the first groove 331*c* and the first protruding portion 332*d* such that the extension and contraction directions of the first spring 338 are parallel to the first axis line X.

In addition, as shown in FIG. 6B, in the inner circumferential surface of the housing 331, a second groove 331*d* which has a predetermined depth in the direction along the third axis line Z and a predetermined width in the direction along the first axis line X is formed on a region facing the second burring die 334. A second protruding portion 334*d* which protrudes toward the second groove 331*d* is provided on the outer circumferential surface of the second burring die 334. A second spring 339 is disposed between the side wall surface of the second wall portion 212 side of the second groove 331*d* and the second protruding portion 334*d* such that the extension and contraction directions of the second spring 339 are parallel to the first axis line X.

If the first burring die 332 having the first protruding portion 332*d* moves toward the first wall portion 211, the first spring 338 is compressed, and as a result, an external force toward the reference point P is applied to the first burring die 332. In addition, if the second burring die 334 having the second protruding portion 334*d* moves toward the second wall portion 212, the second spring 339 is compressed, and as a result, an external force toward the reference point P is applied to the second burring die 334.

In this way, the internal unit 330 includes a die return mechanism which separately applies the external force toward the reference point P to each of the first burring die 332 and the second burring die 334.

In the internal unit 330 configured as described above, the housing 331, the first burring die 332, the first piercing die 333, the second burring die 334, and the second piercing die 335 have the first axis line X as the center axis lines.

In addition, in the internal unit 330, preferably, the inner circumferential surface of the housing 331 and the outer circumferential surface of the first burring die 332 come into close contact with each other, and preferably, the inner circumferential surface of the housing 331 and the outer circumferential surface of the second burring die 334 come into close contact with each other.

In addition, preferably, the inner circumferential surface of the first burring die 332 (the surface of the first forming hole 332*a*) and the outer circumferential surface of the first piercing die 333 come into close contact with each other, and preferably, the inner circumferential surface of the second burring die 334 (the surface of the second forming hole 334*a*) and the outer circumferential surface of the second piercing die 335 come into close contact with each other.

Accordingly, when each of the first burring die 332, the first piercing die 333, the second burring die 334, and the second piercing die 335 moves along the first axis line X, it is possible to prevent the center axis line from being deviated from the first axis line X.

Next, the burring method according to the first embodiment which is realized using the burring apparatus 300 configured as described above will be described.

<First Process>

First, as shown in FIGS. 6A and 6B, the first external unit 310 of the burring apparatus 300 is disposed outside the first wall portion 211, the second external unit 320 of the burring apparatus 300 is disposed outside the second wall portion 212, and the internal unit 330 of the burring apparatus 300 is disposed between the first wall portion 211 and the second wall portion 212.

That is, in a state where the first piercing punch 311, the first burring punch 312, and the first burring holder 313 have the first axis line X as the center axis lines, the first external unit 310 is disposed outside the first wall portion 211.

In addition, in a state where the second piercing punch 321, the second burring punch 322, and the second burring holder 323 have the first axis line X as the center axis lines, the second external unit 320 is disposed outside the second wall portion 212.

Moreover, in a state where the housing 331, the first burring die 332, the first piercing die 333, the second burring die 334, and the second piercing die 335 have the first axis line X as the center axis lines, the housing 331 of the internal unit 330 is disposed between the first wall portion 211 and the second wall portion 212.

In addition, at this time, the first stopper 336 and the second stopper 337 are disposed outside the housing 311.

Figure 7:
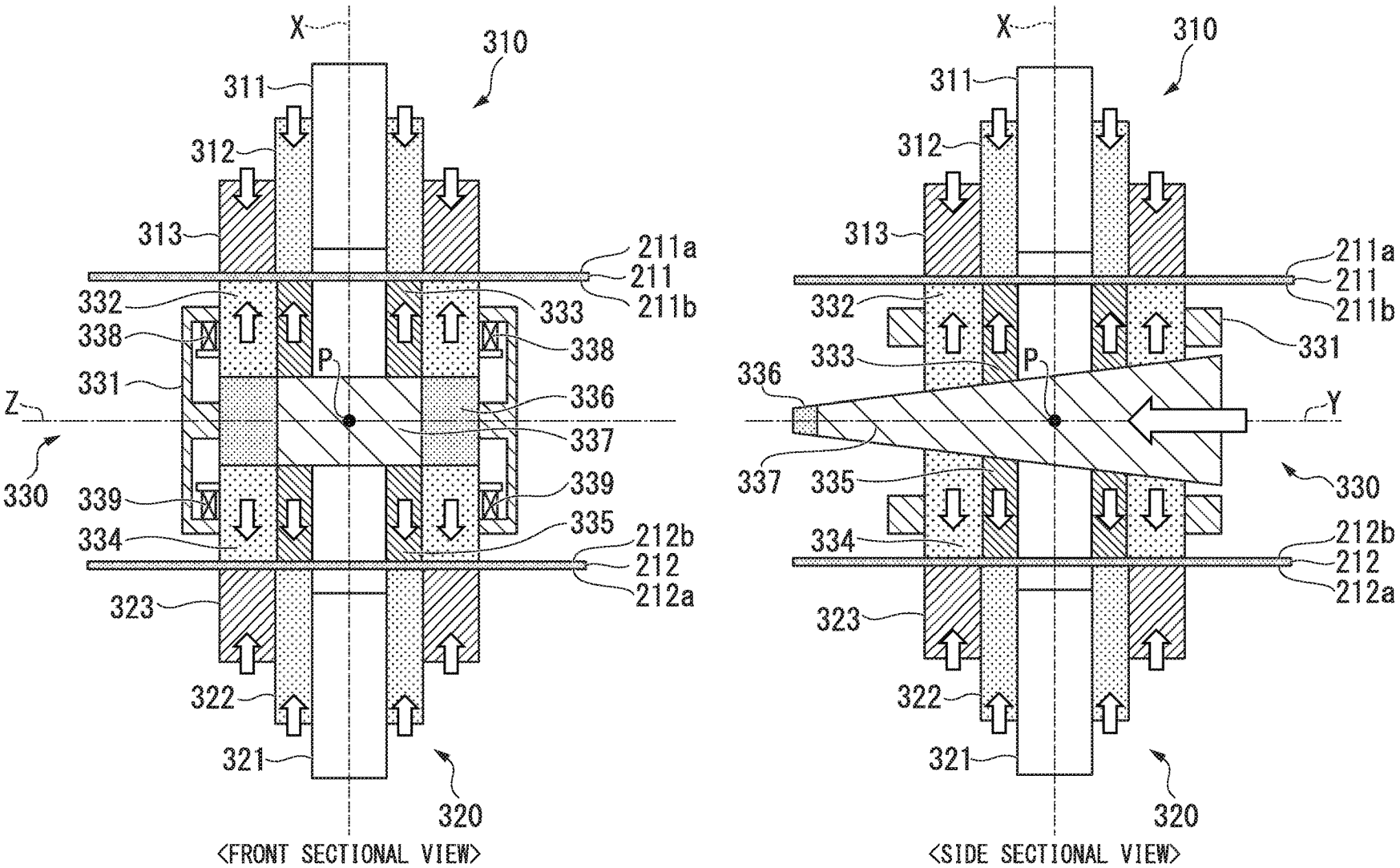
FIG. 7 is an explanatory view with respect to a first process of a burring method according to the first embodiment of the present invention.

Subsequently, as shown in FIG. 7, in the first external unit 310, the first burring punch 312 and the first burring holder 313 move toward the first wall portion 211 along the first axis line X using an actuator (not shown) until the first burring punch 312 and the first burring holder 313 come into contact with the outer wall surface 211*a* of the first wall portion 211.

After the first burring punch 312 and the first burring holder 313 come into contact with the outer wall surface 211*a* of the first wall portion 211, the first burring punch 312 and the first burring holder 313 come into pressure contact with the outer wall surface 211*a* of the first wall portion 211 by applying a pressing force to the first burring punch 312 and the first burring holder 313 in a direction toward the first wall portion 211 using the actuator.

Similarly, in the second external unit 320, the second burring punch 322 and the second burring holder 323 move toward the second wall portion 212 using an actuator (not shown) until the second burring punch 322 and the second burring holder 323 come into contact with the outer wall surface 212*a* of the second wall portion 212.

After the second burring punch 322 and the second burring holder 323 come into contact with the outer wall surface 212*a* of the second wall portion 212, the second burring punch 322 and the second burring holder 323 come into pressure contact with the outer wall surface 212*a* of the second wall portion 212 by applying a pressing force to second burring punch 322 and the second burring holder 323 in a direction toward the second wall portion 212 using the actuator.

In addition, in the internal unit 330, the first stopper 336 moves toward the reference point P along the second axis line Y using an actuator (not shown). In the process in which the first stopper 336 passes through the reference point P along the second axis line Y, the first burring die 332 moves toward the first wall portion 211 and the second burring die 334 moves toward the second wall portion 212 while the first inclined surface 336*a* of the first stopper 336 comes into surface contact with the inclined surface 332*c* of the first burring die 332 and the second inclined surface 336*b* of the first stopper 336 comes into surface contact with the inclined surface 334*c* of the second burring die 334.

The first stopper 336 moves along the second axis line Y to a position at which the flat surface 332*b* of the first burring die 332 comes into surface contact with the inner wall surface 211*b* of the first wall portion 211 and the flat surface 334*b* of the second burring die 334 comes into surface contact with the inner wall surface 212*b* of the second wall portion 212.

By further moving the first stopper 336 from the position by a predetermined distance, the pressing force is applied to the first burring die 332 in the direction toward the first wall portion 211, and the pressing force is applied to the second burring die 334 in the direction toward the second wall portion 212.

As a result, the first burring die 332 comes into pressure contact with the inner wall surface 211*b* of the first wall portion 211, and the second burring die 334 comes into pressure contact with the inner wall surface 212*b* of the second wall portion 212.

In this way, by inserting the first stopper 336 into a portion between the first burring die 332 and the second burring die 334, the first burring die 332 comes into pressure contact with the inner wall surface 211*b* of the first wall portion 211, and the second burring die 334 comes into pressure contact with the inner wall surface 212*b* of the second wall portion 212.

At this time, since the first spring 338 inside the housing 331 is compressed according to the movement of the first burring die 332, the external force toward the reference point P is always applied to the first burring die 332. Similarly, since the second spring 339 inside the housing 331 is compressed according to the movement of the second burring die 334, the external force toward the reference point P is always applied to the second burring die 334.

Moreover, in the internal unit 330, the second stopper 337 moves toward the reference point P along the second axis line Y using an actuator (not shown). In the process in which the second stopper 337 passes through the reference point P along the second axis line Y, the first piercing die 333 moves toward the first wall portion 211 and the second piercing die 335 moves toward the second wall portion 212 while the third inclined surface 337*a* of the second stopper 337 comes into surface contact with the inclined surface 333*c* of the first piercing die 333 and the fourth inclined surface 337*b* of the second stopper 337 comes into surface contact with the inclined surface 335*c* of the second piercing die 335.

The second stopper 337 moves along the second axis line Y at a position at which the flat surface 333*b* of the first piercing die 333 comes into surface contact with the inner wall surface 211*b* of the first wall portion 211 and the flat surface 335*b* of the second piercing die 335 comes into surface contact with the inner wall surface 212*b* of the second wall portion 212.

By further moving the second stopper 337 from the position by a predetermined distance, the pressing force is applied to the first piercing die 333 in the direction toward the first wall portion 211, and the pressing force is applied to the second piercing die 335 in the direction toward the second wall portion 212.

As a result, the first piercing die 333 comes into pressure contact with the inner wall surface 211*b* of the first wall portion 211, and the second piercing die 335 comes into pressure contact with the inner wall surface 212*b* of the second wall portion 212.

In this way, by inserting the second stopper 337 into a portion between the first piercing die 333 and the second piercing die 335, the first piercing die 333 comes into pressure contact with the inner wall surface 211*b* of the first wall portion 211, and the second piercing die 335 comes into pressure contact with the inner wall surface 212*b* of the second wall portion 212.

In addition, the insertion of the first stopper 336 and the insertion of the second stopper 337 may be performed at timings different from each other, or may be simultaneously performed.

As shown in FIG. 7, at the time when the above-described first process ends, the first burring punch 312 and the first piercing die 333 are disposed so as to face each other in a state where the first wall portion 211 is interposed therebetween, and the first burring holder 313 and the first burring die 332 are disposed so as to face each other in a state where the first wall portion 211 is interposed therebetween.

In addition, the second burring punch 322 and the second piercing die 335 are disposed so as to face each other in a state where the second wall portion 212 is interposed therebetween, and the second burring holder 323 and the second burring die 334 are disposed so as to face each other in a state where the second wall portion 212 is interposed therebetween.

<Second Process>

Figure 8:
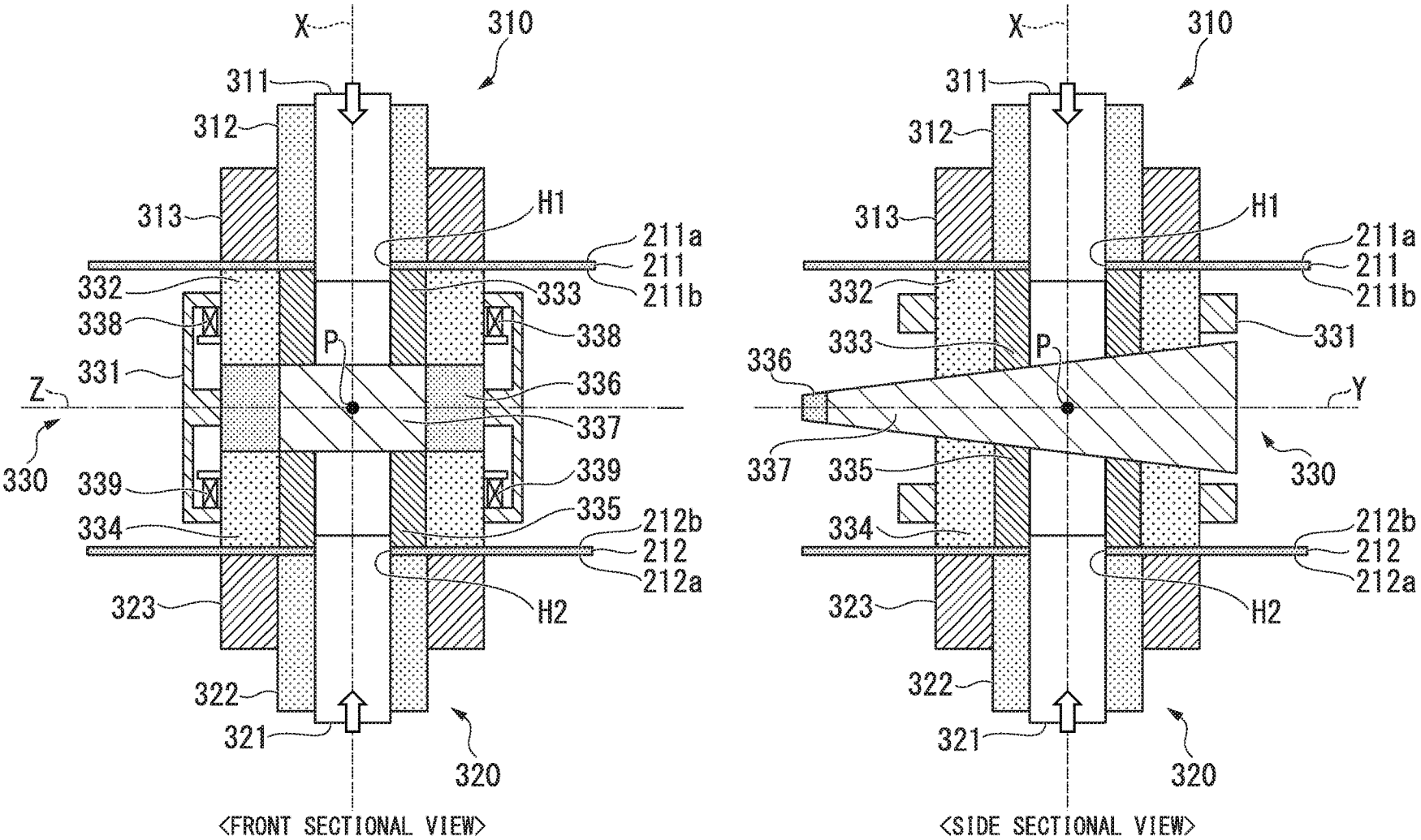
FIG. 8 is a first explanatory view with respect to a second process of the burring method according to the first embodiment of the present invention.

Subsequently, as shown in FIG. 8, by moving the first piercing punch 311 from the outside of the first wall portion 211 to the inside thereof along the first axis line X using an actuator (not shown) such that the first piercing punch 311 is inserted into the first piercing hole 333*a* of the first piercing holder 333, one of the prepared holes is formed on the first wall portion 211.

Accordingly, a prepared hole H1, which has the first axis line X as the center axis line and has the same diameter as the outer diameter of the first piercing punch 311, is formed on the first wall portion 211.

Similarly, by moving the second piercing punch 321 from the outside of the second wall portion 212 to the inside thereof along the first axis line X using an actuator (not shown) such that the second piercing punch 321 is inserted into the second piercing hole 335*a* of the second piercing holder 335, the other prepared hole is formed on the second wall portion 212.

Accordingly, a prepared hole H2, which has the first axis line X as the center axis line and has the same diameter as the outer diameter of the second piercing punch 321, is formed on the second wall portion 212.

In addition, the formations of the prepared holes H1 and H2 may be performed at timings different from each other, or may be simultaneously performed.

Figure 9:
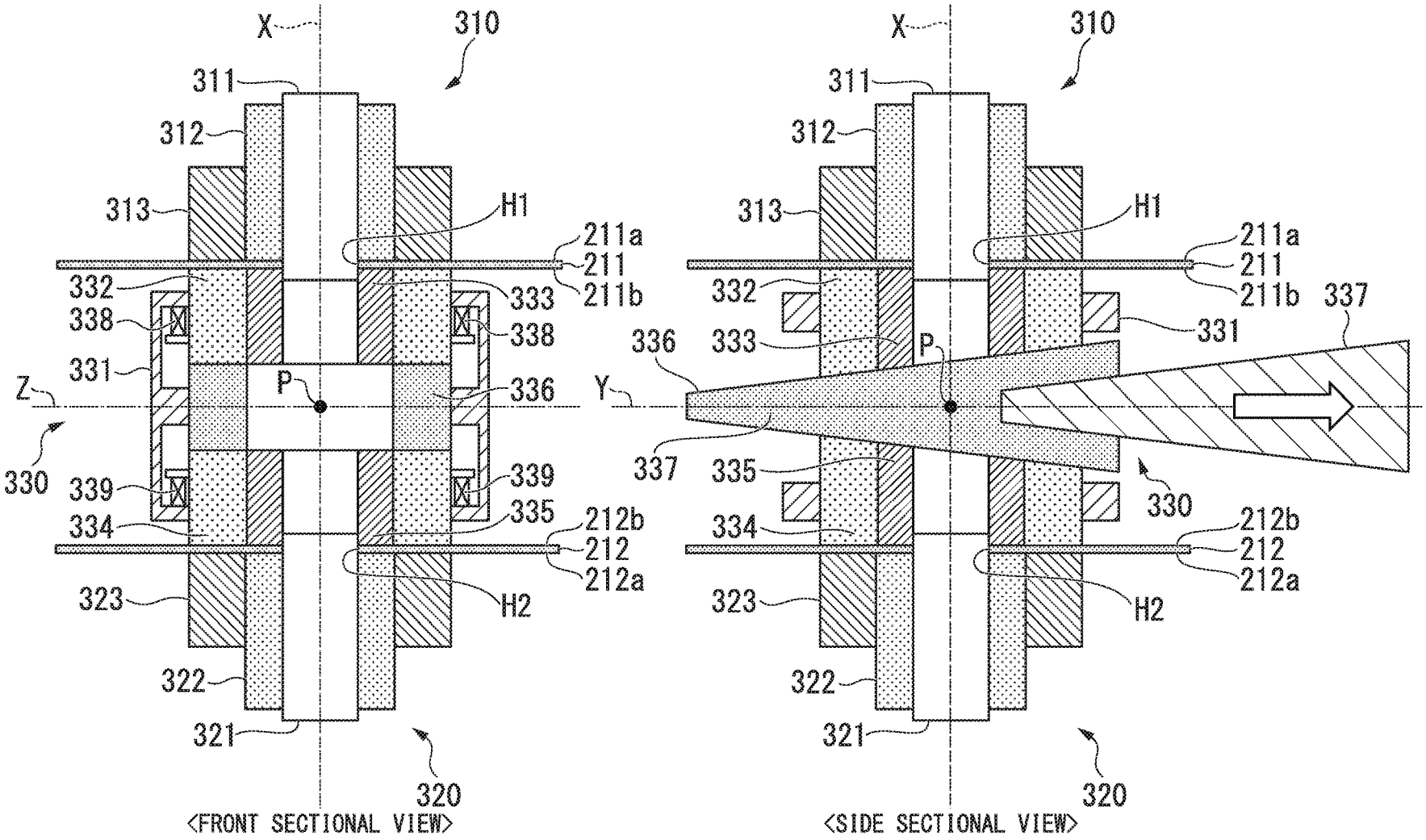
FIG. 9 is a second explanatory view with respect to the second process of the burring method according to the first embodiment of the present invention.

Subsequently, as shown in FIG. 9, the second stopper 337 is removed from a portion between the first piercing die 333 and the second piercing die 335. Accordingly, each of the first piercing die 333 and the second piercing die 335 is movable toward the reference point P.

Figure 10:
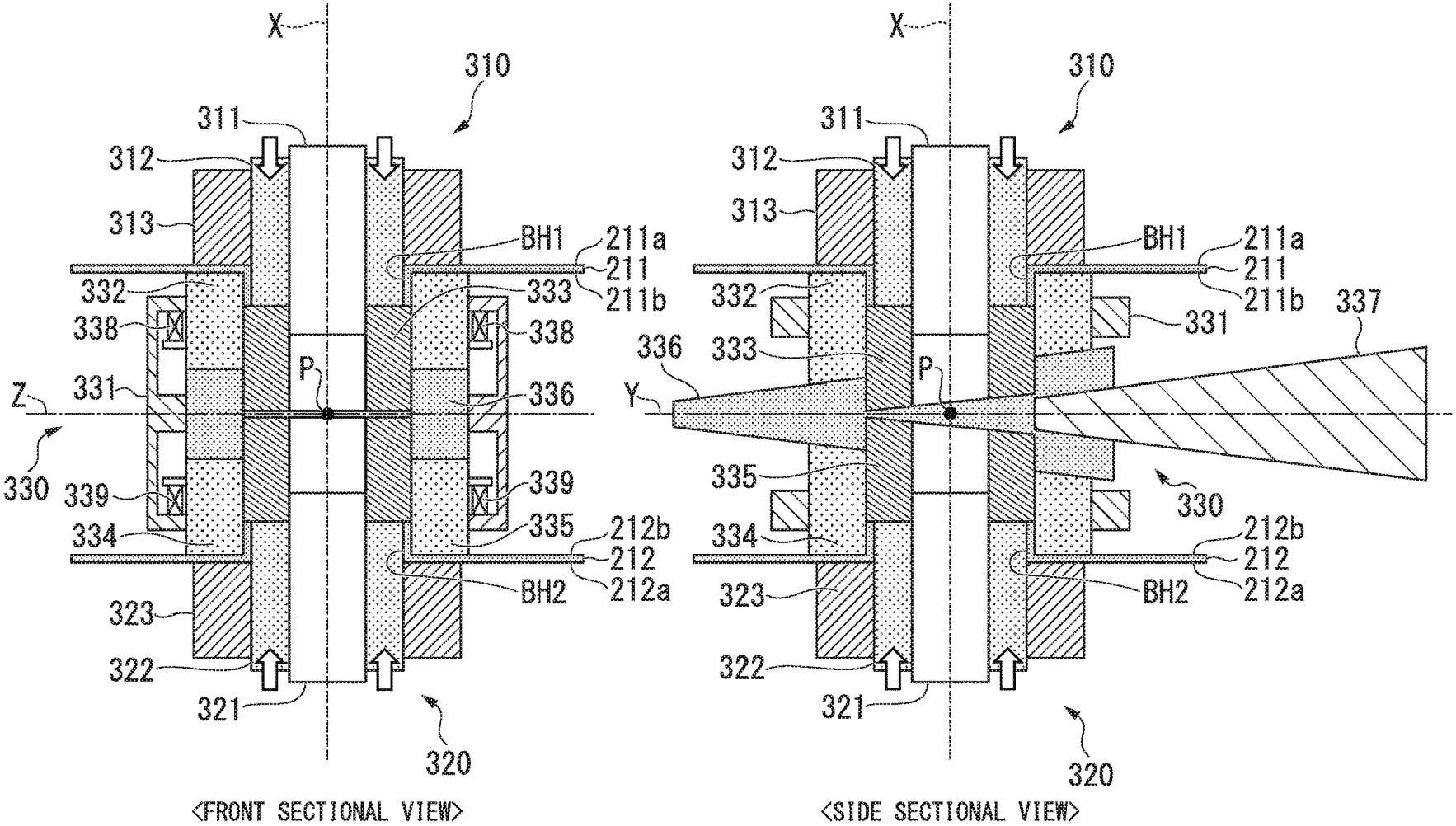
FIG. 10 is a third explanatory view with respect to the second process of the burring method according to the first embodiment of the present invention.

Subsequently, as shown in FIG. 10, by moving the first burring punch 312 from the outside of the first wall portion 211 to the inside thereof along the first axis line X using an actuator (not shown) such that the first burring punch 312 is inserted into the first forming hole 332*a* of the first burring die 332, the peripheral edge portion of the prepared hole H1 of the first wall portion 211 is bent to the inside of the first wall portion 211 to form one of the burring holes.

Accordingly, a burring hole BH1 which has the first axis line X as the center axis line and has the rising wall portion extending toward the inside of the first wall portion 211 is formed on the first wall portion 211. The inner diameter of the burring hole BH1 is the same as the outer diameter of the first burring punch 312. The height (the length along the first axis line X) of the rising wall portion formed on the peripheral edge portion of the burring hole BH1 is determined by the difference between the outer diameter of the first piercing punch 311 and the outer diameter of the first burring punch 312.

Here, the first piercing die 333 also moves toward the reference point P according to the movement of the first burring punch 312. That is, at the time when the burring hole BH1 is formed on the first wall portion 211, the first piercing die 333 is returned to the position close to the center between the first wall portion 211 and the second wall portion 212.

Similarly, by moving the second burring punch 322 from the outside of the second wall portion 212 to the inside thereof along the first axis line X using an actuator (not shown) such that the second burring punch 322 is inserted into the second forming hole 334*a* of the second burring die 334, the peripheral edge portion of the prepared hole H2 of the second wall portion 212 is bent to the inside of the second wall portion 212 to form one of the burring holes.

Accordingly, a burring hole BH2 which has the first axis line X as the center axis line and has the rising wall portion extending toward the inside of the second wall portion 212 is formed on the second wall portion 212. The inner diameter of the burring hole BH2 is the same as the outer diameter of the second burring punch 322. The height of the rising wall portion formed on the peripheral edge portion of the burring hole BH2 is determined by the difference between the outer diameter of the second piercing punch 321 and the outer diameter of the second burring punch 322.

Here, the second piercing die 335 also moves toward the reference point P according to the movement of the second burring punch 322. That is, at the time when the burring hole BH2 is formed on the second wall portion 212, the second piercing die 335 is returned to the position close to the center between the first wall portion 211 and the second wall portion 212.

In addition, the formations of the burring holes BH1 and BH2 may be performed at timings different from each other, or may be simultaneously performed.

Figure 11:
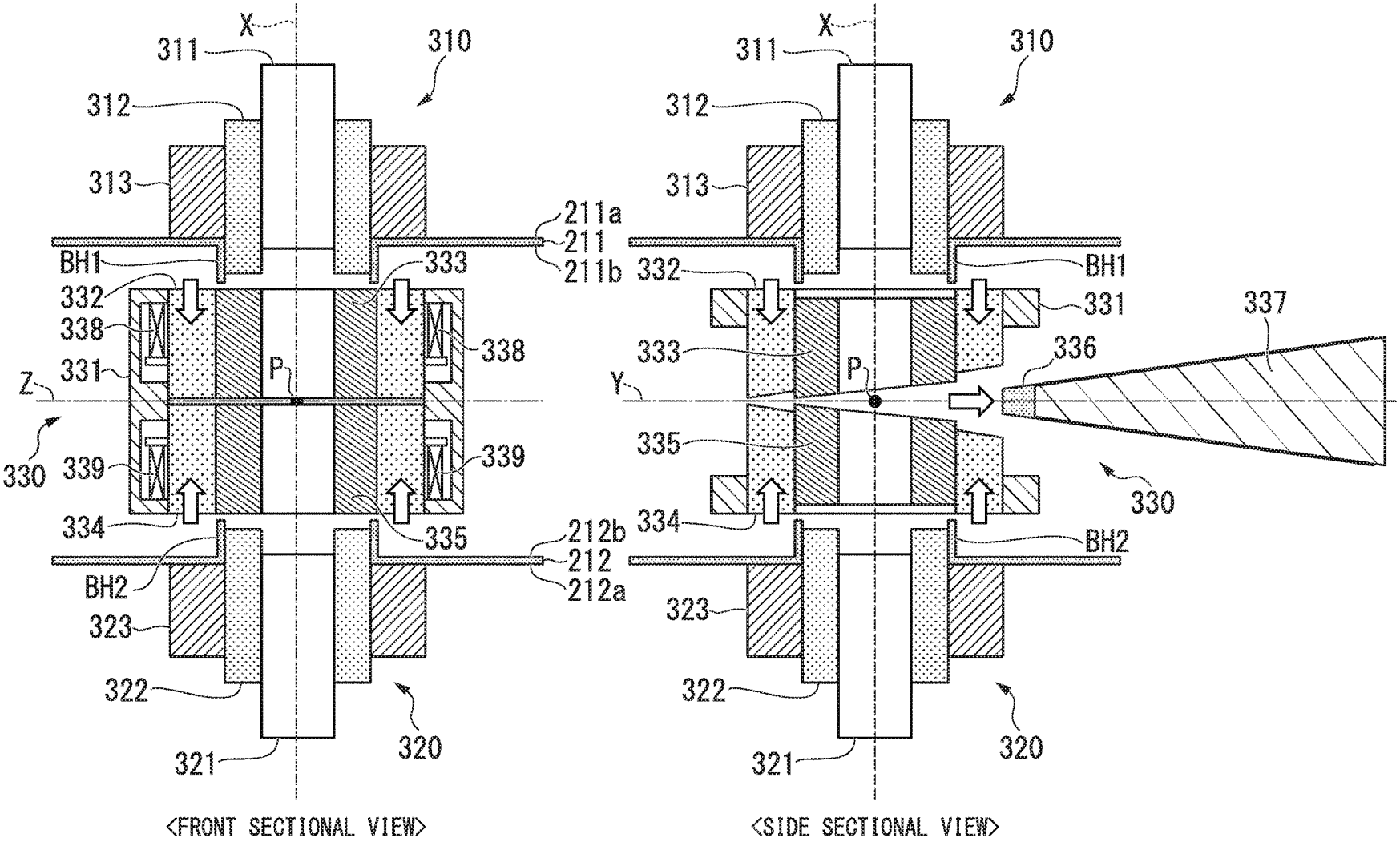
FIG. 11 is a fourth explanatory view with respect to the second process of the burring method according to the first embodiment of the present invention.

Subsequently, as shown in FIG. 11, the first stopper 336 is removed from the portion between the first burring die 332 and the second burring die 334. Accordingly, each of the first burring die 332 and the second burring die 334 is movable toward the reference point P.

As described above, the external force toward the reference point P is applied to the first burring die 332 and the second burring die 334 by compression of the first spring 338 and the second spring 339. Accordingly, if the first stopper 336 is removed from the portion between the first burring die 332 and the second burring die 334, each of the first burring die 332 and the second burring die 334 moves toward the reference point P.

That is, if the first stopper 336 is removed from a portion between the first burring die 332 and the second burring die 334, the first burring die 332 and the second burring die 334 are returned to a position close to the center between the first wall portion 211 and the second wall portion 212 by the external forces which are applied to the first burring die 332 and the second burring die 335 in the direction approaching each other.

As described above, at the time when the second process ends, the burring holes BH1 and BH2 having the first axis lines X as the center axis lines are formed, and the first burring die 332, the first piercing die 333, the second burring die 334, and the second piercing die 335 are returned to the position close to the center between the first wall portion 211 and the second wall portion 212.

<Third Process>

Figure 12:
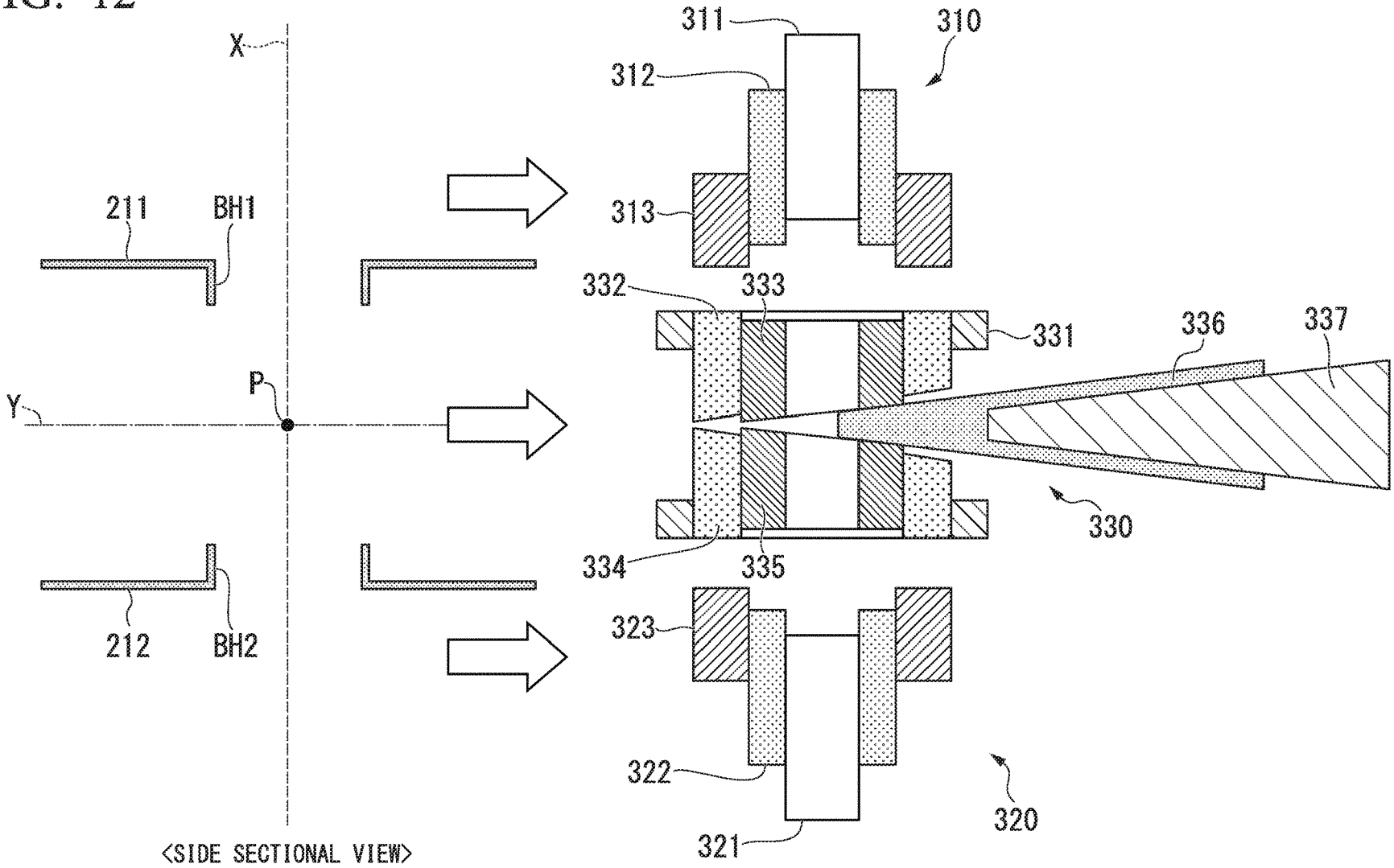
FIG. 12 is an explanatory view with respect to a third process of the burring method according to the first embodiment of the present invention.

Finally, as shown in FIG. 12, the first external unit 310 is detached from the first wall portion 211, the second external unit 320 is detached from the second wall portion 212, the internal unit 330 is detached from the portion between the first wall portion 211 and the second wall portion 212, and the burring ends.

Even when the burring hole BH1 has the rising wall portion extending to the inside of the first wall portion 211 and the burring hole BH2 has the rising wall portion extending to the inside of the second wall portion 212, since the first burring die 332, the first piercing die 333, the second burring die 334, and the second piercing die 335 are returned to the position close to the center between the first wall portion 211 and the second wall portion 212, it is possible to easily detach the internal unit 330 from the portion between the first wall portion 211 and the second wall portion 212.

As described above, in the first embodiment, after the prepared hole H1 is formed on the first wall portion 211 using the first piercing punch 311, the peripheral edge portion of the prepared hole H1 of the first wall portion 211 is bent to the inside of the first wall portion 211 using the first burring punch 312 having the first axis line X as the center axis line along with the first piercing punch 311 to form the burring hole BH1.

In addition, in the first embodiment, after the prepared hole H2 is formed on the second wall portion 212 using the second piercing punch 321, the peripheral edge portion of the prepared hole H2 of the second wall portion 212 is bent to the inside of the second wall portion 212 using the second burring punch 322 having the first axis line X as the center axis line along with the second piercing punch 321 to form the burring hole BH2.

Accordingly, it is possible to significantly decrease misalignment occurring between the center axis lines of the prepared holes H1 and H2 and the center axis lines of the burring holes BH1 and BH2, and it is possible to very accurately form the burring holes BH1 and BH2 having the same axis line (first axis line X) as the center axis lines.

Moreover, according to the first embodiment, since the prepared hole H1 of the first wall portion 211 and the prepared hole H2 of the second wall portion 212 can be simultaneously formed and the burring hole BH1 of the first wall portion 211 and the burring hole H2 of the second wall portion 212 can be simultaneously formed, the first embodiment is remarkably effective.

Therefore, according to the first embodiment, it is possible to accurately and effectively form the burring holes BH1 and BH2 having the same axis line (first axis line X) as the center axis lines with respect to the first wall portion 211 and the second wall portion 212 facing each other.

Second Embodiment

Next, a burring apparatus and a burring method according to a second embodiment of the present invention will be described. In the second embodiment, a burring apparatus and a burring method for forming a burring hole having a rising wall portion which is bent toward the outside of the first wall portion 211 on the first wall portion 211, and a burring hole having a rising wall portion which is bent toward the outside of the second wall portion 212 on the second wall portion 212 will be described.

Figure 13A:
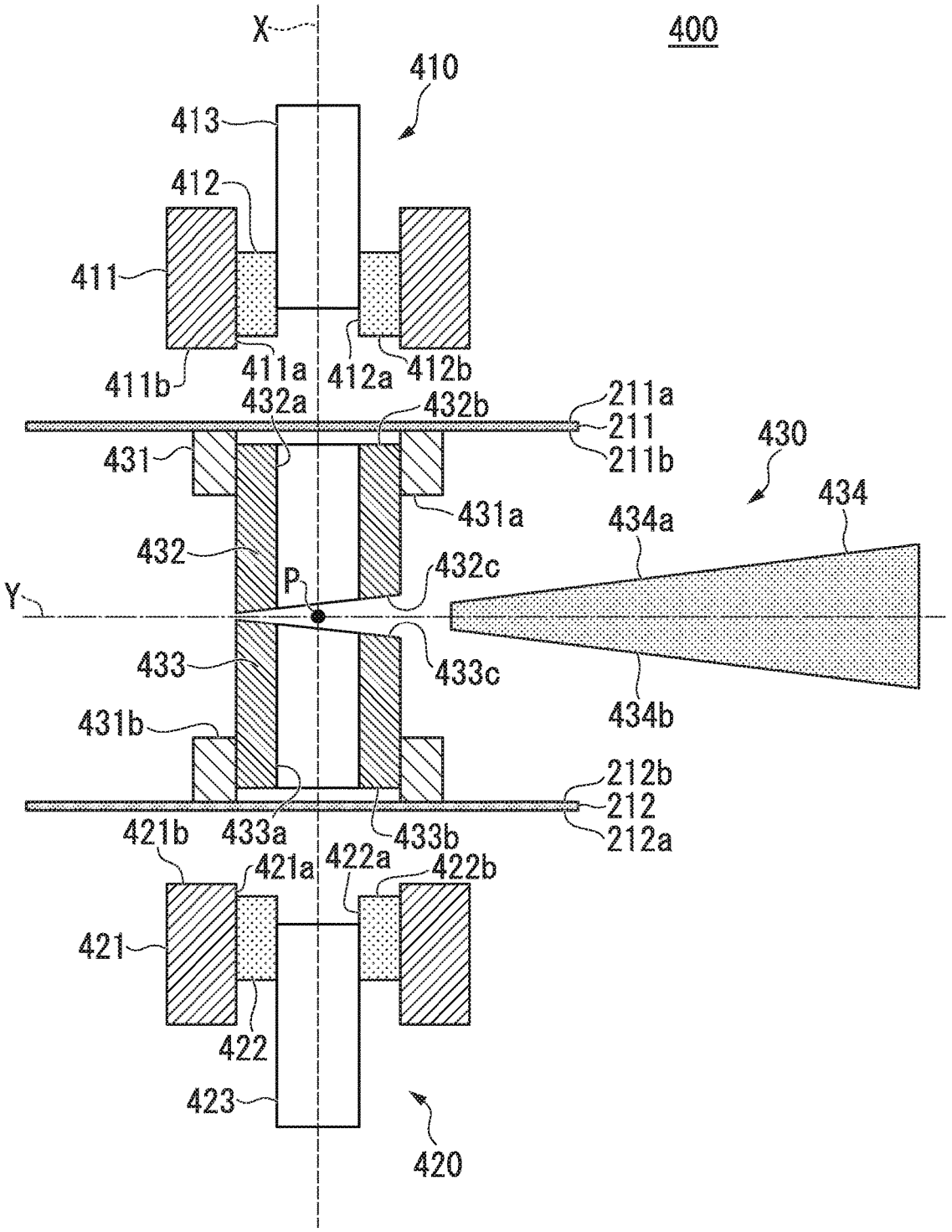
FIG. 13A is a side sectional view of a burring apparatus 400 according to a second embodiment of the present invention.
Figure 13B:
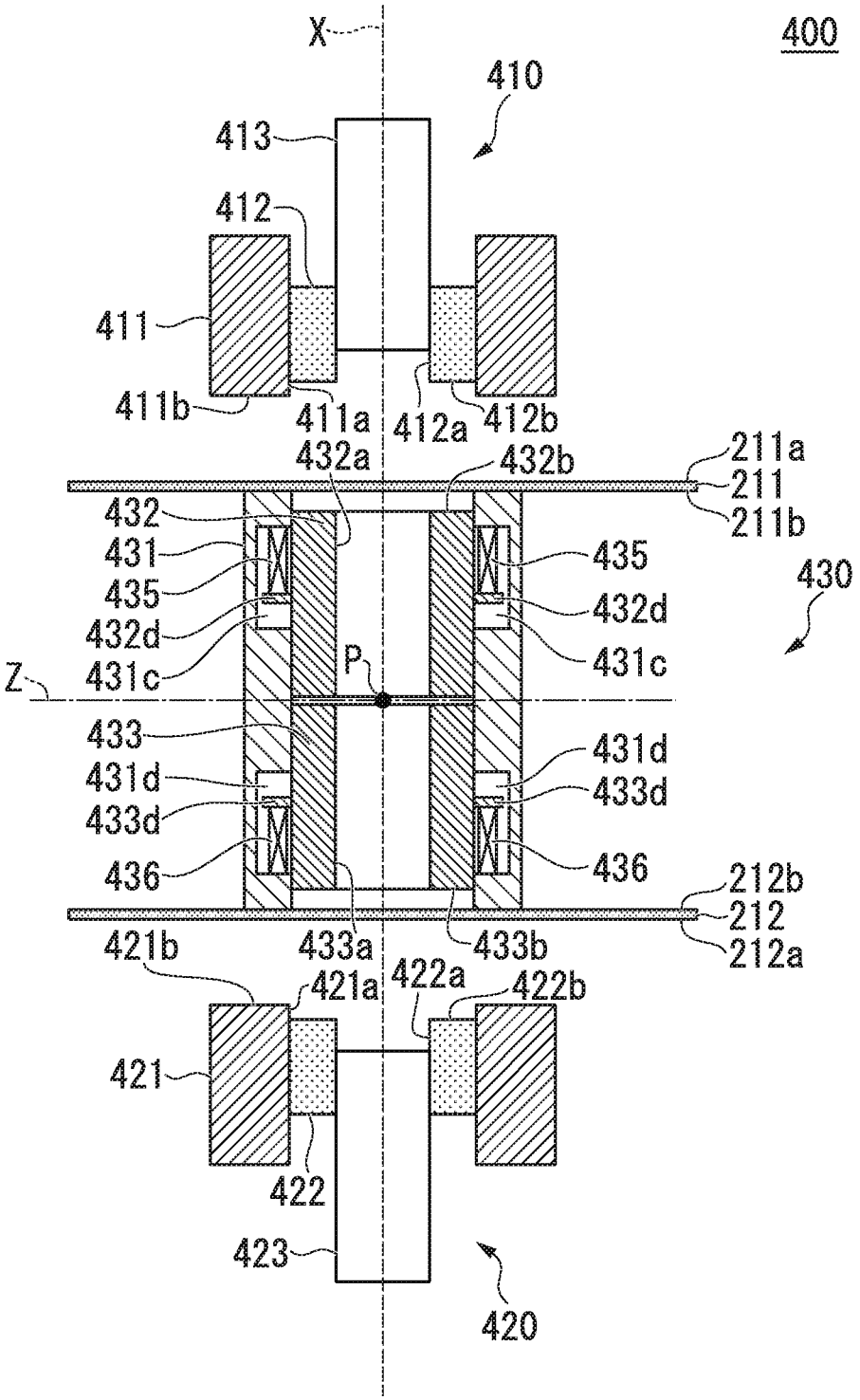
FIG. 13B is a front sectional view of the burring apparatus 400 according to the second embodiment of the present invention.

FIG. 13A is a side sectional view of a burring apparatus 400 according to the second embodiment. FIG. 13B is a front sectional view of the burring apparatus 400 according to the second embodiment. In addition, FIG. 13A is a view when the burring apparatus 400 is viewed along the cross section including the first axis line X and the second axis line Y. FIG. 13B is a view when the burring apparatus 400 is viewed along the cross section including the first axis line X and the third axis line Z.

As shown in FIGS. 13A and 13B, the burring apparatus 400 includes a first external unit 410 which is disposed outside the first wall portion 211, a second external unit 420 which is disposed outside the second wall portion 212, and an internal unit 430 which is disposed between the first wall portion 211 and the second wall portion 212.

The first external unit 410 includes a first burring die 411, a first piercing holder 412, and a first piercing punch 413.

The first burring die 411 is a circular thick plate member having a first forming hole 411*a* into which the first burring punch 432 described below is inserted. The first forming hole 411*a* is a circular hole which penetrates along the plate thickness direction of the first burring die 411 and has the same center axis line as the center axis line of the first burring die 411. Preferably, the diameter of the first forming hole 411*a* has the same value as the sum of the outer diameter of the first burring punch 432 and the thickness of the first wall portion 211.

The first burring die 411 is provided so as to be movable outside the first wall portion 211 along the first axis line X in a state where the center axis line of the first forming hole 411*a* coincides with the first axis line X. In addition, the first burring die 411 includes a flat surface 411*b* which can come into surface contact with the outer wall surface 211*a* of the first wall portion 211.

The first piercing holder 412 is a circular thick plate member which has a first through hole 412*a* serving as a passage of the first piercing punch 413. The first through hole 412*a* is a circular hole which penetrates in a plate thickness direction of the first piercing holder 412 and has the same center axis line as the center axis line of the first piercing holder 412.

The first piercing holder 412 is provided so as to be movable outside the first wall portion 211 along the first axis line X inside the first forming hole 411*a* of the first burring die 411 in a state where the center axis line of the first through hole 412*a* coincides with the first axis line X. In addition, the first piercing holder 412 includes a flat surface 412*b* which can come into surface contact with the outer wall surface 211*a* of the first wall portion 211.

The first piercing punch 413 is a columnar shaft member for forming prepared holes on the first wall portion 211. The first piercing punch 413 is provided so as to be movable between the outside and the inside of the first wall portion 211 along the first axis line X inside the first through hole 412*a* of the first piercing holder 412 in a state where the center axis line of the first piercing punch 413 coincides with the first axis line X.

As described above, in the first external unit 410, the first burring die 411, the first piercing holder 412, and the first piercing punch 413 have the first axis line X as the center axis lines.

In addition, in the first external unit 410, preferably, an inner circumferential surface of the first burring die 411 (a surface of the first forming hole 411*a*) and an outer circumferential surface of the first piercing holder 412 come into close contact with each other. In addition, preferably, an inner circumferential surface of the first piercing holder 412 (a surface of the first through hole 412*a*) and an outer circumferential surface of the first piercing punch 413 come into close contact with each other.

Accordingly, when the first piercing punch 413 moves along the first axis line X, it is possible to prevent the center axis lines of the first piercing punch 413 from being deviated from the first axis line X.

The second external unit 420 includes a second burring die 421, a second piercing holder 422, and a second piercing punch 423.

The second burring die 421 is a circular thick plate member having a second forming hole 421*a* into which the second burring punch 433 described below is inserted. The second forming hole 421*a* is a circular hole which penetrates along the plate thickness direction of the second burring die 421 and has the same center axis line as the center axis line of the second burring die 421. Preferably, the diameter of the second forming hole 421*a* has the same value as the sum of the outer diameter of the second burring punch 433 and the thickness of the second wall portion 212.

The second burring die 421 is provided so as to be movable outside the second wall portion 212 along the first axis line X in a state where the center axis line of the second forming hole 421*a* coincides with the first axis line X. In addition, the second burring die 421 includes a flat surface 421*b* which can come into surface contact with the outer wall surface 212*a* of the second wall portion 212.

The second piercing holder 422 is a circular thick plate member which has a second through hole 422*a* serving as a passage of the second piercing punch 423. The second through hole 422*a* is a circular hole which penetrates in a plate thickness direction of the second piercing holder 422 and has the same center axis line as the center axis line of the second piercing holder 422.

The second piercing holder 422 is provided so as to be movable outside the second wall portion 212 along the first axis line X inside the second forming hole 421*a* of the second burring die 421 in a state where the center axis line of the second through hole 422*a* coincides with the first axis line X. In addition, the second piercing holder 422 includes a flat surface 422*b* which can come into surface contact with the outer wall surface 212*a* of the second wall portion 212.

The second piercing punch 423 is a columnar shaft member for forming prepared holes on the second wall portion 212. The second piercing punch 423 is provided so as to be movable between the outside and the inside of the second wall portion 212 along the first axis line X inside the second through hole 422*a* of the second piercing holder 422 in a state where the center axis line of the second piercing punch 423 coincides with the first axis line X.

As described above, in the second external unit 420, the second burring die 421, the second piercing holder 422, and the second piercing punch 423 have the first axis line X as the center axis lines.

In addition, in the second external unit 420, preferably, an inner circumferential surface of the second burring die 421 (a surface of the second forming hole 421*a*) and an outer circumferential surface of the second piercing holder 422 come into close contact with each other. In addition, preferably, an inner circumferential surface of the second piercing holder 422 (a surface of the second through hole 422*a*) and an outer circumferential surface of the second piercing punch 423 come into close contact with each other.

Accordingly, when the second piercing punch 423 moves along the first axis line X, it is possible to prevent the center axis lines of the second piercing punch 423 from being deviated from the first axis line X.

The internal unit 430 includes a housing 431, a first burring punch 432, a second burring punch 433, and a stopper 434.

The housing 431 is a cylindrical member which includes the first burring punch 432 and the second burring punch 433 and in which both end surfaces are open. The housing 431 is disposed between the first wall portion 211 and the second wall portion 212 in a state where the center axis line of the housing coincides with the first axis line X. In addition, the housing 431 includes a first opening portion 431*a* and a second opening portion 431*b* which are open to have sizes of the openings through which the stopper 434 can pass along the second axis line Y.

When the housing 431 is disposed between the first wall portion 211 and the second wall portion 212, the housing 431 is configured such that one end surface of the housing 431 comes into surface contact with the inner wall surface 211*b* of the first wall portion 211, and the other end surface of the housing 431 comes into surface contact with the inner wall surface 212*b* of the second wall portion 212.

The first burring punch 432 has the first axis line X as the center axis line along with the first piercing punch 413, and is a cylindrical shaft member for forming the burring hole by bending the peripheral edge portion of the prepared hole of the first wall portion 211 to the outside of the first wall portion 211.

The first burring punch 432 includes a first piercing hole 432*a* into which the first piercing punch 413 is inserted. The first piercing hole 432*a* is a circular hole which penetrates along the axial direction of the first burring punch 432 and has the same center axis line as the center axis line of the first burring punch 432. Preferably, the diameter of the first piercing hole 432*a* is the same as the outer diameter of the first piercing punch 413.

The first burring punch 432 is provided so as to be movable between the outside and the inside of the first wall portion 211 along the first axis line X inside the housing 431 in a state where the center axis line of the first piercing hole 432*a* coincides with the first axis line X. In addition, the first burring punch 432 has a flat surface 432*b*, which can come into surface contact with the inner wall surface 211*b* of the first wall portion 211, as one end surface, and has an inclined surface 432*c*, which is inclined in the direction toward the first wall portion 211 with respect to the second axis line Y, as the other end surface.

The second burring punch 433 has the first axis line X as the center axis line along with the second piercing punch 423, and is a cylindrical shaft member for forming the burring hole by bending the peripheral edge portion of the prepared hole of the second wall portion 212 to the outside of the second wall portion 212. The first burring die punch 432 and the second burring punch 433 are disposed so as to face each other in a state where the reference point P is interposed therebetween.

The second burring punch 433 includes a second piercing hole 433*a* into which the second piercing punch 423 is inserted. The second piercing hole 433*a* is a circular hole which penetrates along the axial direction of the second burring punch 433 and has the same center axis line as the center axis line of the second burring punch 433. Preferably, the diameter of the second piercing hole 433*a* is the same as the outer diameter of the second piercing punch 423.

The second burring punch 433 is provided so as to be movable between the outside and the inside of the second wall portion 212 along the first axis line X inside the housing 431 in a state where the center axis line of the second piercing hole 433*a* coincides with the first axis line X. In addition, the second burring punch 433 has a flat surface 433*b*, which can come into surface contact with the inner wall surface 212*b* of the second wall portion 212, as one end surface, and has an inclined surface 433*c*, which is inclined in the direction toward the second wall portion 212 with respect to the second axis line Y, as the other end surface. The inclination angle of the inclined surface 433*c* of the second burring punch 433 is the same as the inclination angle of the inclined surface 432*c* of the first burring punch 432.

The stopper 434 is a thick plate member which is provided so as to be movable along the second axis line Y. The stopper 434 includes a first inclined surface 434*a* which is inclined toward the first wall portion 211 with respect to the second axis line Y, and a second inclined surface 434*b* which is inclined toward the second wall portion 212 with respect to the second axis line Y.

The inclination angle of the first inclined surface 434*a* is the same as the inclination angle of the inclined surface 432*c* of the first burring punch 432. The inclination angle of the second inclined surface 434*b* is the same as the inclination angle of the inclined surface 433*c* of the second burring punch 433. That is, the inclination angle of the first inclined surface 434*a* is the same as the inclination angle of the second inclined surface 434*b*.

Although the details will be described below, in a process in which the stopper 434 passes through the reference point P along the second axis line Y, the first inclined surface 434*a* of the stopper 434 comes into surface contact with the inclined surface 432*c* of the first burring punch 432, and the second inclined surface 434*b* of the stopper 434 comes into surface contact with the inclined surface 433*c* of the second burring punch 433.

In the state where the stopper 434 comes into surface contact with the first burring die 432 and the second burring punch 433, if the stopper 434 advances deeper from the reference point P, the first burring punch 432 moves toward the first wall portion 211, and the second burring punch 433 moves toward the second wall portion 212.

As a result, the flat surface 432*b* of the first burring punch 432 comes into surface contact with the inner wall surface 211*b* of the first wall portion 211, and the flat surface 433*b* of the second burring punch 433 comes into surface contact with the inner wall surface 212*b* of the second wall portion 212.

In this way, in the process in which the stopper 434 passes through the reference point P along the second axis line Y, the stopper 434 has a shape which causes the first burring punch 432 to move toward the first wall portion 211 and the second burring punch 433 to move toward the second wall portion 212.

As shown in FIG. 13B, in the inner circumferential surface of the housing 431, a first groove 431*c* which has a predetermined depth in the direction along the third axis line Z and a predetermined width in the direction along the first axis line X is formed on a region facing the first burring punch 432. A first protruding portion 432*d* which protrudes toward the first groove 431*c* is provided on the outer circumferential surface of the first burring die 432. A first spring 435 is disposed between the side wall surface of the first wall portion 211 side of the first groove 431*c* and the first protruding portion 432*d* such that the extension and contraction directions of the first spring 435 are parallel to the first axis line X.

In addition, as shown in FIG. 13B, in the inner circumferential surface of the housing 431, a second groove 431*d* which has a predetermined depth in the direction along the third axis line Z and a predetermined width in the direction along the first axis line X is formed on a region facing the second burring punch 433. A second protruding portion 433*d* which protrudes toward the second groove 431*d* is provided on the outer circumferential surface of the second burring punch 433. A second spring 436 is disposed between the side wall surface of the second wall portion 212 side of the second groove 431*d* and the second protruding portion 433*d* such that the extension and contraction directions of the second spring 436 are parallel to the first axis line X.

If the first burring die 432 having the first protruding portion 432*d* moves toward the first wall portion 211, the first spring 435 is compressed, and as a result, an external force toward the reference point P is applied to the first burring punch 432. In addition, if the second burring punch 433 having the second protruding portion 433*d* moves toward the second wall portion 212, the second spring 436 is compressed, and as a result, an external force toward the reference point P is applied to the second burring punch 433.

In this way, the internal unit 430 includes a burring punch return mechanism which separately applies the external force toward the reference point P to each of the first burring punch 432 and the second burring punch 433.

In the internal unit 430 configured as described above, the housing 431, the first burring punch 432, and the second burring punch 433 have the first axis line X as the center axis lines.

In addition, in the internal unit 430, preferably, the inner circumferential surface of the housing 431 and the outer circumferential surface of the first burring die 432 come into close contact with each other, and preferably, the inner circumferential surface of the housing 331 and the outer circumferential surface of the second burring punch 433 come into close contact with each other.

Accordingly, when each of the first burring punch 432 and the second burring punch 433 moves along the first axis line X, it is possible to prevent the center axis line from being deviated from the first axis line X.

Next, the burring method according to the second embodiment which is realized using the burring apparatus 400 configured as described above will be described.

<First Process>

First, as shown in FIGS. 13A and 13B, the first external unit 410 of the burring apparatus 400 is disposed outside the first wall portion 211, the second external unit 420 of the burring apparatus 400 is disposed outside the second wall portion 212, and the internal unit 430 of the burring apparatus 400 is disposed between the first wall portion 211 and the second wall portion 212.

That is, in a state where the first burring die 411, the first piercing holder 412, and the first piercing punch 413 have the first axis line X as the center axis lines, the first external unit 410 is disposed outside the first wall portion 211.

In addition, in a state where the second burring die 421, the second piercing holder 422, and the second piercing punch 423 have the first axis line X as the center axis lines, the second external unit 420 is disposed outside the second wall portion 212.

Moreover, in a state where the housing 431, the first burring punch 432, and the first burring punch 433 have the first axis line X as the center axis lines, the housing 431 of the internal unit 430 is disposed between the first wall portion 211 and the second wall portion 212.

In addition, at this time, the stopper 434 is disposed outside the housing 431. In addition, one end surface of the housing 431 comes into surface contact with the inner wall surface 211*b* of the first wall portion 211, and the other end surface of the housing 431 comes into surface contact with the inner wall surface 212*b* of the second wall portion 212.

Figure 14:
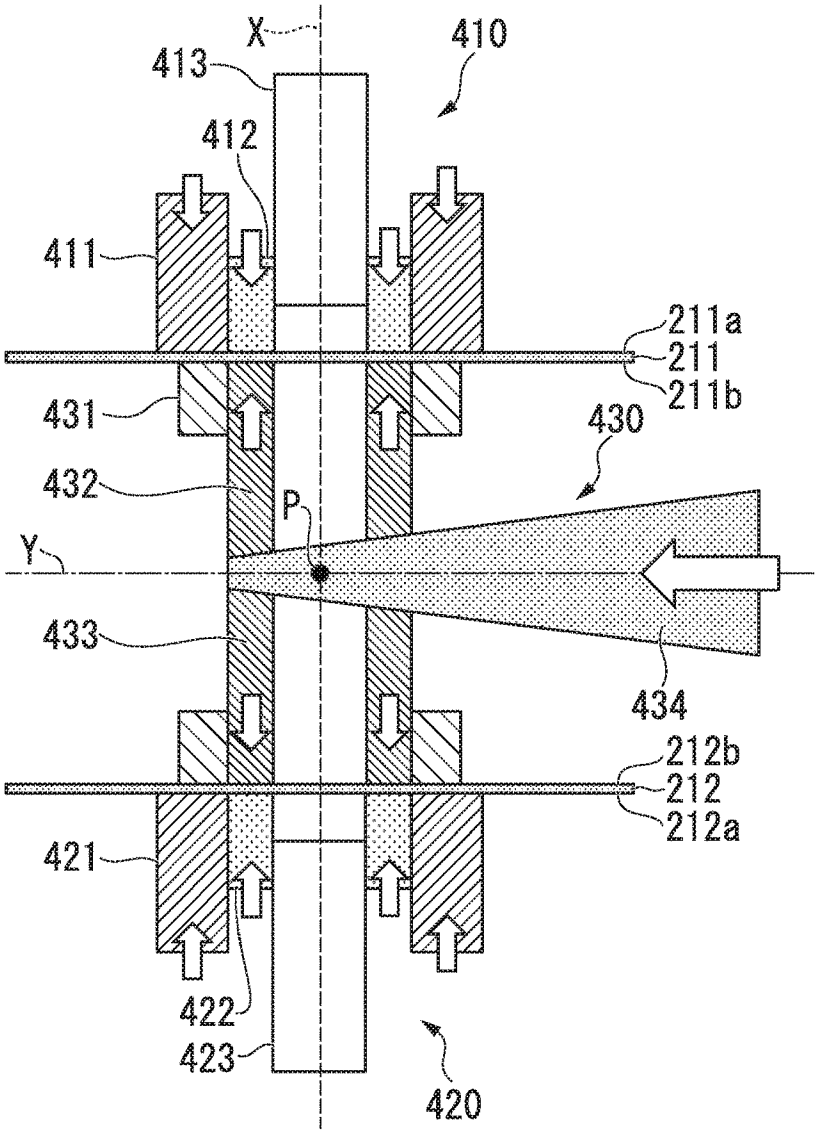
FIG. 14 is an explanatory view with respect to a first process of a burring method according to the second embodiment of the present invention.
Figure 14:
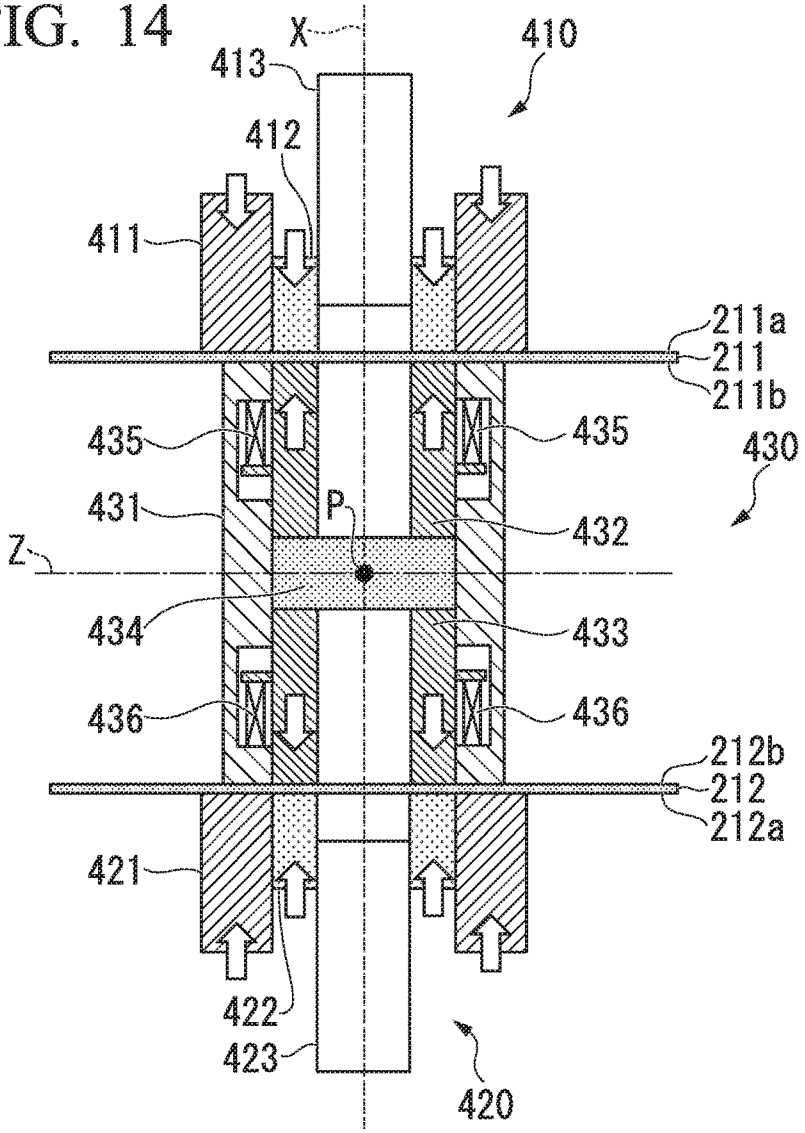

Subsequently, as shown in FIG. 14, in the first external unit 410, the first burring die 411 and the first piercing holder 412 move toward the first wall portion 211 along the first axis line X using an actuator (not shown) until the first burring die 411 and the first piercing holder 412 come into contact with the outer wall surface 211*a* of the first wall portion 211.

After the first burring die 411 and the first piercing holder 412 come into contact with the outer wall surface 211*a* of the first wall portion 211, the first burring die 411 and the first piercing holder 412 come into pressure contact with the outer wall surface 211*a* of the first wall portion 211 by applying a pressing force to first burring die 411 and the first piercing holder 412 in a direction toward the first wall portion 211 using the actuator.

Similarly, in the second external unit 420, the second burring die 421 and the second piercing holder 422 move toward the second wall portion 212 using an actuator (not shown) until the second burring die 421 and the second piercing holder 422 come into contact with the outer wall surface 212*a* of the second wall portion 212.

After the second burring die 421 and the second piercing holder 422 come into contact with the outer wall surface 212*a* of the second wall portion 212, the second burring die 421 and the second piercing holder 422 come into pressure contact with the outer wall surface 212*a* of the second wall portion 212 by applying a pressing force to the second burring die 421 and the second piercing holder 422 in a direction toward the second wall portion 212 using the actuator.

In addition, in the internal unit 430, the stopper 434 moves toward the reference point P along the second axis line Y using an actuator (not shown). In the process in which the stopper 434 passes through the reference point P along the second axis line Y, the first burring punch 432 moves toward the first wall portion 211 and the second burring punch 433 moves toward the second wall portion 212 while the first inclined surface 434*a* of the stopper 434 comes into surface contact with the inclined surface 432*c* of the first burring punch 432 and the second inclined surface 434*b* of the stopper 434 comes into surface contact with the inclined surface 433*c* of the second burring punch 433.

The stopper 434 moves along the second axis line Y at a position at which the flat surface 432*b* of the first burring punch 432 comes into surface contact with the inner wall surface 211*b* of the first wall portion 211 and the flat surface 433*b* of the second burring punch 433 comes into surface contact with the inner wall surface 212*b* of the second wall portion 212.

By further moving the stopper 434 from the position by a predetermined distance, the pressing force is applied to the first burring punch 432 in the direction toward the first wall portion 211, and the pressing force is applied to the second burring punch 433 in the direction toward the second wall portion 212.

As a result, the first burring punch 432 comes into pressure contact with the inner wall surface 211*b* of the first wall portion 211, and the second burring punch 433 comes into pressure contact with the inner wall surface 212*b* of the second wall portion 212.

In this way, by inserting the stopper 434 into a portion between the first burring punch 432 and the second burring punch 433, the first burring punch 432 comes into pressure contact with the inner wall surface 211*b* of the first wall portion 211, and the second burring punch 433 comes into pressure contact with the inner wall surface 212*b* of the second wall portion 212.

At this time, since the first spring 435 inside the housing 431 is compressed according to the movement of the first burring punch 432, the external force toward the reference point P is always applied to the first burring punch 432. Similarly, since the second spring 436 inside the housing 431 is compressed according to the movement of the second burring punch 433, the external force toward the reference point P is always applied to the second burring punch 433.

As shown in FIG. 14, at the time when the above-described first process ends, the first burring die 411 and the housing 431 are disposed so as to face each other in a state where the first wall portion 211 is interposed therebetween, and the first piercing holder 412 and the first burring punch 432 are disposed so as to face each other in a state where the first wall portion 211 is interposed therebetween.

In addition, the second burring die 421 and the housing 431 are disposed so as to face each other in a state where the second wall portion 212 is interposed therebetween, and the second piercing holder 422 and the second burring punch 433 are disposed so as to face each other in a state where the second wall portion 212 is interposed therebetween.

<Second Process>

Figure 15:
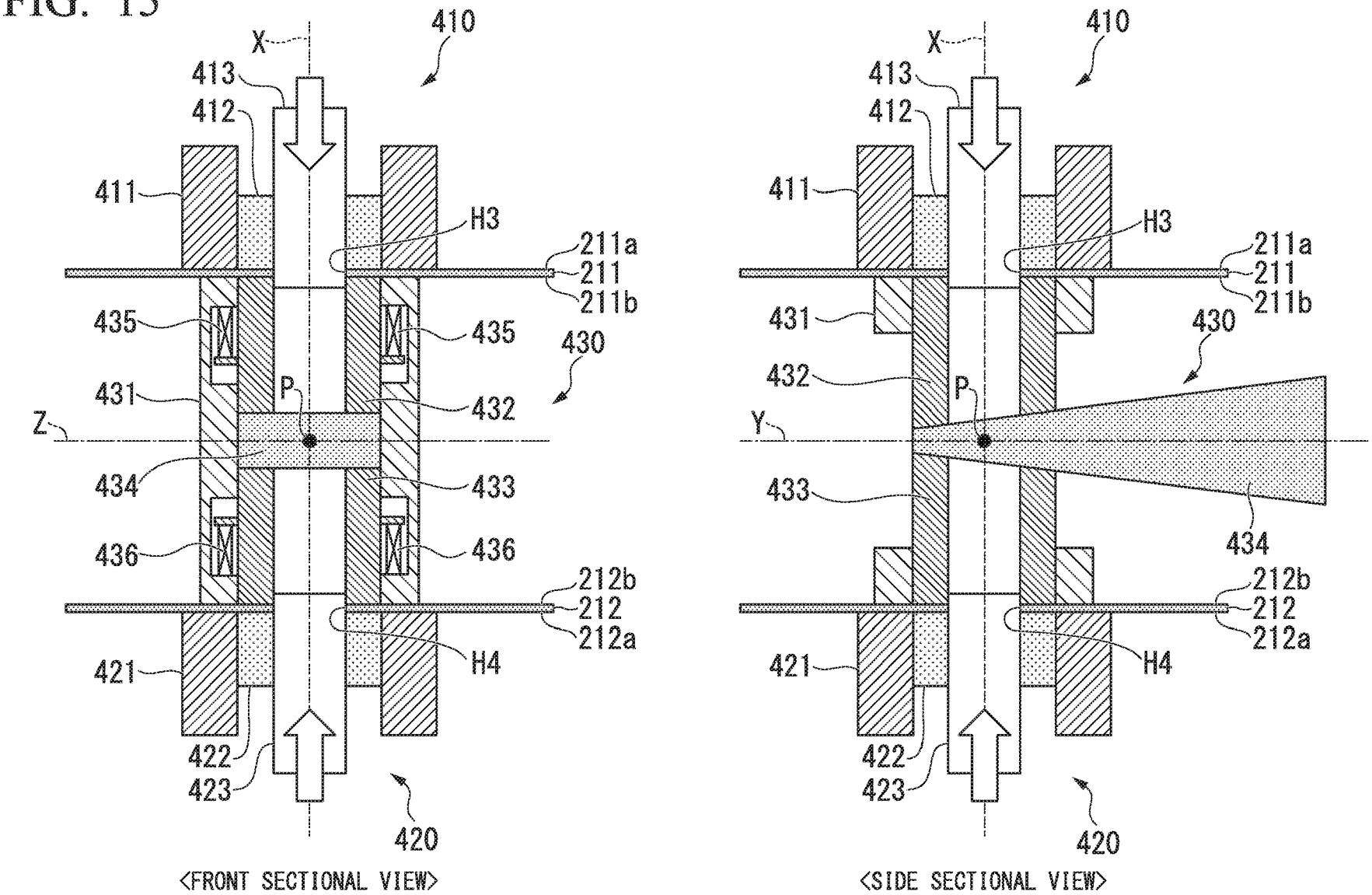
FIG. 15 is a first explanatory view with respect to a second process of the burring method according to the second embodiment of the present invention.

Subsequently, as shown in FIG. 15, by moving the first piercing punch 413 from the outside of the first wall portion 211 to the inside thereof along the first axis line X using an actuator (not shown) such that the first piercing punch 413 is inserted into the first piercing hole 432*a* of the first burring punch 432, one of the prepared holes is formed on the first wall portion 211.

Accordingly, a prepared hole H3, which has the first axis line X as the center axis line and has the same diameter as the outer diameter of the first piercing punch 413, is formed on the first wall portion 211.

Similarly, by moving the second piercing punch 423 from the outside of the second wall portion 212 to the inside thereof along the first axis line X using an actuator (not shown) such that the second piercing punch 423 is inserted into the second piercing hole 433*a* of the second burring punch 433, the other prepared hole is formed on the second wall portion 212.

Accordingly, a prepared hole H4, which has the first axis line X as the center axis line and has the same diameter as the outer diameter of the second piercing punch 423, is formed on the second wall portion 212.

In addition, the formations of the prepared holes H3 and H4 may be performed at timings different from each other, or may be simultaneously performed.

Figure 16:
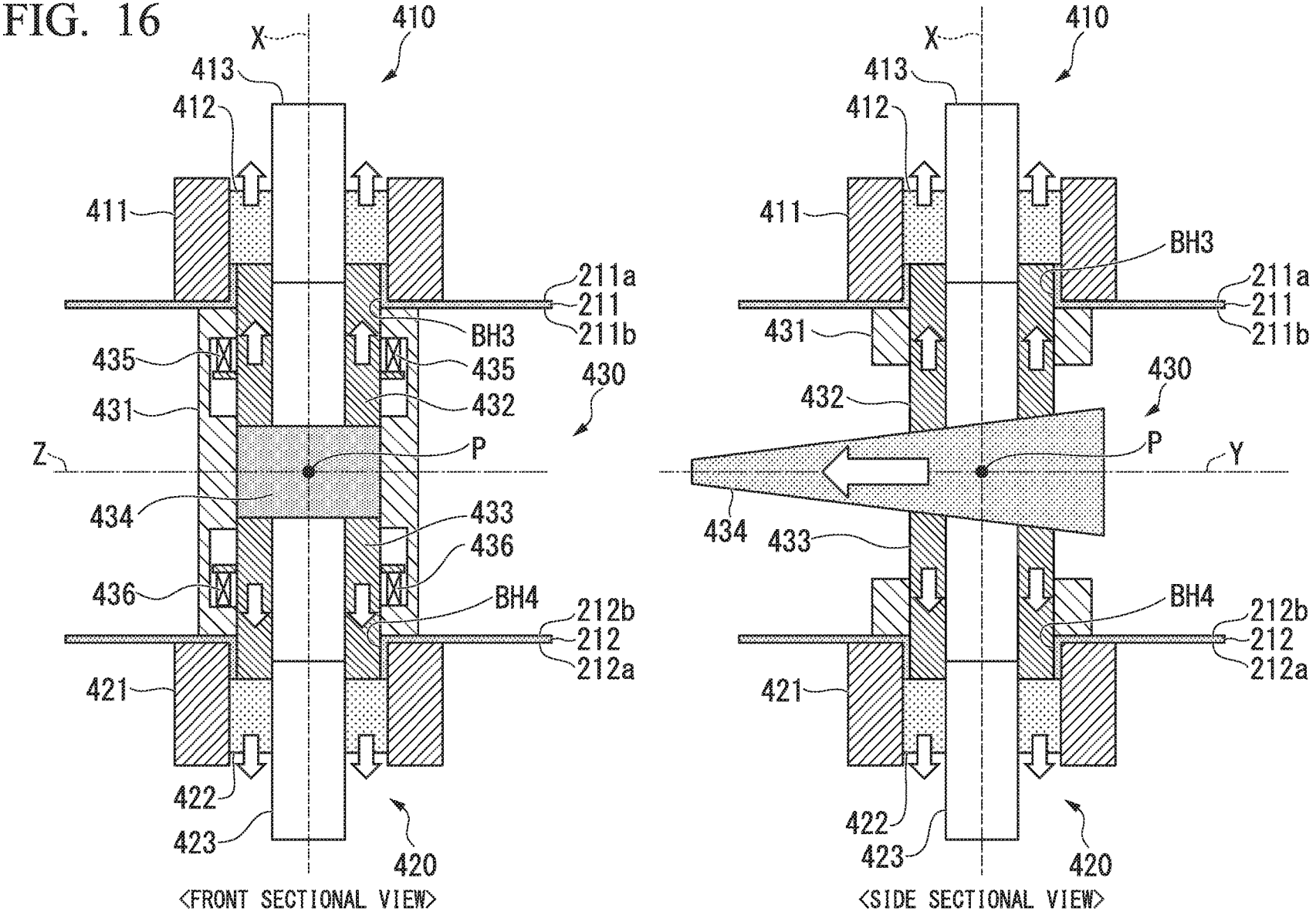
FIG. 16 is a second explanatory view with respect to the second process of the burring method according to the second embodiment of the present invention.

Subsequently, as shown in FIG. 16, by inserting the stopper 434 deeper into a portion between the first burring punch 432 and the second burring punch 433, the first burring punch 432 moves toward the first wall portion 211 along the first axis line X and the second burring punch 433 moves toward the second wall portion 212 along first axis line X.

As described above, by moving the first burring punch 432 from the inside of the first wall portion 211 to the outside thereof along the first axis line X such that the first burring punch 432 is inserted into the first forming hole 411*a* of the first burring die 411, the peripheral edge portion of the prepared hole H3 of the first wall portion 211 is bent to the outside of the first wall portion 211 to form one of the burring holes.

Accordingly, a burring hole BH3 which has the first axis line X as the center axis line and has the rising wall portion extending toward the outside of the first wall portion 211 is formed on the first wall portion 211. The inner diameter of the burring hole BH3 is the same as the outer diameter of the first burring punch 432. The height of the rising wall portion formed on the peripheral edge portion of the burring hole BH3 is determined by the difference between the outer diameter of the first piercing punch 413 and the outer diameter of the first burring punch 432.

Similarly, by moving the second burring punch 433 from the inside of the second wall portion 212 to the outside thereof along the first axis line X such that the second burring punch 433 is inserted into the second forming hole 421*a* of the second burring die 421, the peripheral edge portion of the prepared hole H4 of the second wall portion 212 is bent to the outside of the second wall portion 212 to form one of the burring holes.

Accordingly, a burring hole BH4 which has the first axis line X as the center axis line and has the rising wall portion extending toward the outside of the second wall portion 212 is formed on the second wall portion 212. The inner diameter of the burring hole BH4 is the same as the outer diameter of the second burring punch 433. The height of the rising wall portion formed on the peripheral edge portion of the burring hole BH4 is determined by the difference between the outer diameter of the second piercing punch 423 and the outer diameter of the second burring punch 433.

The formations of the burring holes BH3 and BH4 are simultaneously performed in the process in which the stopper 434 is inserted deeper into the portion between the first burring punch 432 and the second burring punch 433.

Figure 17:
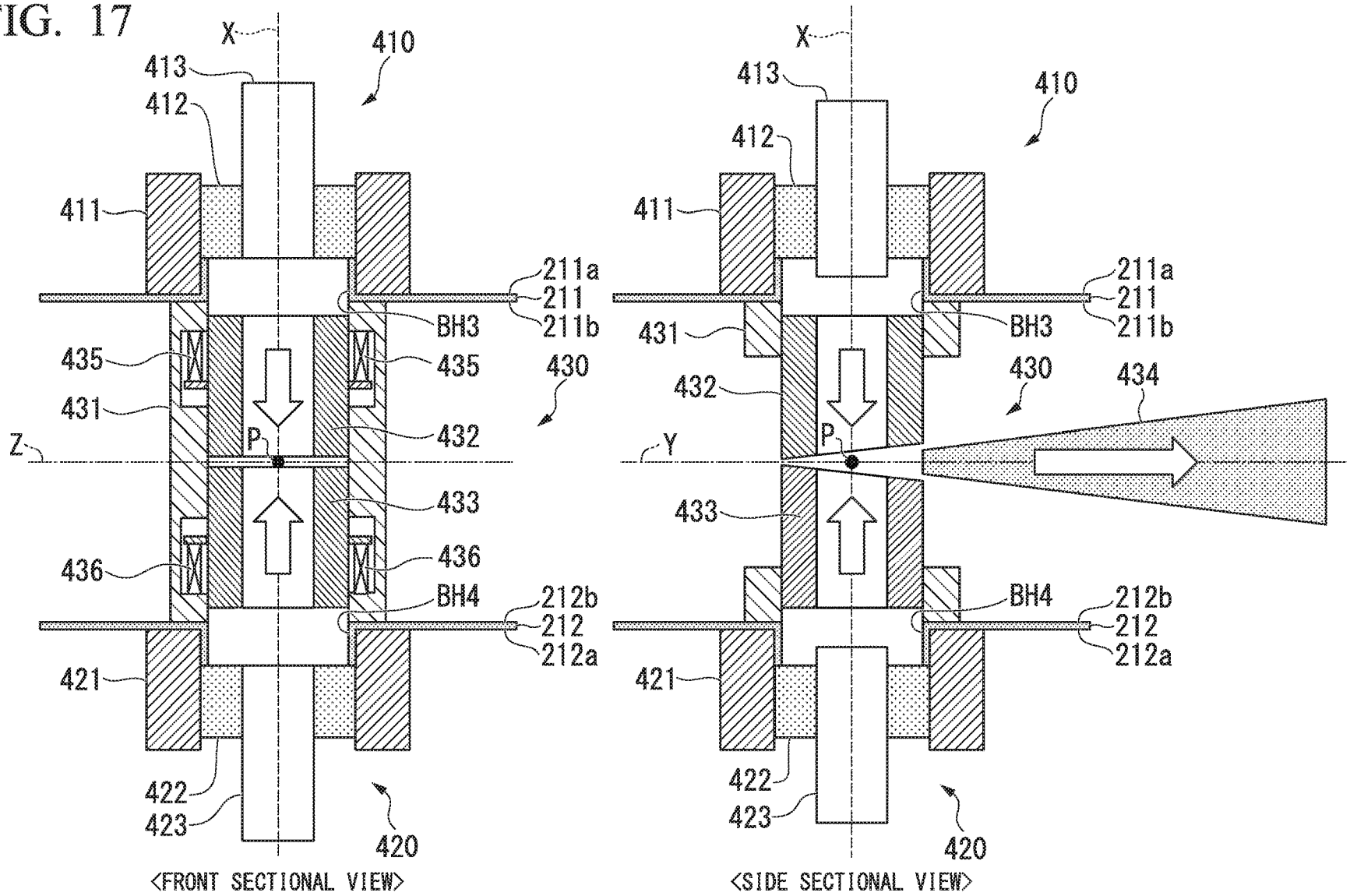
FIG. 17 is a third explanatory view with respect to the second process of the burring method according to the second embodiment of the present invention.

Subsequently, as shown in FIG. 17, the stopper 434 is removed from the portion between the first burring punch 432 and the second burring punch 433. Accordingly, each of the first burring punch 432 and the second burring punch 433 is movable toward the reference point P.

As described above, the external force toward the reference point P is applied to the first burring punch 432 and the second burring punch 433 by compression of the first spring 435 and the second spring 436. Accordingly, if the stopper 434 is removed from the portion between the first burring punch 432 and the second burring punch 433, each of the first burring punch 432 and the second burring punch 433 moves toward the reference point P.

That is, if the stopper 434 is removed from a portion between the first burring punch 432 and the second burring punch 433, the first burring punch 432 and the second burring punch 433 are returned to a position close to the center between the first wall portion 211 and the second wall portion 212 by the external forces which are applied to the first burring punch 432 and the second burring punch 433 in the direction approaching each other.

As described above, at the time when the second process ends, the burring holes BH3 and BH4 having the first axis lines X as the center axis lines are formed, and the first burring punch 432 and the second burring punch 433 are returned to the position close to the center between the first wall portion 211 and the second wall portion 212.

<Third Process>

Figure 18:
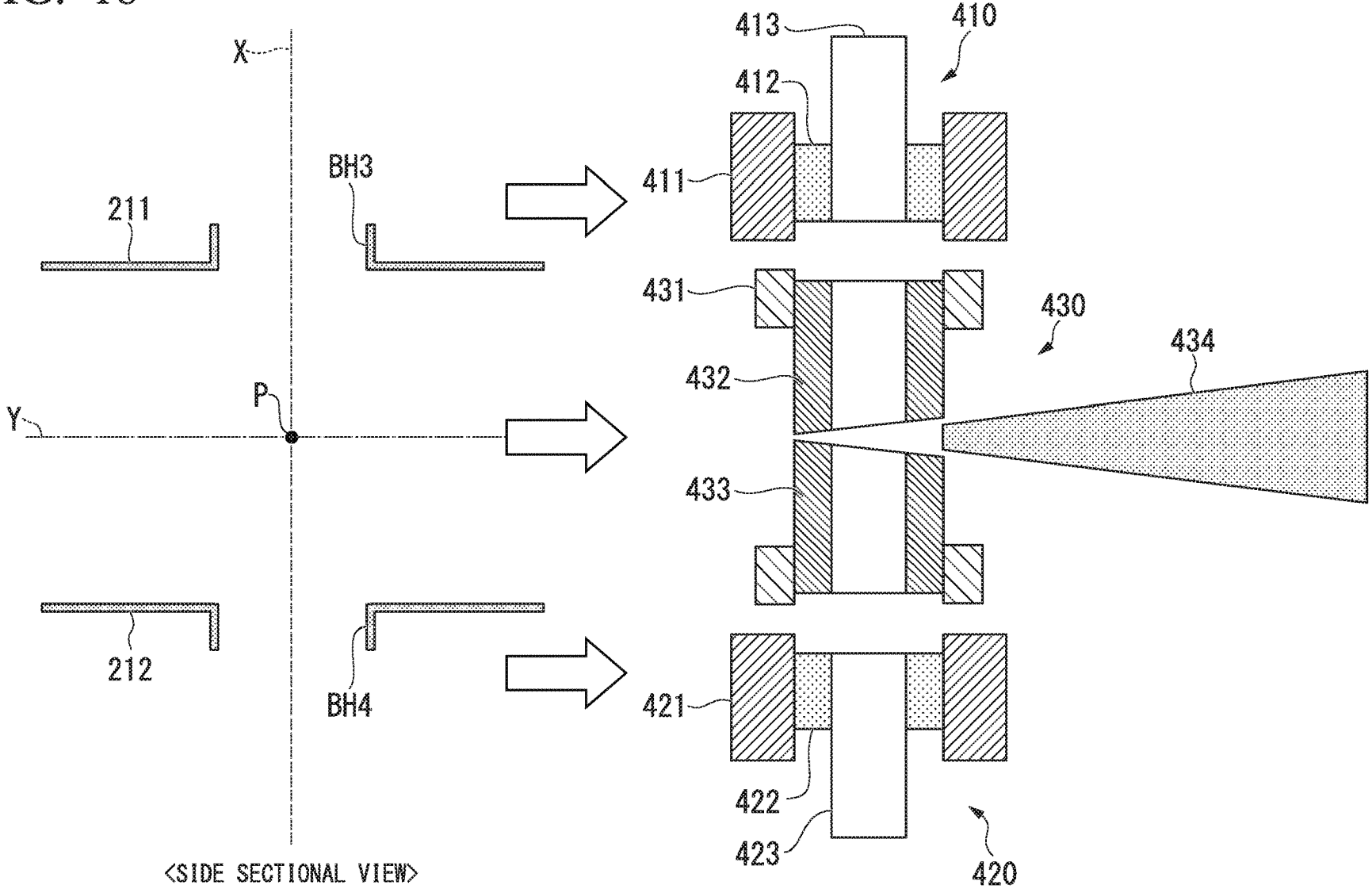
FIG. 18 is an explanatory view with respect to a third process of the burring method according to the second embodiment of the present invention.

Finally, as shown in FIG. 18, the first external unit 410 is detached from the first wall portion 211, the second external unit 420 is detached from the second wall portion 212, the internal unit 430 is detached from the portion between the first wall portion 211 and the second wall portion 212, and the burring ends.

Since the first burring punch 432 and the second burring punch 433 are returned to the position close to the center between the first wall portion 211 and the second wall portion 212, it is possible to easily detach the internal unit 330 (housing 431) from the portion between the first wall portion 211 and the second wall portion 212.

As described above, in the second embodiment, after the prepared hole H3 is formed on the first wall portion 211 using the first piercing punch 413, the peripheral edge portion of the prepared hole H3 of the first wall portion 211 is bent to the outside of the first wall portion 211 using the first burring punch 432 having the first axis line X as the center axis line along with the first piercing punch 413 to form the burring hole BH3.

In addition, in the second embodiment, after the prepared hole H4 is formed on the second wall portion 212 using the second piercing punch 423, the peripheral edge portion of the prepared hole H4 of the second wall portion 212 is bent to the outside of the second wall portion 212 using the second burring punch 433 having the first axis line X as the center axis line along with the second piercing punch 423 to form the burring hole BH4.

Accordingly, it is possible to significantly decrease misalignment occurring between the center axis lines of the prepared holes H3 and H4 and the center axis lines of the burring holes BH3 and BH4, and it is possible to very accurately form the burring holes BH3 and BH4 having the same axis line (first axis line X) as the center axis lines.

Moreover, according to the second embodiment, since the prepared hole H3 of the first wall portion 211 and the prepared hole H4 of the second wall portion 212 can be simultaneously formed and the burring hole BH3 of the first wall portion 211 and the burring hole H4 of the second wall portion 212 can be simultaneously formed, the second embodiment is remarkably effective.

Therefore, according to the second embodiment, similarly to first embodiment, it is possible to accurately and effectively form the burring holes BH3 and BH4 having the same axis line (first axis line X) as the center axis lines with respect to the first wall portion 211 and the second wall portion 212 facing each other.

Third Embodiment

Next, a burring apparatus and a burring method according to a third embodiment of the present invention will be described. In the third embodiment, a burring apparatus and a burring method for forming a burring hole having a rising wall portion which is bent toward the outside of the first wall portion 211 on the first wall portion 211, and a burring hole having a rising wall portion which is bent toward the outside of the second wall portion 212 on the second wall portion 212 will be described. That is, the third embodiment is a modification example of the second embodiment.

Figure 19A:
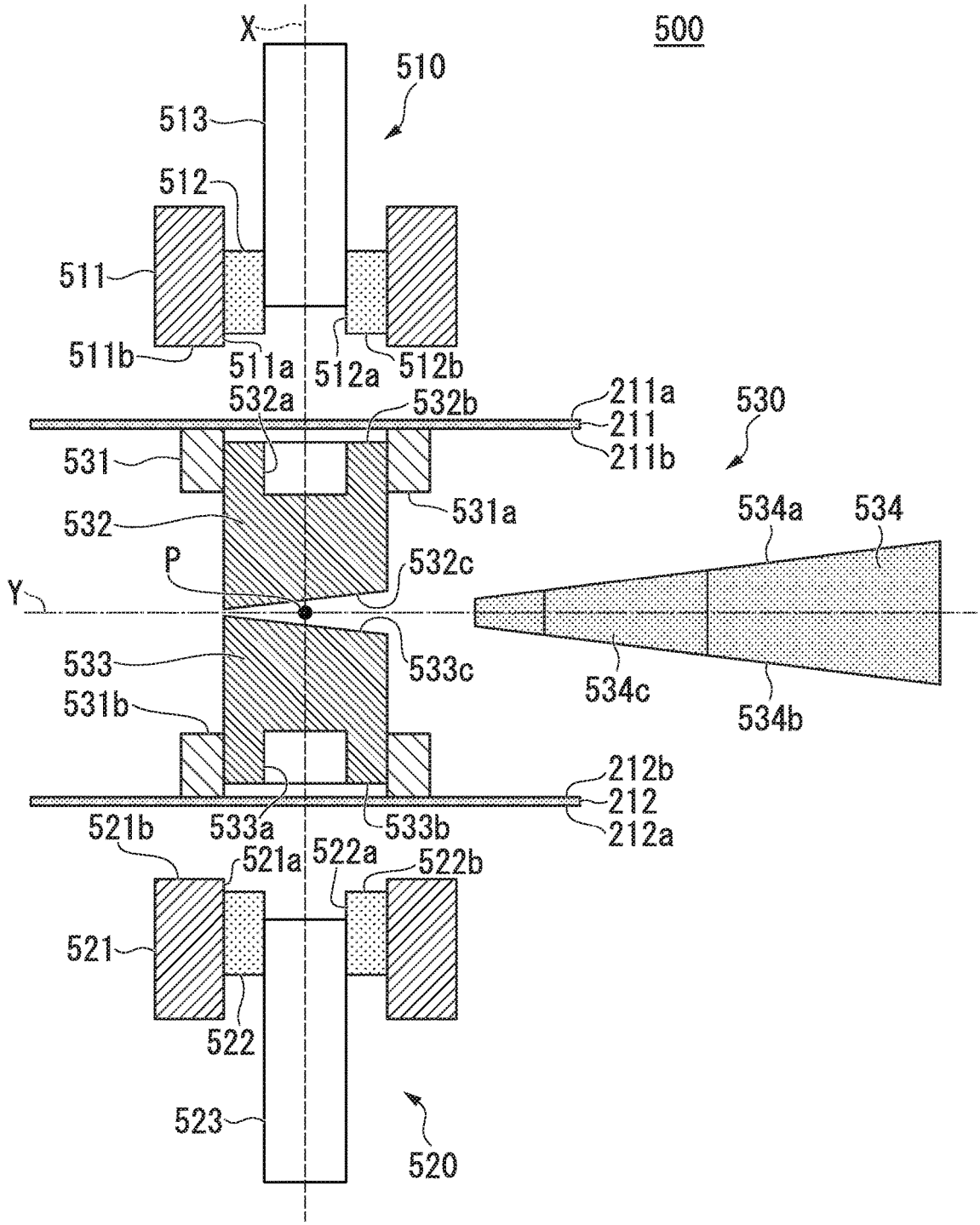
FIG. 19A is a side sectional view of a burring apparatus 500 according to a third embodiment of the present invention.
Figure 19B:
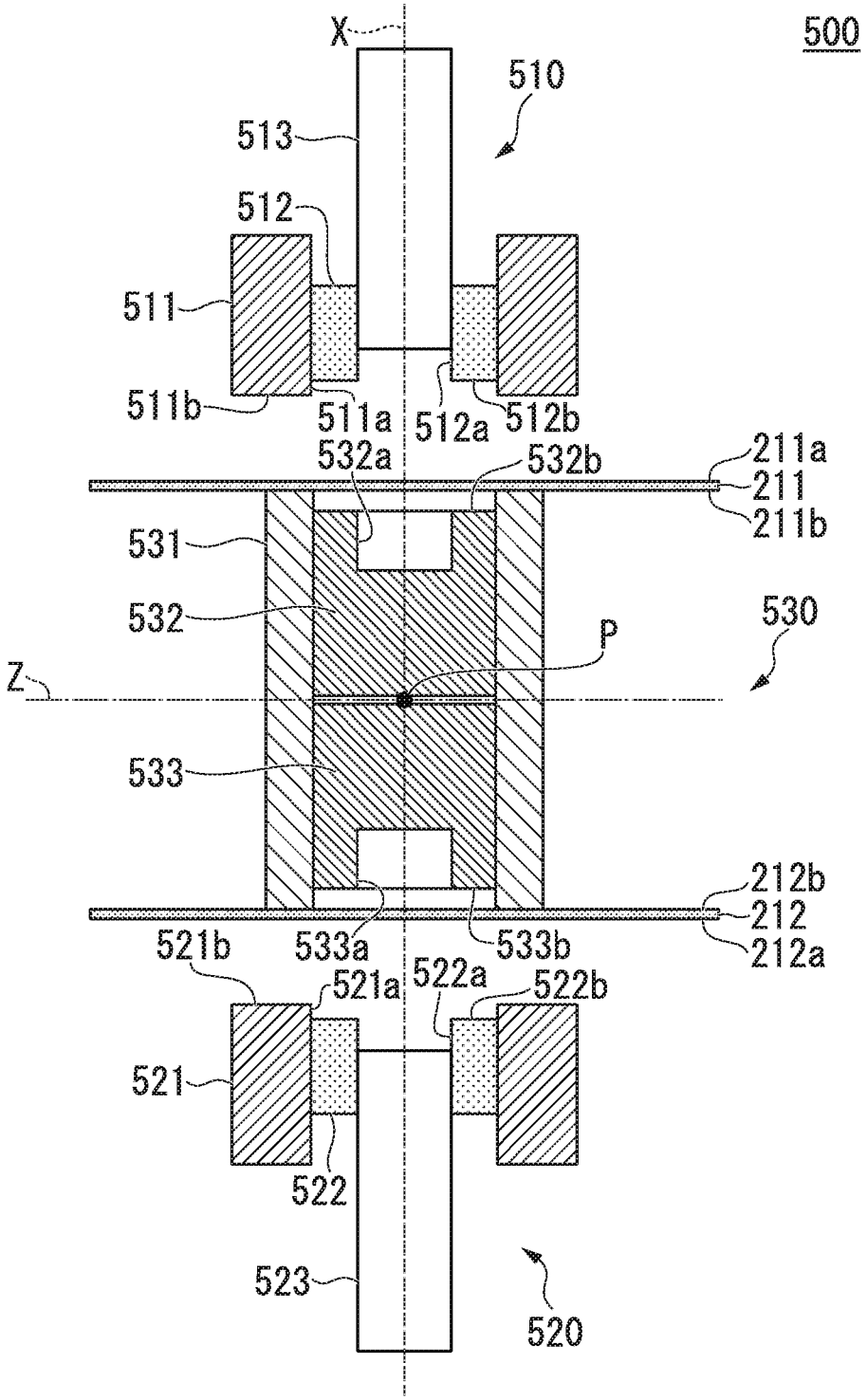
FIG. 19B is a front sectional view of the burring apparatus 500 according to the third embodiment of the present invention.

FIG. 19A is a side sectional view of a burring apparatus 500 according to the third embodiment. FIG. 19B is a front sectional view of the burring apparatus 500 according to the third embodiment. In addition, FIG. 19A is a view when the burring apparatus 500 is viewed along the cross section including the first axis line X and the second axis line Y. FIG. 19B is a view when the burring apparatus 500 is viewed along the cross section including the first axis line X and the third axis line Z.

As shown in FIGS. 19A and 19B, the burring apparatus 500 includes a first external unit 510 which is disposed outside the first wall portion 211, a second external unit 520 which is disposed outside the second wall portion 212, and an internal unit 530 which is disposed between the first wall portion 211 and the second wall portion 212.

The first external unit 510 includes a first burring die 511, a first piercing holder 512, and a first piercing punch 513.

The first burring die 511 is a circular thick plate member having a first forming hole 511*a* into which the first burring punch 532 described below is inserted. The first forming hole 511*a* is a circular hole which penetrates along the plate thickness direction of the first burring die 511 and has the same center axis line as the center axis line of the first burring die 511. Preferably, the diameter of the first forming hole 511*a* has the same value as the sum of the outer diameter of the first burring punch 532 and the thickness of the first wall portion 211.

The first burring die 511 is provided so as to be movable outside the first wall portion 211 along the first axis line X in a state where the center axis line of the first forming hole 511*a* coincides with the first axis line X. In addition, the first burring die 511 includes a flat surface 511*b* which can come into surface contact with the outer wall surface 211*a* of the first wall portion 211.

The first piercing holder 512 is a circular thick plate member which has a first through hole 512*a* serving as a passage of the first piercing punch 513. The first through hole 512*a* is a circular hole which penetrates in a plate thickness direction of the first piercing holder 512 and has the same center axis line as the center axis line of the first piercing holder 512.

The first piercing holder 512 is provided so as to be movable outside the first wall portion 211 along the first axis line X inside the first forming hole 511*a* of the first burring die 511 in a state where the center axis line of the first through hole 512*a* coincides with the first axis line X. In addition, the first piercing holder 512 includes a flat surface 512*b* which can come into surface contact with the outer wall surface 211*a* of the first wall portion 211.

The first piercing punch 513 is a columnar shaft member for forming prepared holes on the first wall portion 211. The first piercing punch 513 is provided so as to be movable between the outside and the inside of the first wall portion 211 along the first axis line X inside the first through hole 512*a* of the first piercing holder 512 in a state where the center axis line of the first piercing punch 513 coincides with the first axis line X.

As described above, in the first external unit 510, the first burring die 511, the first piercing holder 512, and the first piercing punch 513 have the first axis line X as the center axis lines.

In addition, in the first external unit 510, preferably, an inner circumferential surface of the first burring die 511 (a surface of the first forming hole 511*a*) and an outer circumferential surface of the first piercing holder 512 come into close contact with each other. In addition, preferably, an inner circumferential surface of the first piercing holder 512 (a surface of the first through hole 512*a*) and an outer circumferential surface of the first piercing punch 513 come into close contact with each other.

Accordingly, when the first piercing punch 513 moves along the first axis line X, it is possible to prevent the center axis lines of the first piercing punch 513 from being deviated from the first axis line X.

The second external unit 520 includes a second burring die 521, a second piercing holder 522, and a second piercing punch 523.

The second burring die 521 is a circular thick plate member having a second forming hole 521*a* into which the second burring punch 533 described below is inserted. The second forming hole 521*a* is a circular hole which penetrates along the plate thickness direction of the second burring die 521 and has the same center axis line as the center axis line of the second burring die 521. Preferably, the diameter of the second forming hole 521*a* has the same value as the sum of the outer diameter of the second burring punch 533 and the thickness of the second wall portion 212.

The second burring die 521 is provided so as to be movable outside the second wall portion 212 along the first axis line X in a state where the center axis line of the second forming hole 521*a* coincides with the first axis line X. In addition, the second burring die 521 includes a flat surface 521*b* which can come into contact with the outer wall surface 212*a* of the second wall portion 212.

The second piercing holder 522 is a circular thick plate member which has a second through hole 522*a* serving as a passage of the second piercing punch 523. The second through hole 522*a* is a circular hole which penetrates in a plate thickness direction of the second piercing holder 522 and has the same center axis line as the center axis line of the second piercing holder 522.

The second piercing holder 522 is provided so as to be movable outside the second wall portion 212 along the first axis line X inside the second forming hole 521*a* of the second burring die 521 in a state where the center axis line of the second through hole 522*a* coincides with the first axis line X. In addition, the second piercing holder 522 includes a flat surface 522*b* which can come into surface contact with the outer wall surface 212*a* of the second wall portion 212.

The second piercing punch 523 is a columnar shaft member for forming prepared holes on the second wall portion 212. The second piercing punch 523 is provided so as to be movable between the outside and the inside of the second wall portion 212 along the first axis line X inside the second through hole 522*a* of the second piercing holder 522 in a state where the center axis line of the second piercing punch 523 coincides with the first axis line X.

As described above, in the second external unit 520, the second burring die 521, the second piercing holder 522, and the second piercing punch 523 have the first axis line X as the center axis lines.

In addition, in the second external unit 520, preferably, an inner circumferential surface of the second burring die 521 (a surface of the second forming hole 521*a*) and an outer circumferential surface of the second piercing holder 522 come into close contact with each other. In addition, preferably, an inner circumferential surface of the second piercing holder 522 (a surface of the second through hole 522*a*) and an outer circumferential surface of the second piercing punch 523 come into close contact with each other.

Accordingly, when the second piercing punch 423 moves along the first axis line X, it is possible to prevent the center axis lines of the second piercing punch 423 from being deviated from the first axis line X.

The internal unit 530 includes a housing 531, a first burring punch 532, a second burring punch 533, and a stopper 534.

The housing 531 is a cylindrical member which includes the first burring punch 532 and the second burring punch 533 and in which both end surfaces are open. The housing 531 is disposed between the first wall portion 211 and the second wall portion 212 in a state where the center axis line of the housing coincides with the first axis line X. In addition, the housing 531 includes a first opening portion 531*a* and a second opening portion 531*b* which are open to have sizes of the openings through which the stopper 534 can pass along the second axis line Y.

When the housing 531 is disposed between the first wall portion 211 and the second wall portion 212, the housing 531 is configured such that one end surface of the housing 531 comes into surface contact with the inner wall surface 211*b* of the first wall portion 211, and the other end surface of the housing 531 comes into surface contact with the inner wall surface 212*b* of the second wall portion 212.

The first burring punch 532 has the first axis line X as the center axis line along with the first piercing punch 513, and is a cylindrical shaft member for forming the burring hole by bending the peripheral edge portion of the prepared hole of the first wall portion 211 to the outside of the first wall portion 211.

The first burring punch 532 includes a first piercing hole 532*a* into which the first piercing punch 513 is inserted. The first piercing hole 532*a* is a circular hole which has a bottom portion and has the same center axis line as the center axis line of the first burring punch 532. Preferably, the diameter of the first piercing hole 532*a* is the same as the outer diameter of the first piercing punch 513.

The first burring punch 532 is provided so as to be movable between the outside and the inside of the first wall portion 211 along the first axis line X inside the housing 531 in a state where the center axis line of the first piercing hole 532*a* coincides with the first axis line X. In addition, the first burring punch 532 has a flat surface 532*b*, which can come into surface contact with the inner wall surface 211*b* of the first wall portion 211, as one end surface, and has an inclined surface 532*c*, which is inclined in the direction toward the first wall portion 211 with respect to the second axis line Y, as the other end surface.

The second burring punch 533 has the first axis line X as the center axis line along with the second piercing punch 523, and is a cylindrical shaft member for forming the burring hole by bending the peripheral edge portion of the prepared hole of the second wall portion 212 to the outside of the second wall portion 212. The first burring die punch 532 and the second burring punch 533 are disposed so as to face each other in a state where the reference point P is interposed therebetween.

The second burring punch 533 includes a second piercing hole 533*a* into which the second piercing punch 523 is inserted. The second piercing hole 533*a* is a circular hole which has a bottom portion and has the same center axis line as the center axis line of the second burring punch 533. Preferably, the diameter of the second piercing hole 533*a* is the same as the outer diameter of the second piercing punch 523.

The second burring punch 533 is provided so as to be movable along the first axis line X between the outside and the inside of the second wall portion 212 inside the housing 531 in a state where the center axis line of the second piercing hole 533*a* coincides with the first axis line X. In addition, the second burring punch 533 has a flat surface 533*b*, which can come into surface contact with the inner wall surface 212*b* of the second wall portion 212, as one end surface, and has an inclined surface 533*c*, which is inclined in the direction toward the second wall portion 212 with respect to the second axis line Y, as the other end surface. The inclination angle of the inclined surface 533*c* of the second burring punch 533 is the same as the inclination angle of the inclined surface 532*c* of the first burring punch 532.

The stopper 534 is a thick plate member which is provided so as to be movable along the second axis line Y. The stopper 534 includes a first inclined surface 534*a* which is inclined toward the first wall portion 211 with respect to the second axis line Y, and a second inclined surface 534*b* which is inclined toward the second wall portion 212 with respect to the second axis line Y.

The inclination angle of the first inclined surface 534*a* is the same as the inclination angle of the inclined surface 532*c* of the first burring punch 532. The inclination angle of the second inclined surface 534*b* is the same as the inclination angle of the inclined surface 533*c* of the second burring punch 533. That is, the inclination angle of the first inclined surface 534*a* is the same as the inclination angle of the second inclined surface 534*b*.

Although the details will be described below, in a process in which the stopper 534 passes through the reference point P along the second axis line Y, the first inclined surface 534*a* of the stopper 534 comes into surface contact with the inclined surface 532*c* of the first burring punch 532, and the second inclined surface 534*b* of the stopper 534 comes into surface contact with the inclined surface 533*c* of the second burring punch 533.

In the state where the stopper 534 comes into surface contact with the first burring punch 532 and the second burring punch 533, if the stopper 534 advances deeper from the reference point P, the first burring punch 532 moves toward the first wall portion 211, and the second burring punch 533 moves toward the second wall portion 212.

As a result, the flat surface 532*b* of the first burring punch 532 comes into surface contact with the inner wall surface 211*b* of the first wall portion 211, and the flat surface 533*b* of the second burring punch 533 comes into surface contact with the inner wall surface 212*b* of the second wall portion 212.

In this way, in the process in which the stopper 534 passes through the reference point P along the second axis line Y, the stopper 534 has a shape which causes the first burring punch 532 to move toward the first wall portion 211 and the second burring punch 533 to move toward the second wall portion 212.

In addition, the stopper 534 includes a separation block 534*c* which is separated from the stopper 534 and is movable along the first axis line X inside the housing 531 along with the first burring punch 532 and the second burring punch 533 when the stopper stops in a state where the first burring punch 532 comes into pressure contact with the inner wall surface 211*b* of the first wall portion 211 and the second burring punch 533 comes into pressure contact with the inner wall surface 212*b* of the second wall portion 212.

In the internal unit 530 configured as described above, the housing 531, the first burring punch 532, and the second burring punch 533 have the first axis line X as the center axis lines.

In addition, in the internal unit 530, preferably, the inner circumferential surface of the housing 531 and the outer circumferential surface of the first burring punch 532 come into close contact with each other, and preferably, the inner circumferential surface of the housing 531 and the outer circumferential surface of the second burring punch 533 come into close contact with each other.

Accordingly, when each of the first burring punch 532 and the second burring punch 533 moves along the first axis line X, it is possible to prevent the center axis line from being deviated from the first axis line X.

Next, the burring method according to the third embodiment which is realized using the burring apparatus 500 configured as described above will be described.

<First Process>

First, as shown in FIGS. 19A and 19B, the first external unit 510 of the burring apparatus 500 is disposed outside the first wall portion 211, the second external unit 520 of the burring apparatus 500 is disposed outside the second wall portion 212, and the internal unit 530 of the burring apparatus 500 is disposed between the first wall portion 211 and the second wall portion 212.

That is, in a state where the first burring die 511, the first piercing holder 512, and the first piercing punch 513 have the first axis line X as the center axis lines, the first external unit 510 is disposed outside the first wall portion 211.

In addition, in a state where the second burring die 521, the second piercing holder 522, and the second piercing punch 523 have the first axis line X as the center axis lines, the second external unit 520 is disposed outside the second wall portion 212.

Moreover, in a state where the housing 531, the first burring punch 532, and the first burring punch 533 have the first axis line X as the center axis lines, the housing 531 of the internal unit 530 is disposed between the first wall portion 211 and the second wall portion 212.

In addition, at this time, the stopper 534 is disposed outside the housing 531. In addition, one end surface of the housing 531 comes into surface contact with the inner wall surface 211*b* of the first wall portion 211, and the other end surface of the housing 531 comes into surface contact with the inner wall surface 212*b* of the second wall portion 212.

Figure 20:
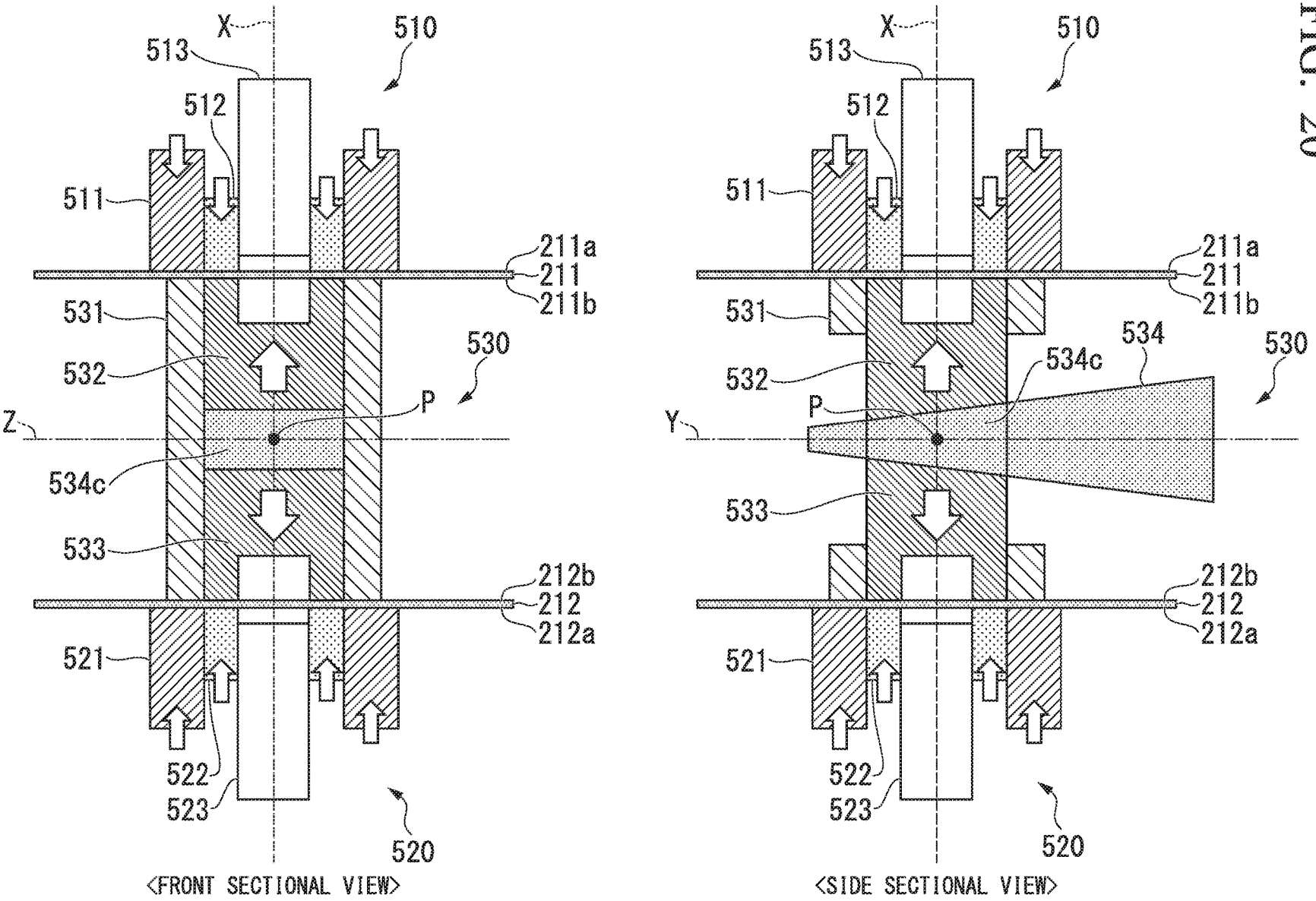
FIG. 20 is an explanatory view with respect to a first process of a burring method according to the third embodiment of the present invention.

Subsequently, as shown in FIG. 20, in the first external unit 510, the first burring die 511 and the first piercing holder 512 move toward the first wall portion 211 along the first axis line X using an actuator (not shown) until the first burring die 511 and the first piercing holder 512 come into contact with the outer wall surface 211*a* of the first wall portion 211.

After the first burring die 511 and the first piercing holder 512 come into contact with the outer wall surface 211*a* of the first wall portion 211, the first burring die 511 and the first piercing holder 512 come into pressure contact with the outer wall surface 211*a* of the first wall portion 211 by applying a pressing force to first burring die 511 and the first piercing holder 512 in a direction toward the first wall portion 211 using the actuator.

Similarly, in the second external unit 520, the second burring die 521 and the second piercing holder 522 move toward the second wall portion 212 using an actuator (not shown) until the second burring die 521 and the second piercing holder 522 come into contact with the outer wall surface 212*a* of the second wall portion 212.

After the second burring die 521 and the second piercing holder 522 come into contact with the outer wall surface 212*a* of the second wall portion 212, the second burring die 521 and the second piercing holder 522 come into pressure contact with the outer wall surface 212*a* of the second wall portion 212 by applying a pressing force to the second burring die 521 and the second piercing holder 522 in a direction toward the second wall portion 212 using the actuator.

In addition, in the internal unit 530, the stopper 534 moves toward the reference point P along the second axis line Y using an actuator (not shown). In the process in which the stopper 534 passes through the reference point P along the second axis line Y, the first burring punch 532 moves toward the first wall portion 211 and the second burring punch 533 moves toward the second wall portion 212 while the first inclined surface 534*a* of the stopper 534 comes into surface contact with the inclined surface 532*c* of the first burring punch 532 and the second inclined surface 534*b* of the stopper 534 comes into surface contact with the inclined surface 533*c* of the second burring punch 533.

The stopper 534 moves along the second axis line Y at a position at which the flat surface 532*b* of the first burring punch 532 comes into surface contact with the inner wall surface 211*b* of the first wall portion 211 and the flat surface 533*b* of the second burring punch 533 comes into surface contact with the inner wall surface 212*b* of the second wall portion 212.

By further moving the stopper 534 from the position by a predetermined distance, the pressing force is applied to the first burring punch 532 in the direction toward the first wall portion 211, and the pressing force is applied to the second burring punch 533 in the direction toward the second wall portion 212.

As a result, the first burring punch 532 comes into pressure contact with the inner wall surface 211*b* of the first wall portion 211, and the second burring punch 533 comes into pressure contact with the inner wall surface 212*b* of the second wall portion 212.

In this way, by inserting the stopper 534 into a portion between the first burring punch 532 and the second buffing punch 533, the first burring punch 532 comes into pressure contact with the inner wall surface 211*b* of the first wall portion 211, and the second burring punch 533 comes into pressure contact with the inner wall surface 212*b* of the second wall portion 212.

As shown in FIG. 20, at the time when the above-described first process ends, the first burring die 511 and the housing 531 are disposed so as to face each other in a state where the first wall portion 211 is interposed therebetween, and the first piercing holder 512 and the first burring punch 532 are disposed so as to face each other in a state where the first wall portion 211 is interposed therebetween.

In addition, the second burring die 521 and the housing 531 are disposed so as to face each other in a state where the second wall portion 212 is interposed therebetween, and the second piercing holder 522 and the second burring punch 533 are disposed so as to face each other in a state where the second wall portion 212 is interposed therebetween.

<Second Process>

Figure 21:
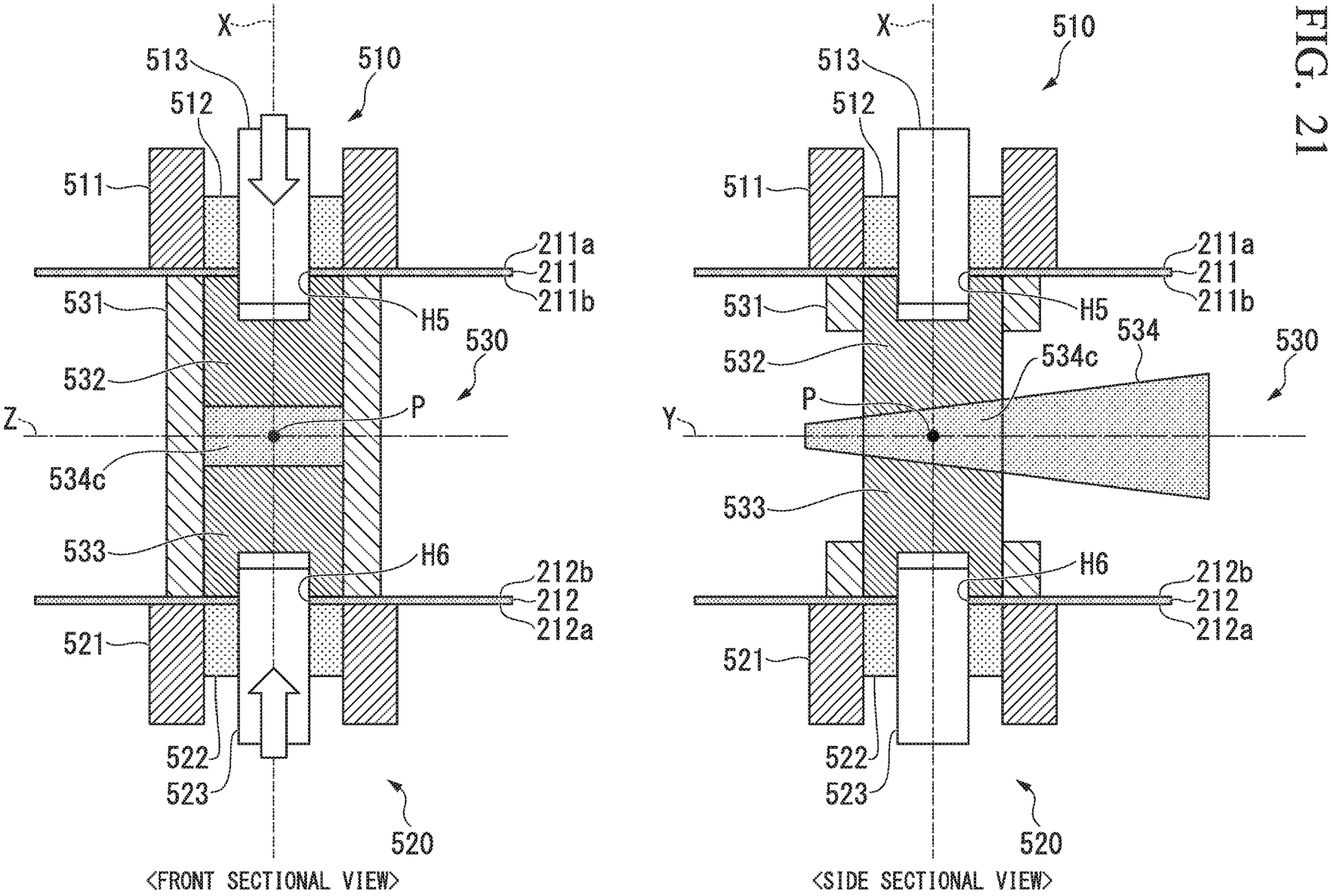
FIG. 21 is a first explanatory view with respect to a second process of the burring method according to the third embodiment of the present invention.

Subsequently, as shown in FIG. 21, by moving the first piercing punch 513 from the outside of the first wall portion 211 to the inside thereof along the first axis line X using an actuator (not shown) such that the first piercing punch 513 is inserted into the first piercing hole 532*a* of the first burring punch 532, one of the prepared holes is formed on the first wall portion 211.

Accordingly, a prepared hole H5, which has the first axis line X as the center axis line and has the same diameter as the outer diameter of the first piercing punch 513, is formed on the first wall portion 211.

Similarly, by moving the second piercing punch 523 from the outside of the second wall portion 212 to the inside thereof along the first axis line X using an actuator (not shown) such that the second piercing punch 523 is inserted into the second piercing hole 533*a* of the second burring punch 533, the other prepared hole is formed on the second wall portion 212.

Accordingly, a prepared hole H6, which has the first axis line X as the center axis line and has the same diameter as the outer diameter of the second piercing punch 523, is formed on the second wall portion 212.

In addition, the formations of the prepared holes H5 and H6 may be performed at timings different from each other, or may be simultaneously performed.

Figure 22:
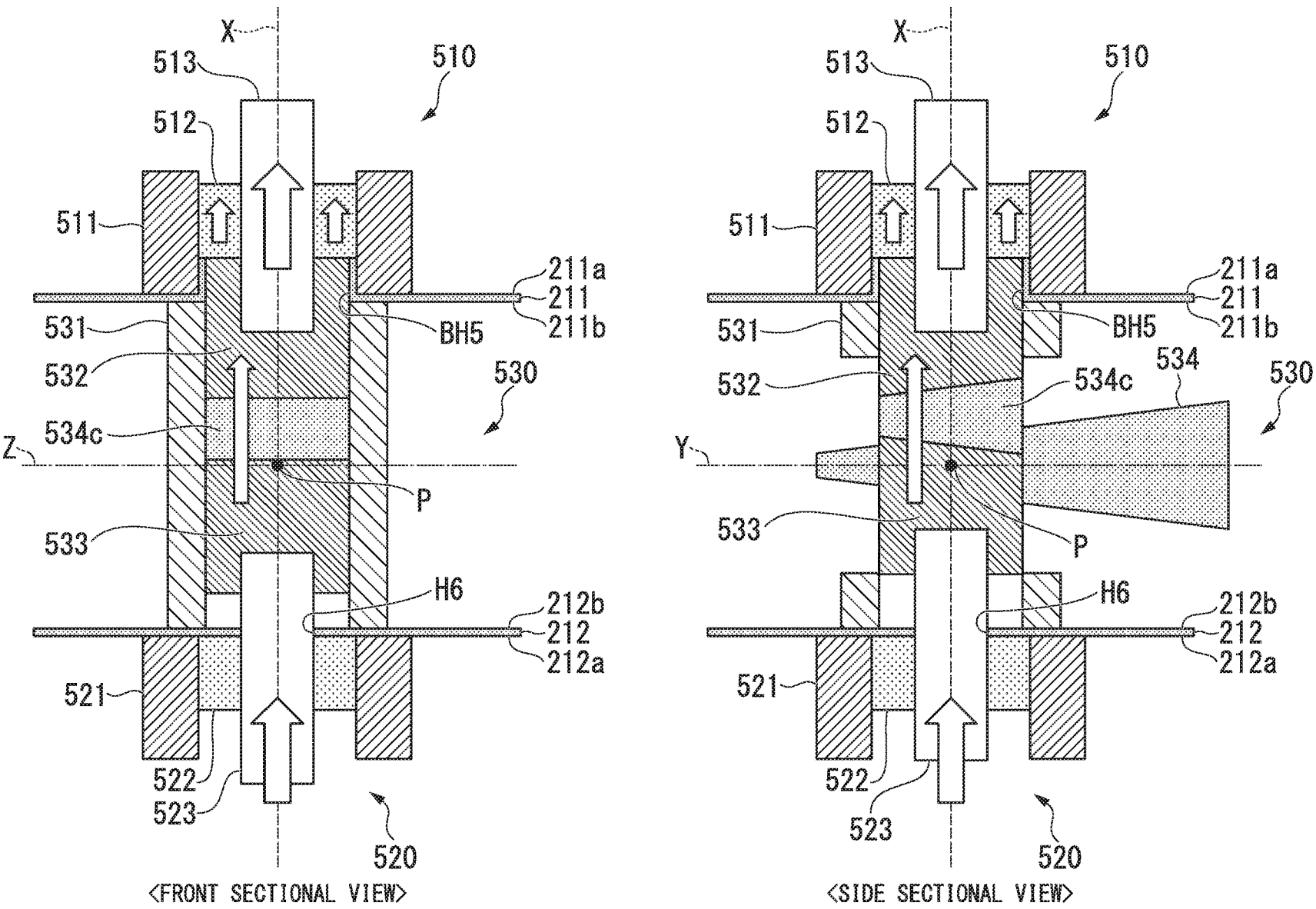
FIG. 22 is a second explanatory view with respect to the second process of the burring method according to the third embodiment of the present invention.

Subsequently, as shown in FIG. 22, by moving the second piercing punch 523 toward the first wall portion 211 along the first axis line X in the state where the front end of the second piercing punch 523 comes into contact with the bottom portion of the second piercing hole 533*a* of the second burring punch 533, the second burring punch 533, the separable separation block 534*c* provided on the stopper 534, and the first burring punch 532 simultaneously move toward the outside of the first wall portion 211 along the first axis line X.

As described above, by moving the first burring punch 532 from the inside of the first wall portion 211 to the outside thereof along the first axis line X such that the first burring punch 532 is inserted into the first forming hole 511*a* of the first burring die 511, the peripheral edge portion of the prepared hole H5 of the first wall portion 211 is bent to the outside of the first wall portion 211 to form one of the burring holes.

Accordingly, a burring hole BH5 which has the first axis line X as the center axis line and has the rising wall portion extending toward the outside of the first wall portion 211 is formed on the first wall portion 211. The inner diameter of the burring hole BH5 is the same as the outer diameter of the first burring punch 532. The height of the rising wall portion formed on the peripheral edge portion of the burring hole BH5 is determined by the difference between the outer diameter of the first piercing punch 513 and the outer diameter of the first burring punch 532.

Figure 23:
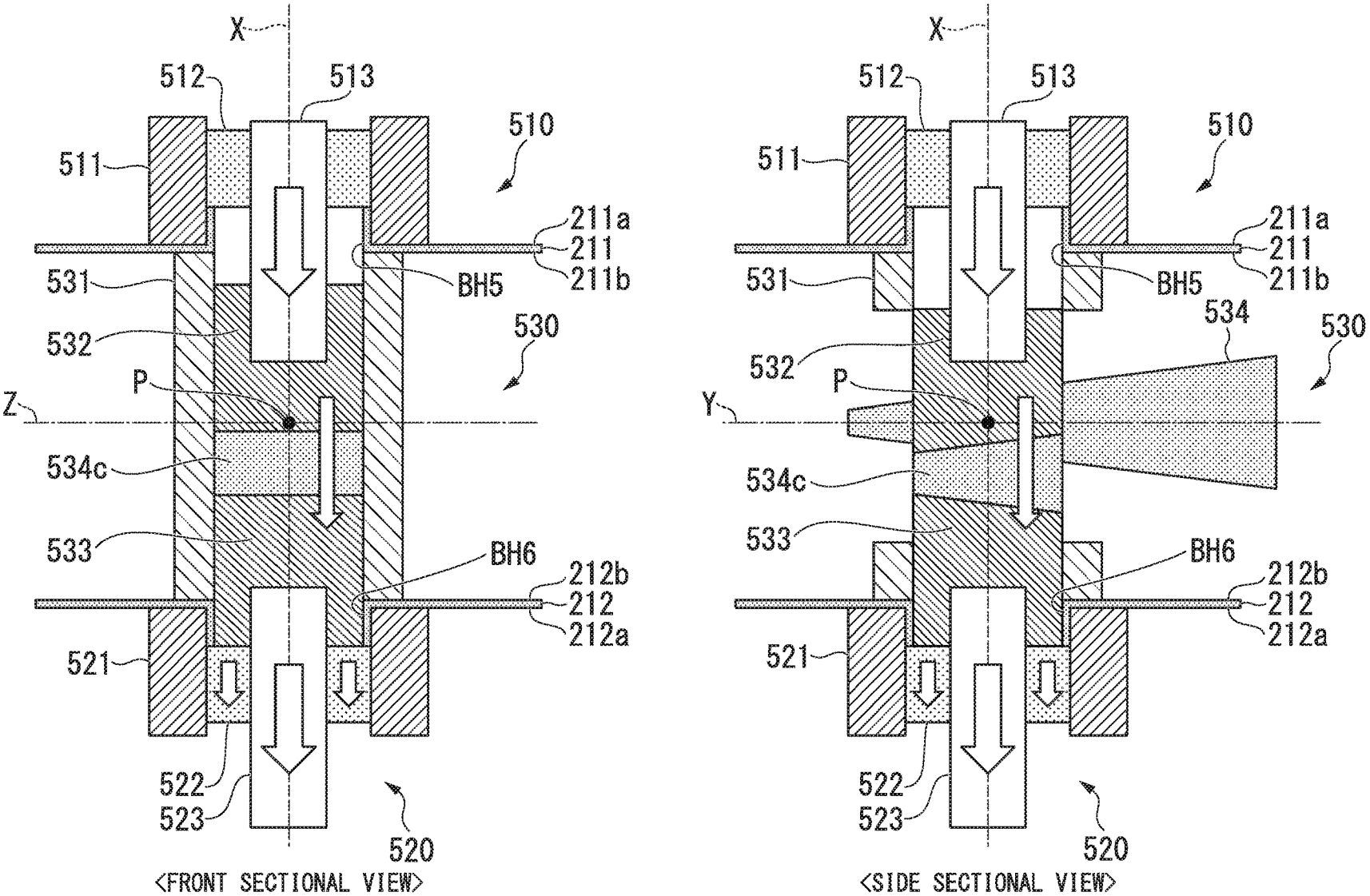
FIG. 23 is a third explanatory view with respect to the second process of the burring method according to the third embodiment of the present invention.

Subsequently, as shown in FIG. 23, by moving the first piercing punch 513 toward the second wall portion 212 along the first axis line X in the state where the front end of the first piercing punch 513 comes into contact with the bottom portion of the first piercing hole 532*a* of the first burring punch 532, the first burring punch 532, the separation block 534*c*, and the second burring punch 533 simultaneously move toward the outside of the second wall portion 212 along the first axis line X.

As described above, by moving the second burring punch 533 from the inside of the second wall portion 212 to the outside thereof along the first axis line X such that the second burring punch 533 is inserted into the second forming hole 521*a* of the second burring die 521, the peripheral edge portion of the prepared hole H6 of the second wall portion 212 is bent to the outside of the second wall portion 212 to from the other burring hole.

Accordingly, a burring hole BH6 which has the first axis line X as the center axis line and has the rising wall portion extending toward the outside of the second wall portion 212 is formed on the second wall portion 212. The inner diameter of the burring hole BH6 is the same as the outer diameter of the second burring punch 533. The height of the rising wall portion formed on the peripheral edge portion of the burring hole BH6 is determined by the difference between the outer diameter of the second piercing punch 523 and the outer diameter of the second burring punch 533.

Figure 24:
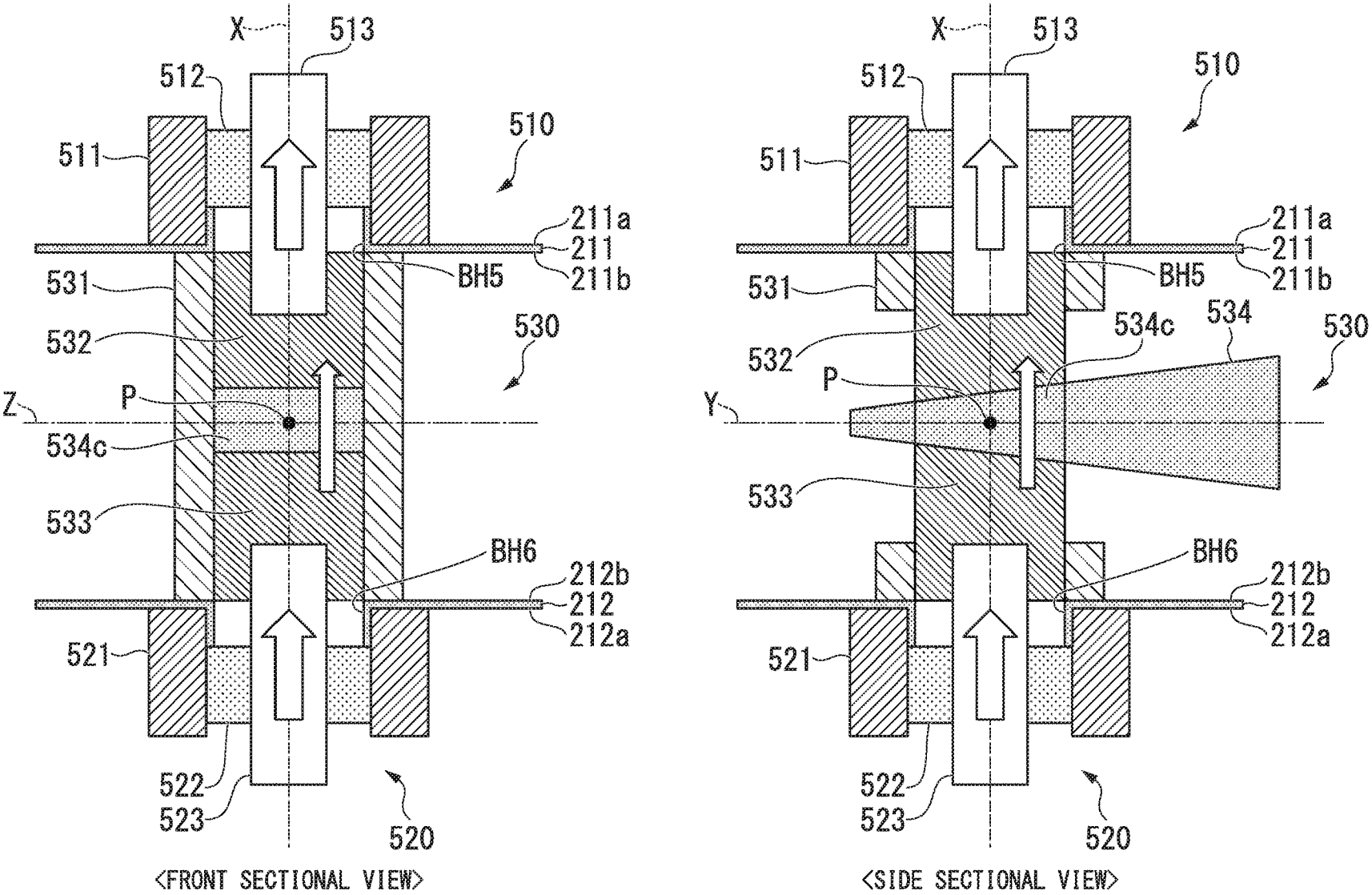
FIG. 24 is a fourth explanatory view with respect to the second process of the burring method according to the third embodiment of the present invention.

Subsequently, as shown in FIG. 24, by moving the second piercing punch 523 toward the first wall portion 211 along the first axis line X in the state where the front end of the second piercing punch 523 comes into contact with the bottom portion of the second piercing hole 533*a* of the second burring punch 533, the separation block 534*c* is returned into stopper 534.

As described above, at the time when the second process ends, the burring holes BH5 and BH6 having the first axis lines X as the center axis lines are formed, the entirety of the first burring punch 532 and the second burring punch 533 is completely accommodated inside the housing 531.

<Third Process>

Figure 25:
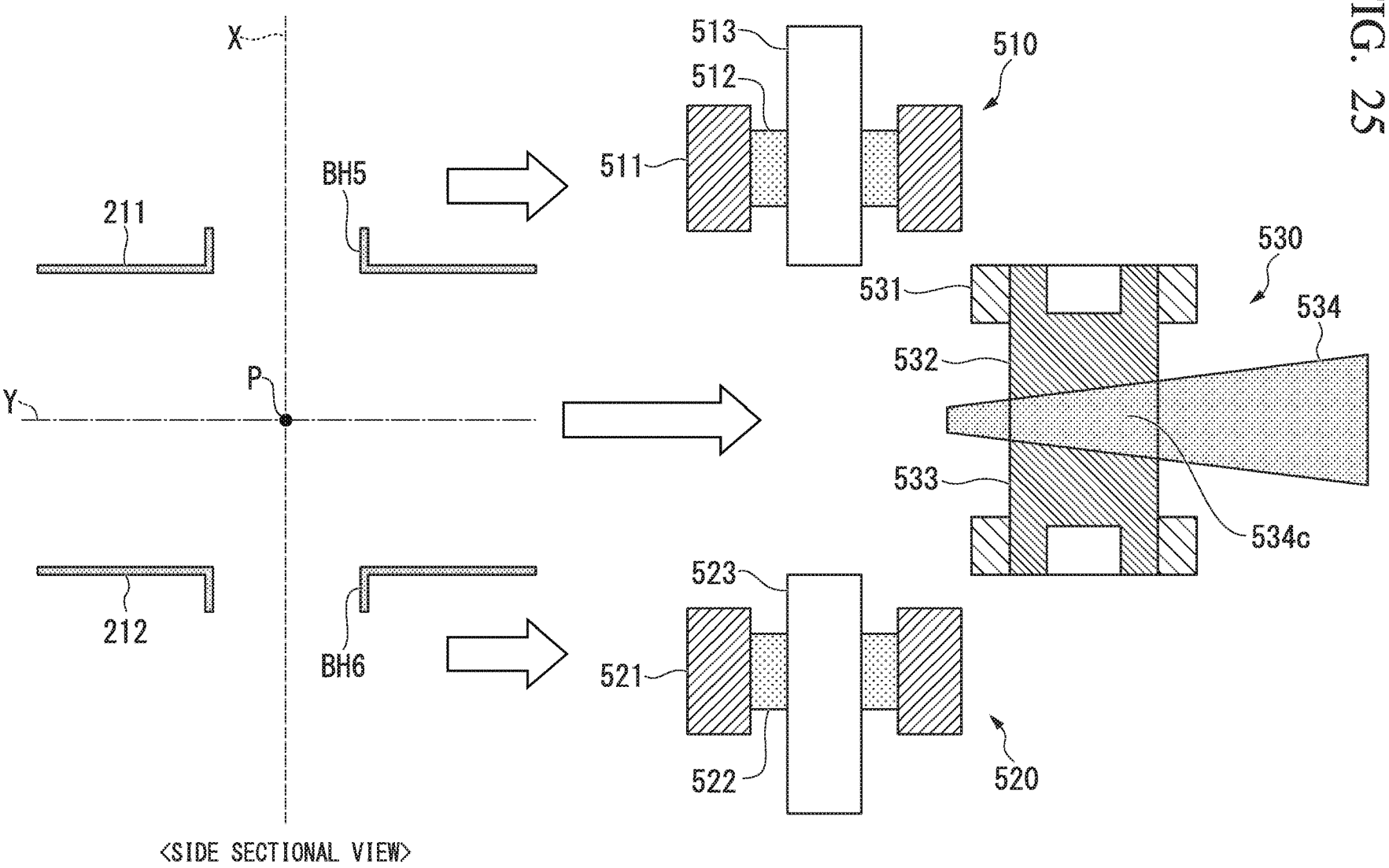
FIG. 25 is an explanatory view with respect to a third process of the burring method according to the third embodiment of the present invention.

Finally, as shown in FIG. 25, the first external unit 510 is detached from the first wall portion 211, the second external unit 520 is detached from the second wall portion 212, the internal unit 530 is detached from the portion between the first wall portion 211 and the second wall portion 212, and the burring ends.

Since the entirety of the first burring punch 532 and the second burring punch 533 is completely accommodated inside the housing 531, it is possible to easily detach the internal unit 530 (housing 531) from the portion between the first wall portion 211 and the second wall portion 212.

As described above, in the third embodiment, after the prepared hole H5 is formed on the first wall portion 211 using the first piercing punch 513, the peripheral edge portion of the prepared hole H5 of the first wall portion 211 is bent to the outside of the first wall portion 211 using the first burring punch 532 having the first axis line X as the center axis line along with the first piercing punch 513 to form the burring hole BH5.

In addition, in the third embodiment, after the prepared hole H6 is formed on the second wall portion 212 using the second piercing punch 523, the peripheral edge portion of the prepared hole H6 of the second wall portion 212 is bent to the outside of the second wall portion 212 using the second burring punch 533 having the first axis line X as the center axis line along with the second piercing punch 523 to form the burring hole BH6.

Accordingly, it is possible to significantly decrease misalignment occurring between the center axis lines of the prepared holes H5 and H6 and the center axis lines of the burring holes BH5 and BH6, and it is possible to very accurately form the burring holes BH5 and BH6 having the same axis line (first axis line X) as the center axis lines.

In addition, according to the third embodiment, even when it is possible to simultaneously form the prepared hole H5 of the first wall portion 211 and the prepared hole H6 of the second wall portion 212, it is not possible to simultaneously form the burring hole BH5 of the first wall portion 211 and the burring hole H6 of the second wall portion 212. However, the third embodiment is sufficiently effective due to only the fact that it is possible to simultaneously form the prepared hole H5 of the first wall portion 211 and the prepared hole H6 of the second wall portion 212.

Moreover, unlike the second embodiment, in the third embodiment, it is not necessary to provide the burring punch return mechanism which applies an external force toward the reference point P to the first burring punch 532 and the second burring punch 533, it is possible to decrease the size of the internal unit 530. Accordingly, according to the third embodiment, it is also possible to cope with a case in which a space between the first wall portion 211 and the second wall portion 212 is small.

In this way, similarly to the first and second embodiments, according to the third embodiment, it is possible to accurately and effectively form the burring holes BH5 and BH6 having the same axis line (first axis line X) as the center axis lines with respect to the first wall portion 211 and the second wall portion 212 facing each other, and it is possible to decrease the size of the internal unit 530.

Fourth Embodiment

Next, a burring apparatus and a burring method according to a fourth embodiment of the present invention will be described. In the fourth embodiment, a burring apparatus and a burring method for forming a burring hole having a rising wall portion which is bent toward the inside of the first wall portion 211 on the first wall portion 211, and a burring hole having a rising wall portion which is bent toward the outside of the second wall portion 212 on the second wall portion 212 will be described.

Figure 26A:
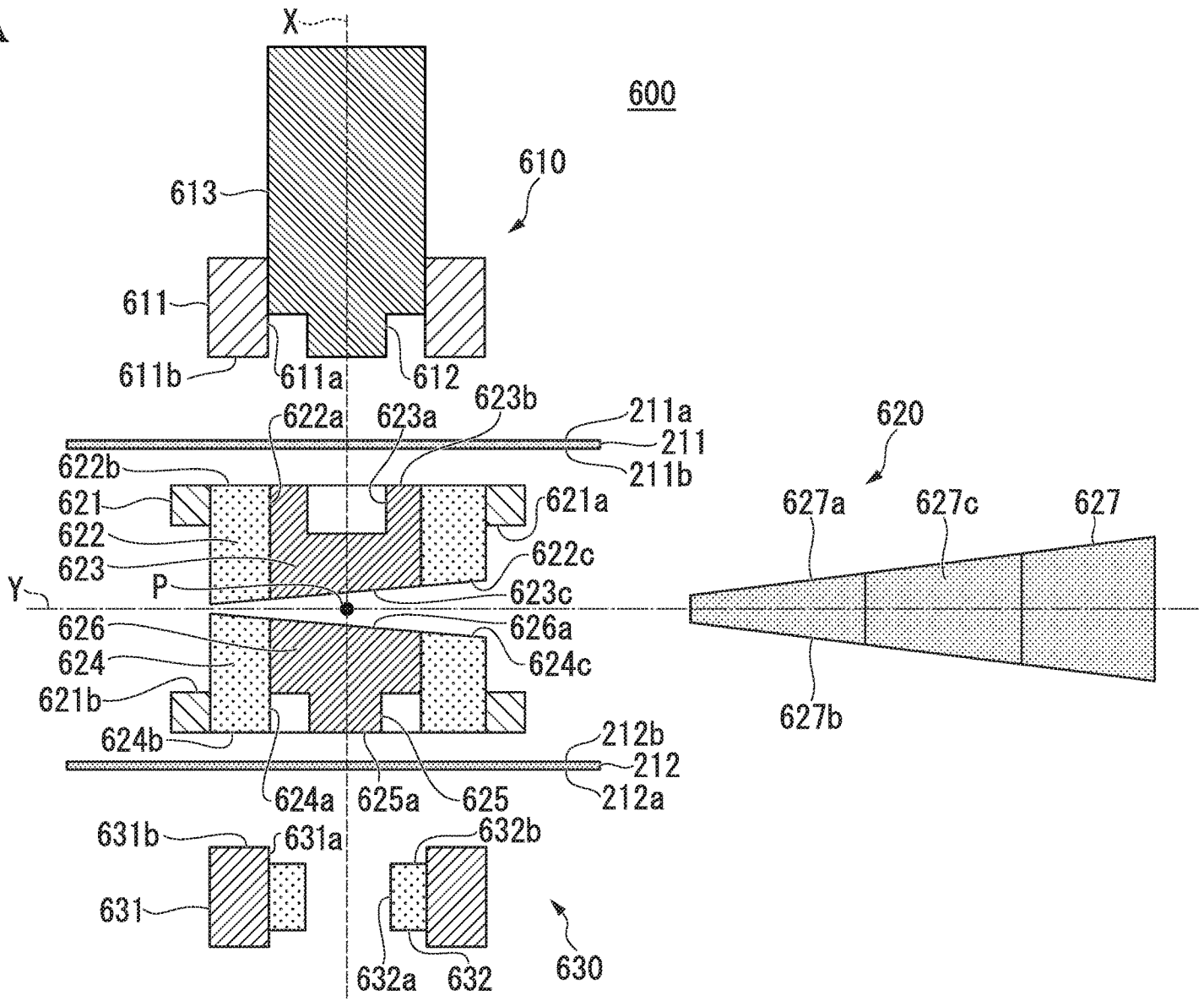
FIG. 26A is a side sectional view of a burring apparatus 600 according to a fourth embodiment of the present invention.
Figure 26B:
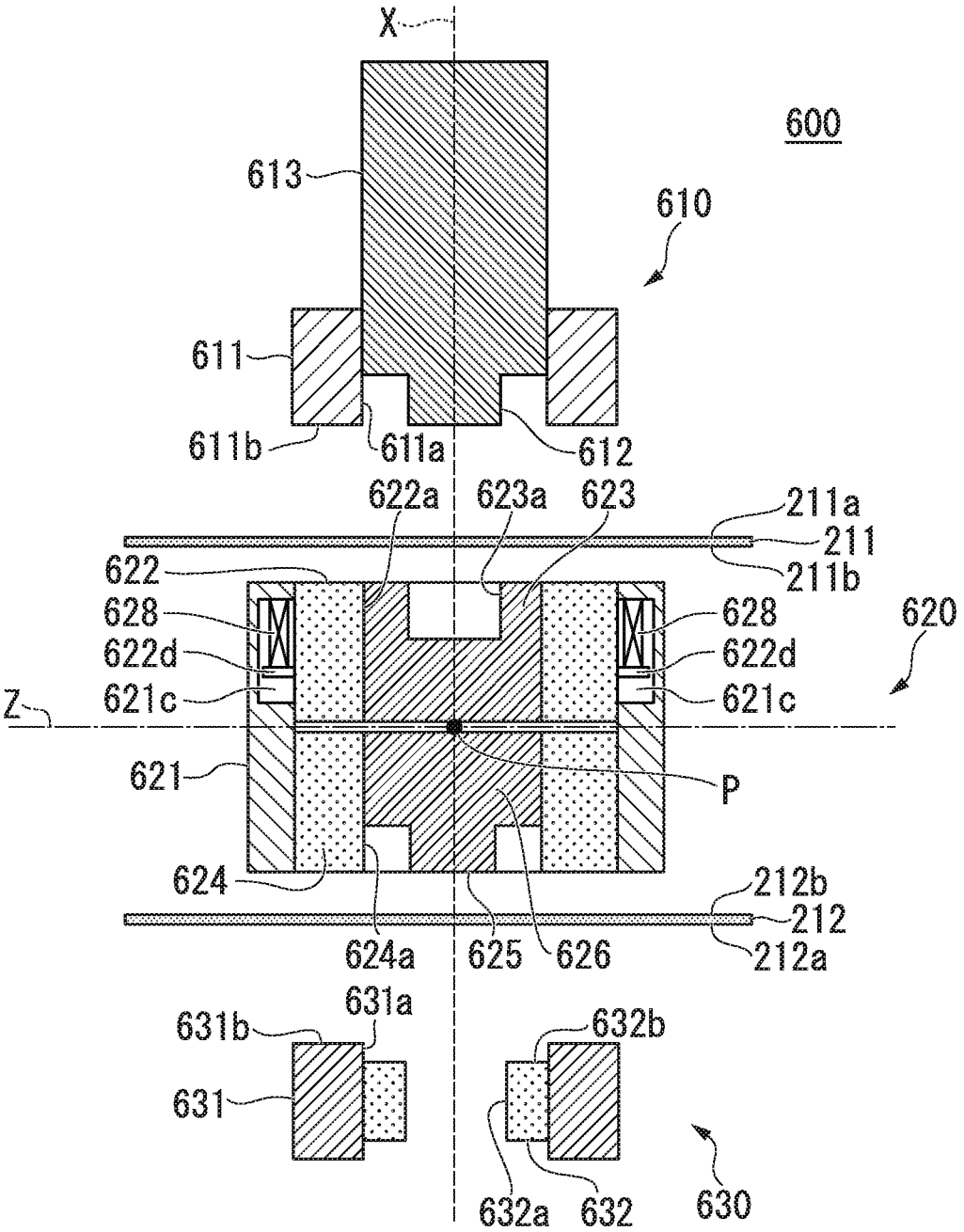
FIG. 26B is a front sectional view of the burring apparatus 600 according to the fourth embodiment of the present invention.

FIG. 26A is a side sectional view of a burring apparatus 600 according to the fourth embodiment. FIG. 26B is a front sectional view of the burring apparatus 600 according to the fourth embodiment. In addition, FIG. 26A is a view when the burring apparatus 600 is viewed along the cross section including the first axis line X and the second axis line Y. FIG. 26B is a view when the burring apparatus 600 is viewed along the cross section including the first axis line X and the third axis line Z.

As shown in FIGS. 26A and 26B, the burring apparatus 600 includes a first external unit 610 which is disposed outside the first wall portion 211, an internal unit 620 which is disposed between the first wall portion 211 and the second wall portion 212, and a second external unit 630 which is disposed outside the second wall portion 212.

The first external unit 610 includes a first burring holder 611, a first piercing punch 612, and a first burring punch 613.

The first burring holder 611 is a circular thick plate member which has a first through hole 611*a* serving as a passage of the first burring punch 613. The first through hole 611*a* is a circular hole which penetrates in a plate thickness direction of the first burring holder 611 and has the center axis line of the first burring holder 611 as the center axis line.

The first burring holder 611 is provided so as to be movable outside the first wall portion 211 along the first axis line X in a state where the center axis line of the first through hole 611*a* coincides with the first axis line X. In addition, the first burring holder 611 has a flat surface 611*b* which can come into surface contact with an outer wall surface 211*a* of the first wall portion 211.

The first piercing punch 612 is a columnar shaft member for forming the prepared holes on the first wall portion 211. The first burring punch 613 has the first axis line X as the center axis line along with the first piercing punch 612 and is a columnar shaft member for forming the burring holes on the first wall portion 211 by bending the peripheral edge portion of the prepared hole of the first wall portion 211 to the inside of the first wall portion 211.

The first piercing punch 612 is attached to the front end of the first burring punch 613 while having the first axis line X as the center axis line along with the first burring punch 613. The first burring punch 613 is provided so as to be movable along the first axis line X inside the first through hole 611*a* of the first burring holder 611 in a state where the center axis line of the first burring punch 613 coincides with the first axis line X.

As described above, in the first external unit 610, the first burring holder 611, the first piercing punch 612, and the first burring punch 613 have the first axis line X as the center axis lines.

In addition, in the first external unit 610, preferably, an inner circumference surface (a surface of the first through hole 611*a*) of the first burring holder 611 and an outer circumference surface of the first burring punch 613 come into close contact with each other.

Accordingly, when the first piercing punch 612 and the first burring punch 613 are integrated with each other and move along the first axis line X, it is possible to prevent the center axis lines of the first piercing punch 612 and the first burring punch 613 from being deviated from the first axis line X.

The internal unit 620 includes a housing 621, a first burring die 622, a first piercing die 623, a second burring holder 624, a second piercing punch 625, a second burring punch 626, and a stopper 627.

The housing 621 is a cylindrical member which includes the first burring die 622, the first piercing die 623, the second burring holder 624, the second piercing punch 625, and the second burring punch 626 and in which both end surfaces are open. The housing 621 is disposed between the first wall portion 211 and the second wall portion 212 in a state where the center axis line of the housing coincides with the first axis line X. In addition, the housing 621 includes a first opening portion 621*a* and a second opening portion 621*b* which are open to have sizes of the openings through which the stopper 627 can pass along the second axis line Y.

The first burring die 622 is a circular thick plate member having a first forming hole 622*a* into which the first burring punch 613 is inserted. The first forming hole 622*a* is a circular hole which penetrates along the plate thickness direction of the first burring die 622 and has the center axis line of the first burring die 622 as the center axis line. Preferably, the diameter of the first forming hole 622*a* has the same value as the sum of the outer diameter of the first burring punch 613 and the thickness of the first wall portion 211.

The first burring die 622 is provided so as to be movable along the first axis line X inside the housing 621 in a state where the center axis line of the first forming hole 622*a* coincides with the first axis line X. In addition, the first burring die 622 includes a flat surface 622*b* which can come into surface contact with the inner wall surface 211*b* of the first wall portion 211, and an inclined surface 622*c* which is inclined in the direction toward the first wall portion 211 with respect to the second axis line Y.

The first piercing die 623 is a circular thick plate member which has the first piercing hole 623*a* into which the first piercing punch 612 is inserted. The first piercing hole 623*a* is a circular hole which has a bottom portion and has the same center axis line as the center axis line of the first piercing die 623. Preferably, the diameter of the first piercing hole 623*a* is the same as the outer diameter of the first piercing punch 612.

The first piercing die 623 is provided so as to be movable along the first axis line X inside the first forming hole 622*a* of the first burring die 622 in a state where the center axis line of the first piercing hole 623*a* coincides with the first axis line X. In addition, the first piercing die 623 includes a flat surface 623*b* which can come into surface contact with the inner wall surface 211*b* of the first wall portion 211 and an inclined surface 623*c* which is inclined in the direction toward the first wall portion 211 with respect to the second axis line Y. The inclination angle of the inclined surface 623*c* of the first piercing die 623 is the same as the inclination angle of the inclined surface 622*c* of the first burring die 622.

The second burring die 624 is a circular thick plate member having a second through hole 624*a* serving as the passage of the second burring punch 626. The second through hole 624*a* is a circular hole which penetrates along the plate thickness direction of the second burring holder 624 and has the same center axis line as the center axis line of the second burring holder 624.

The second burring holder 624 is provided so as to be movable along the first axis line X inside the housing 621 in a state where the center axis line of the second through hole 624*a* coincides with the first axis line X. In addition, the second burring holder 624 includes a flat surface 624*b* which can come into surface contact with an inner wall surface 212*b* of the second wall portion 212 and an inclined surface 624*c* which is inclined in a direction toward the second wall portion 212 with respect to the second axis line Y.

The second piercing punch 625 is a columnar shaft member for forming the prepared hole on the second wall portion 212. The second burring punch 626 has the first axis line X as the center axis line along with the second piercing punch 625, and is a columnar shaft member for forming the burring hole on the second wall portion 212 by bending the peripheral edge portion of the prepared hole of the second wall portion 212 to the outside of the second wall portion 212.

The second piercing punch 625 is attached to the front end of the second burring punch 626 while having the first axis line X as the center axis line along with the second burring punch 626. The second burring punch 626 is provided so as to be movable along the first axis line X inside the second through hole 624*a* of the second burring holder 624 in a state where the center axis line of the second burring punch 626 coincides with the first axis line X.

The second piercing punch 625 includes a flat surface 625*a* which can come into surface contact with the inner wall surface 212*b* of the second wall portion 212. The second burring punch 626 includes an inclined surface 626*a* which is inclined in the direction toward the second wall portion 212 with respect to the second axis line Y.

The first burring die 622 and the second burring holder 624 are disposed so as to face each other in a state where the reference point P is interposed therebetween. The first piercing die 623 and the second burring punch 626 are disposed so as to face each other in a state where the reference point P is interposed therebetween.

When the entire first piercing die 623 is included inside the first burring die 622 (inside the first forming hole 622*a*), the flat surface 622*b* of the first burring die 622 and the flat surface 623*b* of the first piercing die 623 are flush with each other, and the inclined surface 622*c* of the first burring die 622 and the inclined surface 623*c* of the first piercing die 623 are flush with each other.

When the entirety of the second piercing punch 625 and the second burring punch 626 is included inside the second burring holder 624 (inside the second through hole 624*a*), the flat surface 624*b* of the second burring holder 624 and the flat surface 625*a* of the second piercing punch 625 are flush with each other, and the inclined surface 624*c* of the second burring holder 624 and the inclined surface 626*a* of the second burring punch 626 are flush with each other.

The inclination angle of the inclined surface 622*c* of the first burring die 622 (the inclined surface 623*c* of the first piercing die 623) is the same as the inclination angle of the inclined surface 624*c* of the second burring holder 624 (the inclined surface 626*a* of the second burring punch 626).

The stopper 627 is a thick plate member which is provided so as to be movable along the second axis line Y. The stopper 627 includes a first inclined surface 627*a* which is inclined toward the first wall portion 211 with respect to the second axis line Y, and a second inclined surface 627*b* which is inclined toward the second wall portion 212 with respect to the second axis line Y.

The inclination angle of the first inclined surface 627*a* is the same as the inclination angle of the inclined surface 622*c* of the first burring die 622 (the inclined surface 623*c* of the first piercing die 623). The inclination angle of the second inclined surface 627*b* is the same as the inclination angle of the inclined surface 624*c* of the second burring holder 624 (the inclined surface 626*a* of the second burring punch 626). That is, the inclination angle of the first inclined surface 627*a* is the same as the inclination angle of the second inclined surface 627*b*.

Although the details will be described below, in a process in which the stopper 627 passes through the reference point P along the second axis line Y, the first inclined surface 627*a* of the stopper 627 comes into surface contact with the inclined surface 622*c* of the first burring die 622 and the inclined surface 623*c* of the first piercing die 623, and the second inclined surface 627*b* of the stopper 627 comes into surface contact with the inclined surface 624*c* of the second burring holder 624 and the inclined surface 626*a* of the second burring punch 626.

In the state where the stopper 627 comes into surface contact with the first burring die 622, the first piercing die 623, the second burring holder 624, and the second burring punch 626, if the stopper 627 advances deeper from the reference point P, the first burring die 622 and the first piercing die 623 move toward the first wall portion 211, and the second burring holder 624 and the second burring punch 626 move toward the second wall portion 212.

As a result, the flat surface 622*b* of the first burring die 622 and the flat surface 623*b* of the first piercing die 623 come into surface contact with the inner wall surface 211*b* of the first wall portion 211, and the flat surface 624*b* of the second burring holder 624 and the flat surface 625*a* of the second piercing punch 625 come into surface contact with the inner wall surface 212*b* of the second wall portion 212.

In this way, in the process in which the stopper 627 passes through the reference point P along the second axis line Y, the stopper 627 has a shape which causes the first burring die 622 and the first piercing die 623 to move toward the first wall portion 211 and the second burring holder 624 and the second burring punch 625 (and the second piercing punch 626) to move toward the second wall portion 212.

In addition, the stopper 627 includes a separation block 627*c* which is separated from the stopper 627 and is movable along the first axis line X along with the first piercing die 623 and the second burring punch 626 when the stopper stops in a state where the first burring die 622 and the first piercing die 623 come into pressure contact with the inner wall surface 211*b* of the first wall portion 211 and the second piercing punch 625 attached to the front ends of the second burring holder 624 and the second burring punch 626 comes into pressure contact with the inner wall surface 212*b* of the second wall portion 212.

As shown in FIG. 26B, in the inner circumferential surface of the housing 621, a groove 621*c* which has a predetermined depth in the direction along the third axis line Z and a predetermined width in the direction along the first axis line X is formed on a region facing the first burring die 622. A protruding portion 622*d* which protrudes toward the groove 621*c* is provided on the outer circumferential surface of the first burring die 622. A spring 628 is disposed between the side wall surface of the first wall portion 211 side of the groove 621*c* and the protruding portion 622*d* such that the extension and contraction directions of the spring 628 are parallel to the first axis line X.

If the first burring die 622 having the protruding portion 622*d* moves toward the first wall portion 211, the spring 628 is compressed, and as a result, an external force toward the reference point P is applied to the first burring die 622. In this way, the internal unit 620 includes a die return mechanism which applies the external force toward the reference point P to the first burring die 622.

In the internal unit 620 configured as described above, the housing 621, the first burring die 622, the first piercing die 623, the second burring holder 624, the second piercing punch 625, and the second burring punch 626 have the first axis line X as the center axis lines.

In addition, in the internal unit 620, preferably, the inner circumferential surface of the housing 621 and the outer circumferential surface of the first burring die 622 come into close contact with each other, and preferably, the inner circumferential surface of the housing 621 and the outer circumferential surface of the second burring holder 624 come into close contact with each other.

Moreover, preferably, the inner circumferential surface of the first burring die 622 (the surface of the first forming hole 622*a*) and the outer circumferential surface of the first piercing die 623 come into close contact with each other, and preferably, the inner circumferential surface of the second burring holder 624 (the surface of the second through hole 624*a*) and the outer circumferential surface of the second burring punch 626 come into close contact with each other.

Accordingly, when each of the first burring die 622, the first piercing die 623, the second burring holder 624, the second piercing punch 625, and the second burring punch 626 move along the first axis line X, it is possible to prevent the center axis line from being deviated from the first axis line X.

The second external unit 630 includes a second burring die 631 and a second piercing die 632.

The second burring die 631 is a circular thick plate member having a second forming hole 631*a* into which the second burring punch 626 is inserted. The second forming hole 631*a* is a circular hole which penetrates along the plate thickness direction of the second burring die 631 and has the same center axis line as the center axis line of the second burring die 631. Preferably, the diameter of the second forming hole 631*a* has the same value as the sum of the outer diameter of the second burring punch 626 and the thickness of the second wall portion 212.

The second burring die 631 is provided so as to be movable outside the second wall portion 212 along the first axis line X in a state where the center axis line of the second forming hole 631*a* coincides with the first axis line X. In addition, the second burring die 631 includes a flat surface 631*b* which can come into surface contact with the outer wall surface 212*a* of the second wall portion 212.

The second piercing die 632 is a circular thick plate member having a second piercing hole 632*a* into which the second piercing punch 625 is inserted. The second piercing hole 632*a* is a circular hole which penetrates along the plate thickness direction of the second piercing die 632 and has the same center axis line as the center axis line of the second piercing die 632. Preferably, the diameter of the second piercing hole 632*a* is the same as the outer diameter of the second piercing punch 625.

The second piercing die 632 is provided so as to be movable outside the second wall portion 212 along the first axis line X inside the second forming hole 631*a* of the second burring die 631 in a state where the center axis line of the second piercing hole 632*a* coincides with the first axis line X. In addition, the second piercing die 632 includes a flat surface 632*b* which can come into surface contact with the outer wall surface 212*a* of the second wall portion 212.

As described above, in the second external unit 630, the second burring die 631 and the second piercing die 632 have the first axis line X as the center axis lines. In addition, in the second external unit 630, preferably, the inner circumferential surface of the second burring die 631 (the surface of the second forming hole 631*a*) and the outer circumferential surface of the second piercing die 632 come into close contact with each other.

Next, the burring method according to the fourth embodiment which is realized using the burring apparatus 600 configured as described above will be described.

<First Process>

First, as shown in FIGS. 26A and 26B, the first external unit 610 of the burring apparatus 600 is disposed outside the first wall portion 211, the internal unit 620 of the burring apparatus 600 is disposed between the first wall portion 211 and the second wall portion 212, and the second external unit 630 of the burring apparatus 600 is disposed outside the second wall portion 212.

That is, in the state where the first burring holder 611, the first piercing punch 612, and the first burring punch 613 have the first axis line X as the center axis lines, the first external unit 610 is disposed outside the first wall portion 211.

In addition, in the state where the housing 621, the first burring die 622, the first piercing die 623, the second burring holder 624, the second piercing punch 625, and the second burring punch 626 have the first axis line X as the center axis lines, the housing 621 of the internal unit 620 is disposed between the first wall portion 211 and the second wall portion 212. At this time, the stopper 627 is disposed outside the housing 621.

In addition, in the state where the second burring die 631 and the second piercing die 632 have the first axis line X as the center axis lines, the second external unit 630 is disposed outside the second wall portion 212.

Figure 27:
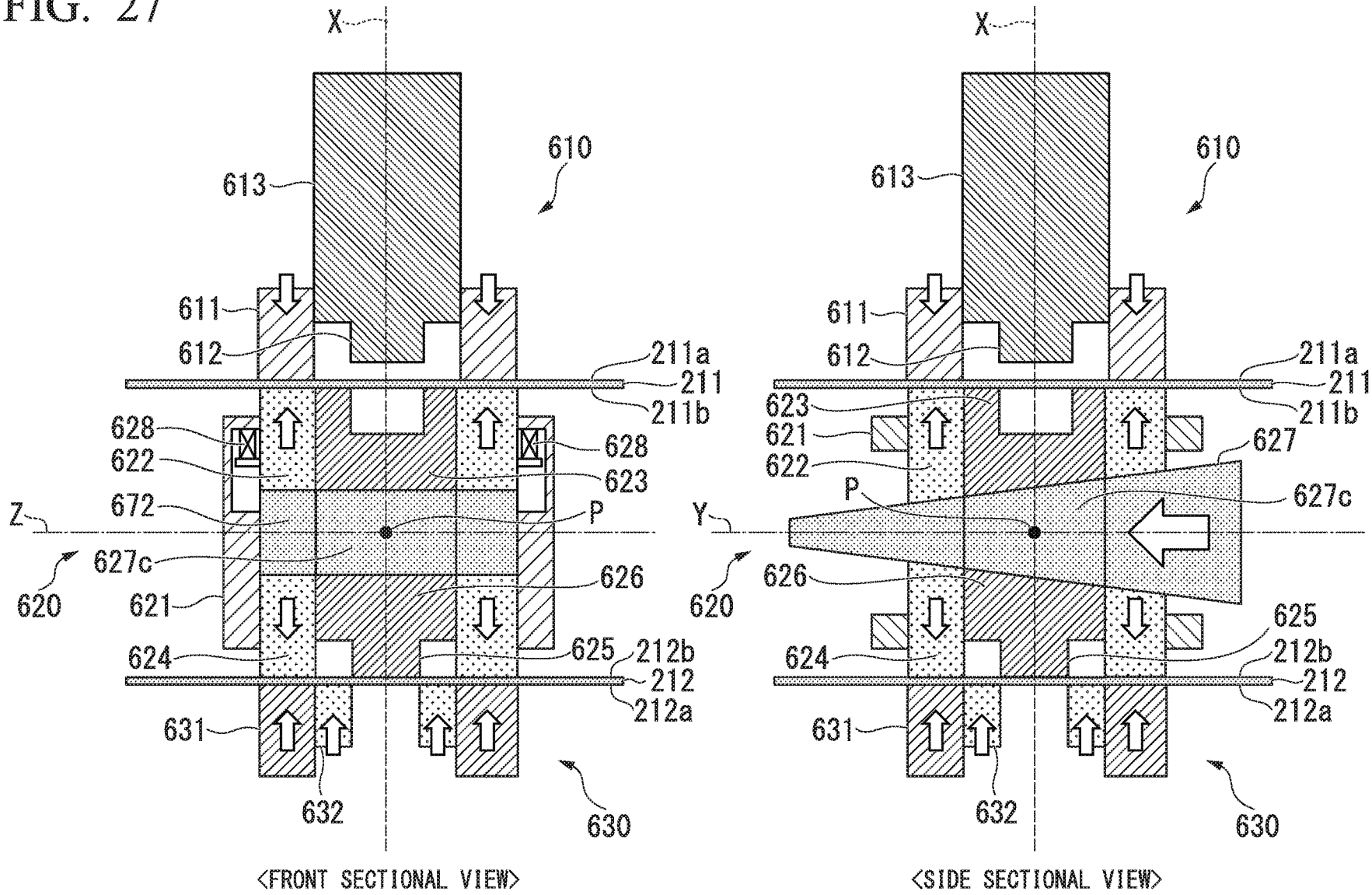
FIG. 27 is an explanatory view with respect to a first process of a burring method according to the fourth embodiment of the present invention.

Subsequently, as shown in FIG. 27, in the first external unit 610, the first burring holder 611 moves toward the first wall portion 211 along the first axis line X using an actuator (not shown) until the first burring holder 611 comes into contact with the outer wall surface 211*a* of the first wall portion 211.

After the first burring holder 611 comes into contact with the outer wall surface 211*a* of the first wall portion 211, the first burring holder 611 comes into pressure contact with the outer wall surface 211*a* of the first wall portion 211 by applying a pressing force to the first burring holder 611 in the direction toward the first wall portion 211 using the actuator.

Meanwhile, in the second external unit 630, the second burring die 631 and the second piercing die 632 move toward the second wall portion 212 along the first axis line X using an actuator (not shown) until the second burring die 631 and the second piercing die 632 comes into contact with the outer wall surface 212*a* of the second wall portion 212.

After the second burring die 631 and the second piercing die 632 comes into contact with the outer wall surface 212*a* of the second wall portion 212, the second burring die 631 and the second piercing die 632 comes into pressure contact with the outer wall surface 212*a* of the second wall portion 212 by applying a pressure force to the second burring die 631 and the second piercing die 632 in the direction toward the second wall portion 212 using the actuator.

In addition, in the internal unit 620, the stopper 627 moves toward the reference point P along the second axis line Y using an actuator (not shown). In the process in which the stopper 627 passes through the reference point P along the second axis line Y, the first burring die 622 and the first piercing die 623 move toward the first wall portion 211 and the second burring holder 624 and the second burring punch 626 move toward the second wall portion 212 while the first inclined surface 627*a* of the stopper 627 comes into surface contact with the inclined surface 622*c* of the first burring die 622 and the inclined surface 623*c* of the first piercing die 623 and the second inclined surface 627*b* of the stopper 627 comes into surface contact with the inclined surface 624*c* of the second burring holder 624 and the inclined surface 626*a* of the second burring punch 626.

The stopper 627 moves along the second axis line Y to a position at which the flat surface 622*b* of the first burring die 622 and the flat surface 623*b* of the first piercing die 623 come into surface contact with the inner wall surface 211*b* of the first wall portion 211 and the flat surface 624*b* of the second burring holder 624 and the flat surface 625*a* of the second piercing punch 625 come into surface contact with the inner wall surface 212*b* of the second wall portion 212.

By further moving the stopper 627 from the position by a predetermined distance, the pressing force is applied to the first burring die 622 and the second piercing die 623 in the direction toward the first wall portion 211, and the pressing force is applied to the second burring holder 624 and the second burring punch 626 (second piercing punch 625) in the direction toward the second wall portion 212.

As a result, the first burring die 622 and the second piercing die 623 come into pressure contact with the inner wall surface 211*b* of the first wall portion 211, and the second burring holder 624 and the second piercing punch 625 come into pressure contact with the inner wall surface 212*b* of the second wall portion 212.

In this way, by inserting the stopper 627 into a portion between the first burring die 622 and the second burring holder 624 (a portion between the first piercing die 623 and the second burring punch 626), the first burring die 622 and the second piercing die 623 come into pressure contact with the inner wall surface 211*b* of the first wall portion 211, and the second burring holder 624 and the second piercing punch 625 come into pressure contact with the inner wall surface 212*b* of the second wall portion 212.

At this time, since the spring 628 inside the housing 621 is compressed according to the movement of the first burring die 622, the external force toward the reference point P is always applied to first burring die 622.

As shown in FIG. 27, at the time when the above-described first process ends, the first burring holder 611 and the first burring die 622 are disposed so as to face each other in a state where the first wall portion 211 is interposed therebetween. Moreover, the second burring holder 624 and the second burring die 631 are disposed so as to face each other in a state where the second wall portion 212 is interposed therebetween.

<Second Process>

Figure 28:
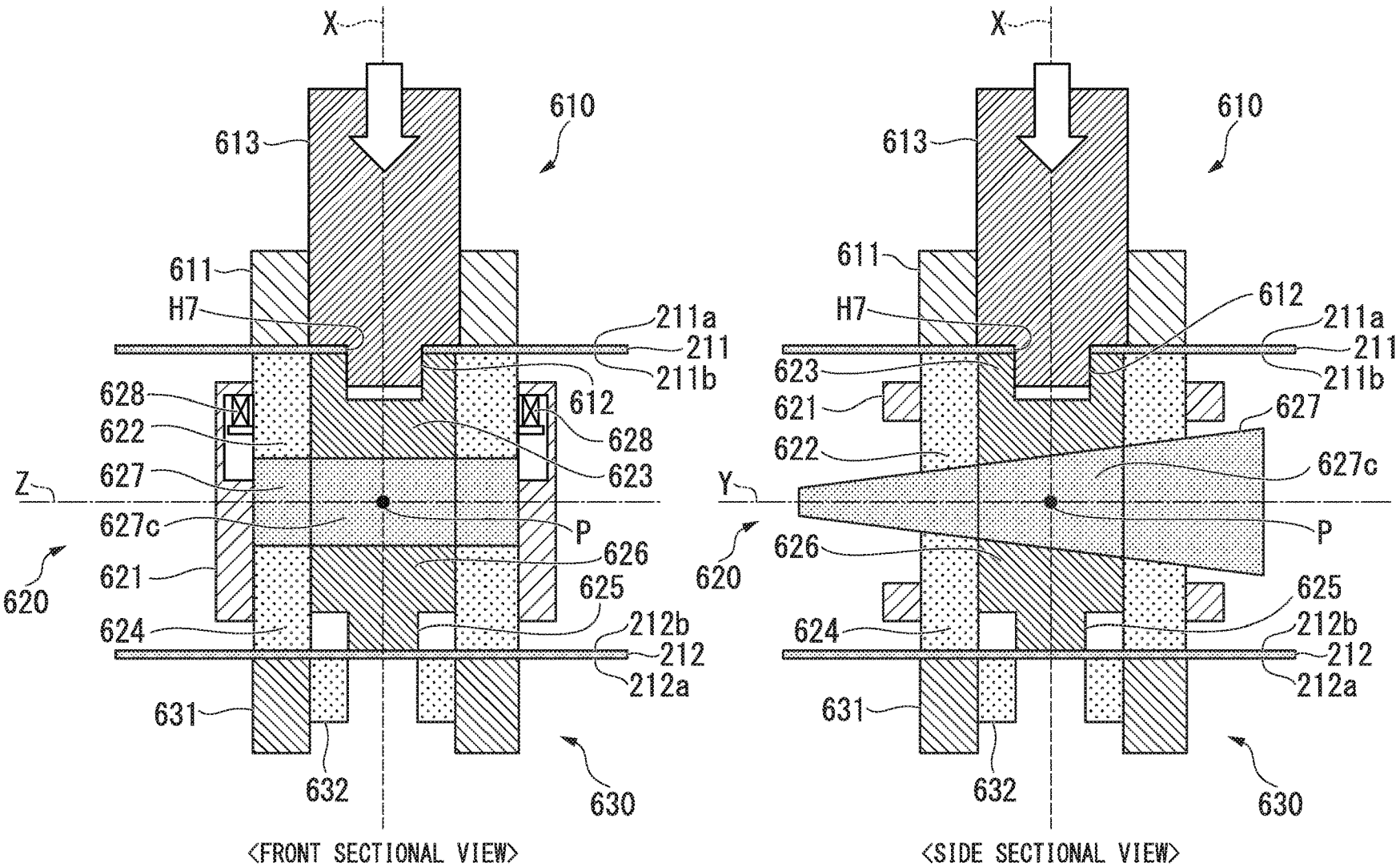
FIG. 28 is a first explanatory view with respect to a second process of the burring method according to the fourth embodiment of the present invention.

Subsequently, as shown in FIG. 28, by moving the first piercing punch 612 and the first burring punch 613 from the outside of the first wall portion 211 to the inside thereof along the first axis line X using an actuator (not shown) such that the first piercing punch 612 is inserted into the first piercing hole 623*a* of the first piercing die 623, one of the prepared holes is formed on the first wall portion 211.

Accordingly, a prepared hole H7, which has the first axis line X as the center axis line and has the same diameter as the outer diameter of the first piercing punch 612, is formed on the first wall portion 211.

Figure 29:
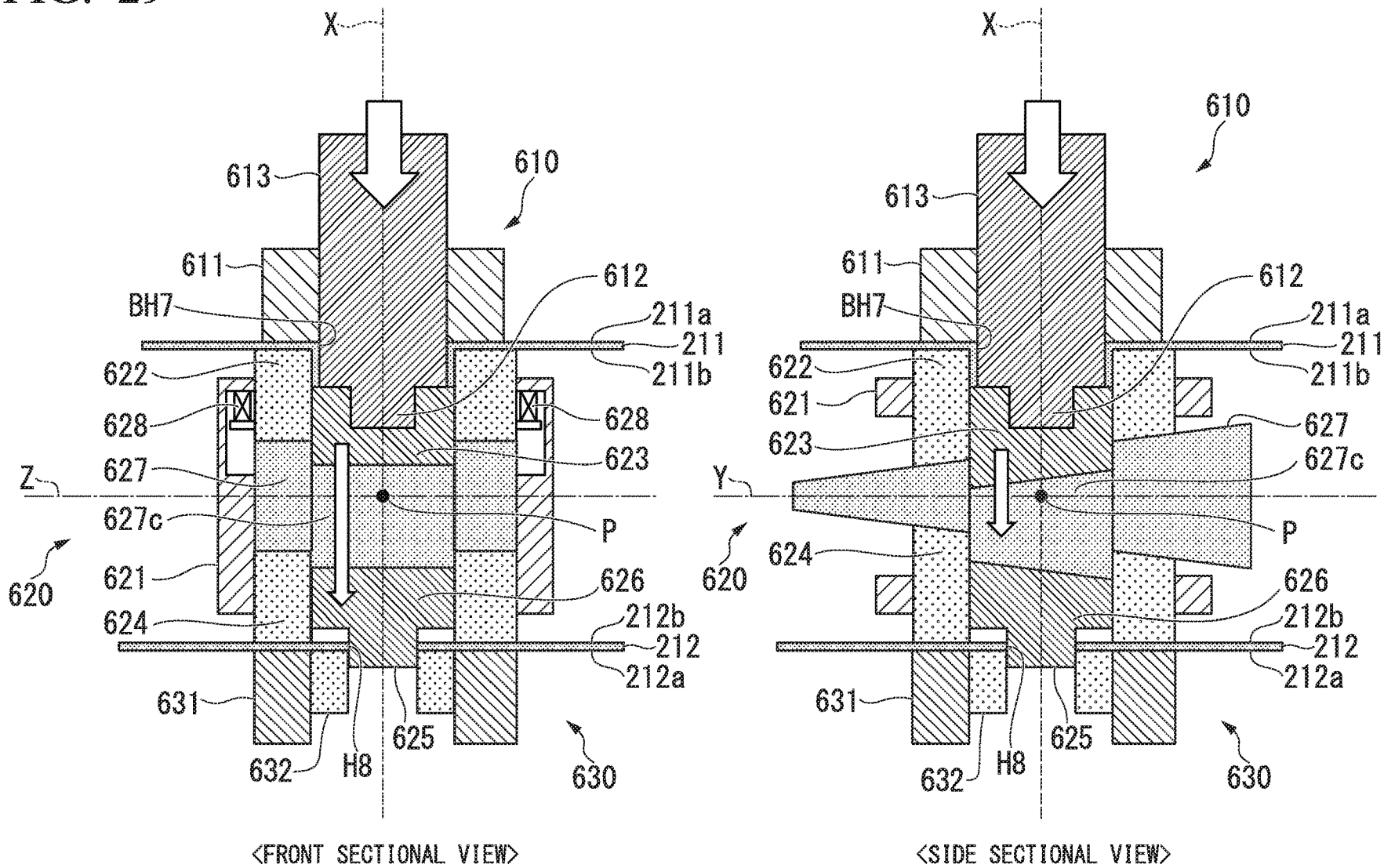
FIG. 29 is a second explanatory view with respect to the second process of the burring method according to the fourth embodiment of the present invention.

Subsequently, as shown in FIG. 29, by moving the first burring punch 613 from the outside of the first wall portion 211 to the inside thereof along the first axis line X such that the first burring punch 613 is inserted into the first forming hole 622*a* of the first burring die 622, the peripheral edge portion of the prepared hole H7 of the first wall portion 211 is bent to the inside of the first wall portion 211 to form one of the burring holes.

Accordingly, a burring hole BH7 which has the first axis line X as the center axis line and has the rising wall portion extending toward the inside of the first wall portion 211 is formed on the first wall portion 211. The inner diameter of the burring hole BH7 is the same as the outer diameter of the first burring punch 613. The height of the rising wall portion formed on the peripheral edge portion of the burring hole BH7 is determined by the difference between the outer diameter of the first piercing punch 612 and the outer diameter of the first burring punch 613.

As shown in FIG. 29, the burring hole BH7 is formed on the first wall portion 211, and the other prepared hole is formed on the second wall portion 212.

That is, in the process in which the burring hole BH7 is formed, since the first burring punch 613 moves toward the second wall portion 212 in the state where the front end of the first piercing punch 612 comes into contact with the bottom portion of the first piercing hole 623*a*, the first piercing die 623, the separable separation block 627*c* provided on the stopper 627, and the second burring punch 626 to which the second piercing punch 625 is attached simultaneously move toward the second wall portion 212 along the first axis line X.

As a result, since the second piercing punch 625 moves from the inside of the second wall portion 212 to the outside thereof along the first axis line X so as to be inserted into the second piercing hole 632*a* of the second piercing die 632, the other of prepared hole is formed on the second wall portion 212. In this way, simultaneously with the formation of the burring hole BH7, a prepared hole H8 which has the first axis line X as the center axis line and has the same diameter as the outer diameter of the second piercing punch 625 is formed on the second wall portion 212.

Figure 30:
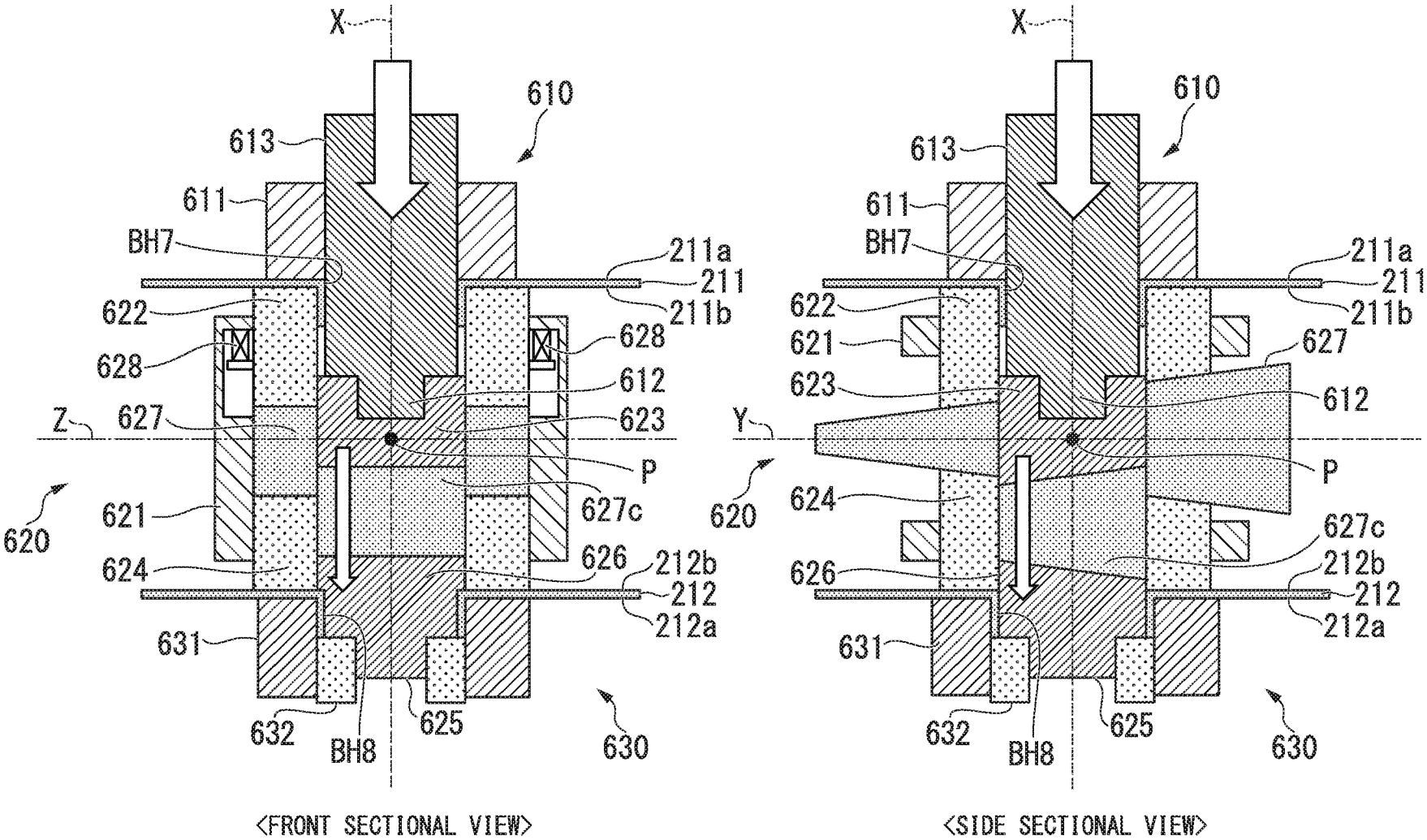
FIG. 30 is a third explanatory view with respect to the second process of the burring method according to the fourth embodiment of the present invention.

Subsequently, as shown in FIG. 30, in the state where the front end of the first piercing punch 612 comes into contact with the bottom portion of the first piercing hole 623*a*, the first burring punch 613 further moves toward the second wall portion 212 along the first axis line X. Accordingly, the first piercing die 623, the separation block 627*c*, and the second burring punch 626 further move toward the second wall portion 212 along the first axis line X simultaneously.

As a result, since the second burring punch 626 moves from the inside of the second wall portion 212 to the outside thereof along the first axis line X so as to be inserted into the second forming hole 631*a* of the second burring die 631, the peripheral edge portion of the prepared hole H8 of the second wall portion 212 is bent to the outside of the second wall portion 212, and the other burring hole is formed.

Accordingly, a burring hole BH8 which has the first axis line X as the center axis line and has the rising wall portion extending toward the outside of the second wall portion 212 is formed on the second wall portion 212. The inner diameter of the burring hole BH8 is the same as the outer diameter of the second burring punch 626. The height of the rising wall portion formed on the peripheral edge portion of the burring hole BH8 is determined by the difference between the outer diameter of the second piercing punch 625 and the outer diameter of the second burring punch 626.

Figure 31:
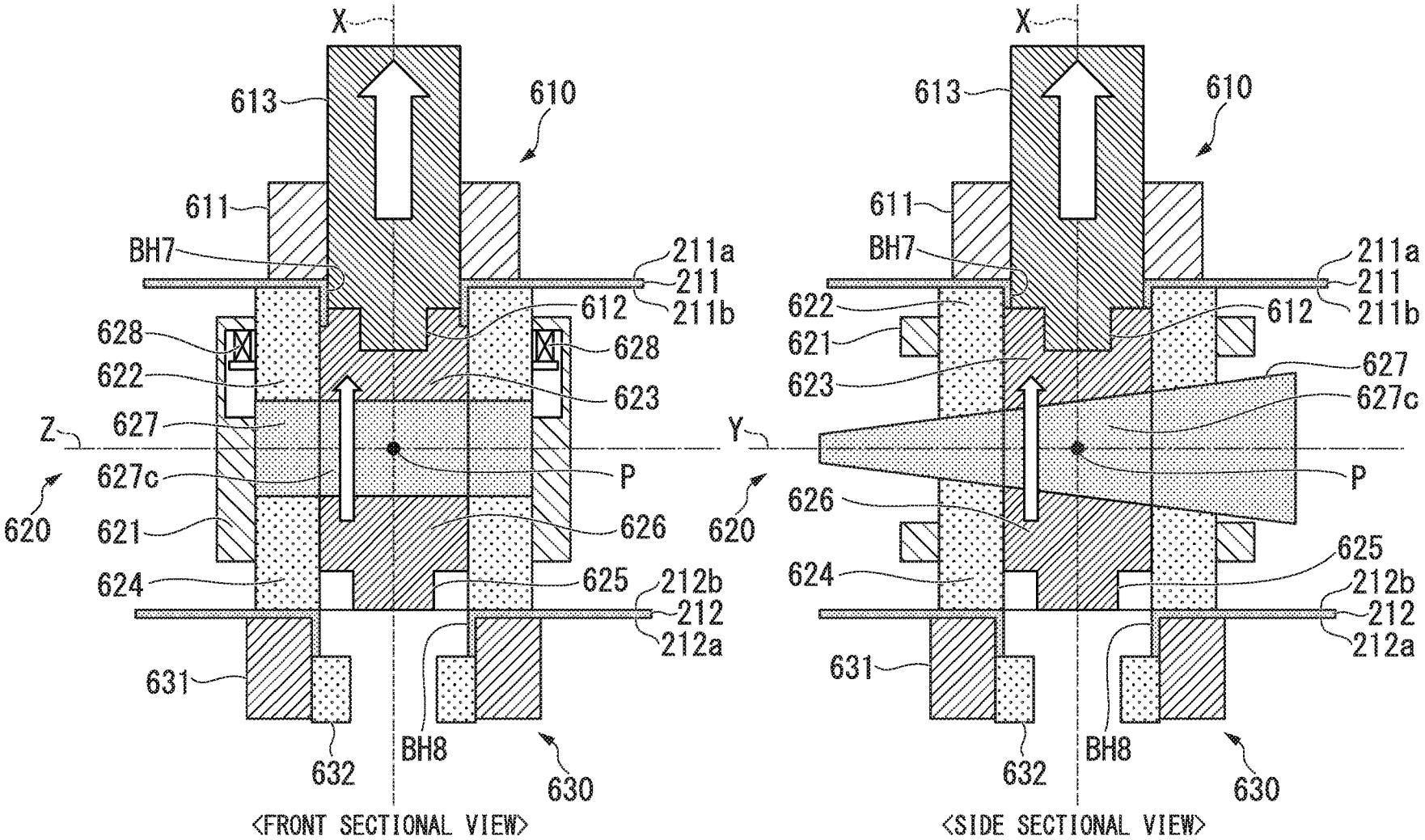
FIG. 31 is a fourth explanatory view with respect to the second process of the burring method according to the fourth embodiment of the present invention.

Subsequently, as shown in FIG. 31, by moving the first piercing die 623, the separation block 627*c*, and the second burring punch 626 to the inside of the second wall portion 212, the separation block 627*c* is returned into the stopper 627. Here, for example, it is possible to move the first piercing die 623, the separation block 627*c*, and the second burring punch 626 to the inside of the second wall portion 212 by pressing the front end of the second piercing punch 625 toward the first wall portion 211 using a rod-shaped member (not shown).

Figure 32:
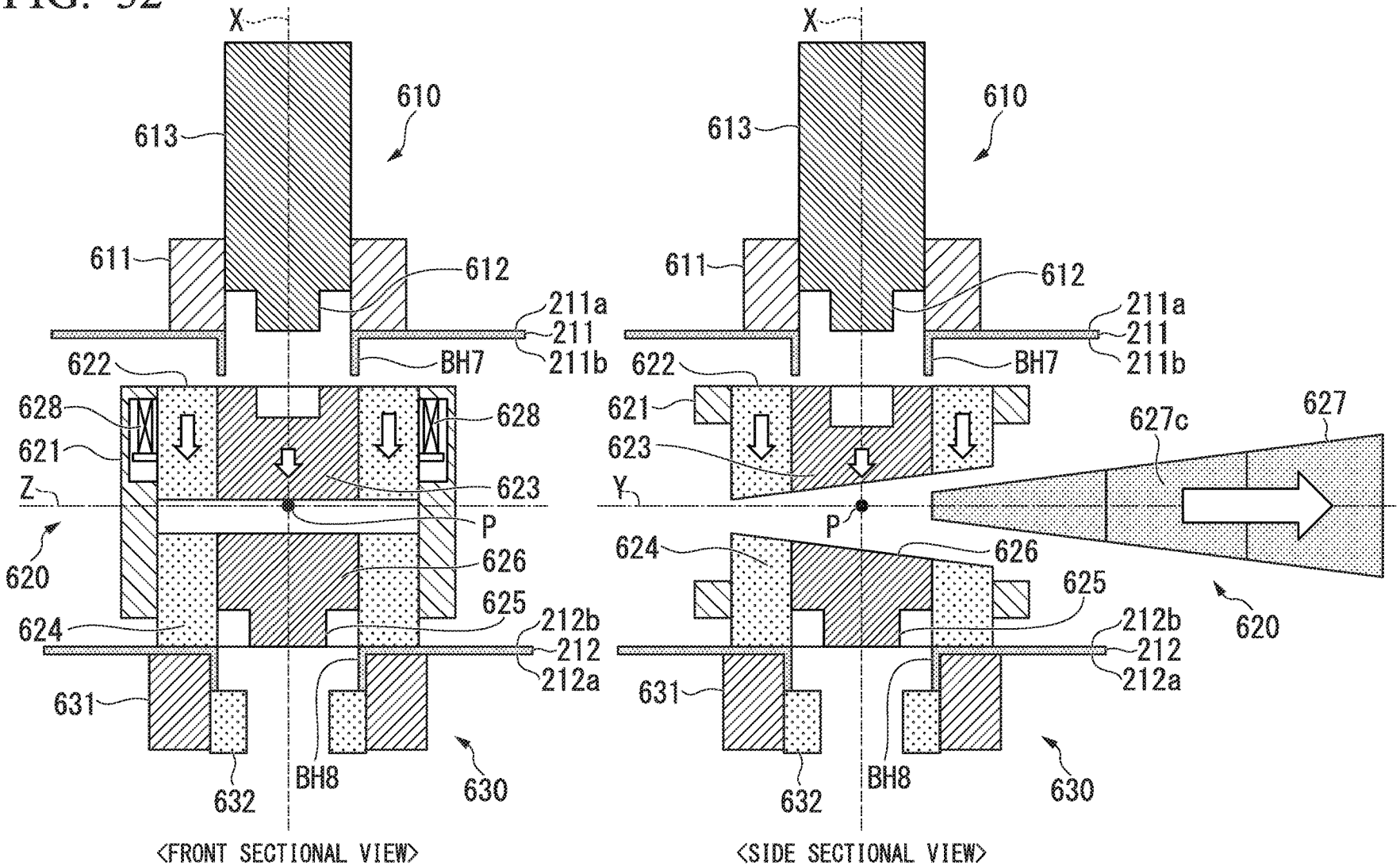
FIG. 32 is a fifth explanatory view with respect to the second process of the burring method according to the fourth embodiment of the present invention.

In addition, as shown in FIG. 32, after the separation block 627*c* is returned into the stopper 627, the stopper 627 is removed from the portion between the first burring die 622 and the second burring holder 624 (the portion between the first piercing die 623 and the second burring punch 626). Accordingly, each of the first burring die 622 and the first piercing die 623 are movable toward the reference point P.

As described above, since the external force toward the reference point P is applied to the first burring die 622 by the compression of the spring 628, if the stopper 627 is removed from the portion between the first burring die 622 and the second burring holder 624, the first burring die 622 moves toward the reference point P.

That is, if the stopper 627 is removed from the portion between the first burring die 622 and the second burring holder 624, the first burring die 622 is returned to a position close to the center between the first wall portion 211 and the second wall portion 212 by the external forces which are applied to the first burring die 622 in the direction toward the second wall portion 212.

Meanwhile, by applying the external force to the first piercing die 623 in the direction toward the second wall portion 212 according to the movement of the first burring punch 613 toward the second wall portion 212, it is possible to return the first piercing die 623 to the position close to the center between the first wall portion 211 and the second wall portion 212.

As described above, at the time when the second process ends, the burring holes BH7 and BH8 having the first axis lines X as the center axis lines are formed, and the first burring die 622 and the first piercing die 623 are returned to the position close to the center between the first wall portion 211 and the second wall portion 212. That is, the entirety of the first burring die 622 and the first piercing die 623 is accommodated inside the housing 621.

<Third Process>

Figure 33:
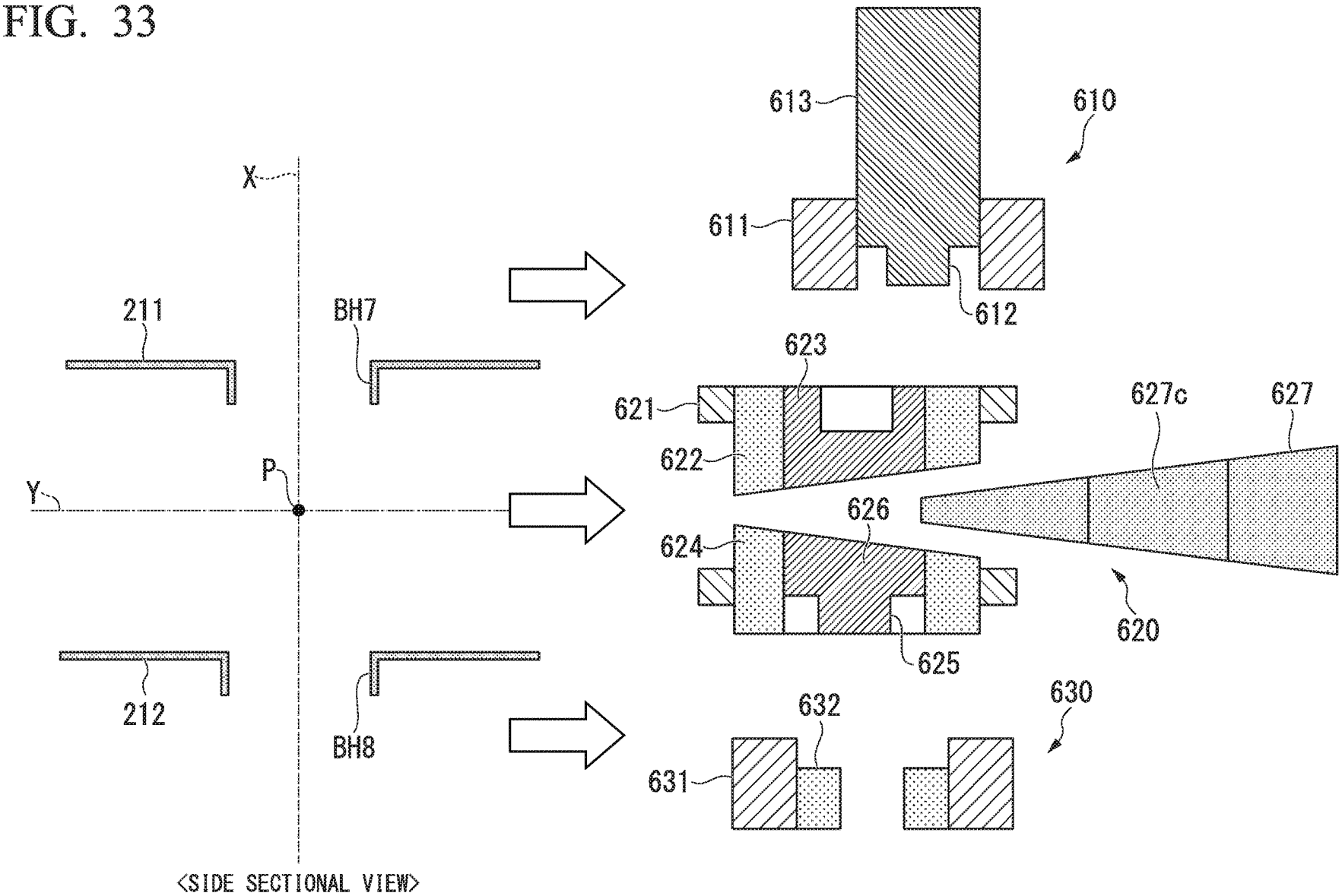
FIG. 33 is an explanatory view with respect to a third process of the burring method according to the fourth embodiment of the present invention.

Finally, as shown in FIG. 33, the first external unit 610 is detached from the first wall portion 211, the internal unit 620 is detached from the portion between the first wall portion 211 and the second wall portion 212, the second external unit 630 is detached from the second wall portion 212, and the burring ends.

Even when the burring hole BH7 has the rising wall portion extending to the inside to the first wall portion 211, since the entirety of the first burring die 622 and the first piercing die 623 is completely accommodated inside the housing 621, it is possible to easily detach the internal unit 620 (housing 621) from the portion between the first wall portion 211 and the second wall portion 212.

As described above, in the fourth embodiment, after the prepared hole H7 is formed on the first wall portion 211 using the first piercing punch 612, the peripheral edge portion of the prepared hole H7 of the first wall portion 211 is bent to the inside of the first wall portion 211 using the first burring punch 613 having the first axis line X as the center axis line along with the first piercing punch 612 to form the burring hole BH7.

In addition, in the fourth embodiment, after the prepared hole H8 is formed on the second wall portion 212 using the second piercing punch 625, the peripheral edge portion of the prepared hole H8 of the second wall portion 212 is bent to the outside of the second wall portion 212 using the second burring punch 626 having the first axis line X as the center axis line along with the second piercing punch 625 to form the burring hole BH8.

Accordingly, it is possible to significantly decrease misalignment occurring between the center axis lines of the prepared holes H7 and H8 and the center axis lines of the burring holes BH7 and BH8, and it is possible to very accurately form the burring holes BH7 and BH8 having the same axis line (first axis line X) as the center axis lines.

In addition, according to the fourth embodiment, since it is possible to continuously form the prepared hole H7 of the first wall portion 211, the burring hole BH7 of the first wall portion 211, the prepared hole H8 of the second wall portion 212, and the burring hole BH8 of the second wall portion 212 by simply moving the first burring punch 613 from the outside of the first wall portion 211 toward the second wall portion 212, the fourth embodiment is remarkably effective.

Therefore, according to the fourth embodiment, it is possible to accurately and effectively form the burring holes BH7 and BH8 having the same axis line (first axis line X) as the center axis lines with respect to the first wall portion 211 and the second wall portion 212 facing each other.

Hereinbefore, the first to fourth embodiments of the present invention are described. However, the present invention is not limited to the embodiments, and the embodiments are appropriately modified within a scope which does not depart from the gist of the present invention.

In addition, in the first to fourth embodiments, the case is exemplified in which the burring holes having the same axis line (first axis line X) as the center axis lines are formed with respect to the pair of bush holding wall portions 21 (first wall portion 211 and the second wall portion 212) provided on the lateral link 1. However, the present invention is not limited to the lateral link 1, and the present invention may be applied to any workpiece as long as it has a pair of first wall portion and second wall portion facing each other.

INDUSTRIAL APPLICABILITY

According to the present invention, it is possible to accurately and effectively form burring holes having the same axis line (first axis line X) as the center axis lines with respect to a first wall portion and a second wall portion facing each other. Therefore, the present invention has sufficient industrial applicability.

BRIEF DESCRIPTION OF THE REFERENCE SYMBOLS

1: lateral link
211: first wall portion
212: second wall portion
300: burring apparatus
310: first external unit
311: first piercing punch
312: first burring punch
313: first burring holder

320: second external unit
321: first piercing punch
322: first burring punch
323: first burring holder
330: internal unit
331: housing
332: first burring die
333: first piercing die
334: second burring die
335: second piercing die
336: first stopper
337: second stopper
400: burring apparatus
410: first external unit
411: first burring die
412: first piercing holder
413: first piercing punch
420: second external unit
421: second burring die
422: second piercing holder
423: second piercing punch
430: internal unit
431: housing
432: first burring punch
433: second burring punch
434: stopper
500: burring apparatus
510: first external unit
511: first burring die
512: first piercing holder
513: first piercing punch
520: second external unit
521: second burring die
522: second piercing holder
523: second piercing punch
530: internal unit
531: housing
532: first burring punch
533: second burring punch
534: stopper
534*c*: separation block
600: burring apparatus
610: first external unit
611: first burring holder
612: first piercing punch
613: first burring punch
620: internal unit
621: housing
622: first burring die
623: first piercing die
624: second burring holder
625: second piercing punch
626: second burring punch
627: stopper
627*c*: separation block
X: first axis line
Y: second axis line
Z: third axis line
H1 to H8: prepared hole
BH1 to BH8: burring hole

What is claimed is:

1. A burring method for forming burring holes sharing a first axis line as center axis lines of the burring holes with respect to a first wall portion and a second wall portion facing each other, the burring method comprising:

a first process of disposing an internal unit of a burring apparatus between the first wall portion and the second wall portion, disposing a first external unit of the burring apparatus outside the first wall portion, and disposing a second external unit of the burring apparatus outside the second wall portion;

a second process of, first, forming prepared holes sharing the first axis line as the center axis lines of the burring holes with respect to the first wall portion and the second wall portion using a piercing punch, and thereafter, forming burring holes sharing the first axis line as the center axis lines of the burring holes with respect to the first wall portion and the second wall portion using a burring punch; and a third process of detaching the internal unit, the first external unit, and the second external unit from the first wall portion and the second wall portion, the piercing punch and the burring punch being shaft members sharing the first axis line as the center axis lines of the shaft members provided in at least one of the internal unit, the first external unit, and the second external unit, and are provided so as to be movable along the first axis line, wherein in the second process, after one of the prepared holes is formed on the first wall portion using a first piercing punch provided in the first external unit, one of the burring holes is formed by bending a peripheral edge portion of the prepared hole of the first wall portion to the inside of the first wall portion using a first burring punch which is provided in the first external unit and has the first axis line as the center axis line along with the first piercing punch; and after the other prepared hole is formed on the second wall portion using a second piercing punch provided in the second external unit, the other burring hole is formed by bending a peripheral edge portion of the prepared hole of the second wall portion to the inside of the second wall portion using a second burring punch which is provided in the second external unit and has the first axis line as the center axis line along with the second piercing punch, wherein in the first process, among a first burring holder which is provided in the first external unit and has a first through hole serving as a passage of the first burring punch, the first burring punch which is disposed inside the first through hole, and the first piercing punch which is disposed inside the first burring punch, the first burring holder and the first burring punch come into pressure contact with an outer wall surface of the first wall portion in a state where center axis lines of the first through hole, the first piercing punch, and the first burring punch coincide with the first axis line;

among a second burring holder which is provided in the second external unit and has a second through hole serving as a passage of the second burring punch, the second burring punch which is disposed inside the second through hole, and the second piercing punch which is disposed inside the second burring punch, the second burring holder and the second burring punch come into pressure contact with an outer wall surface of the second wall portion in a state where center axis lines of the second through hole, the second piercing punch, and the second burring punch coincide with the first axis line;

a first burring die which is provided in the internal unit and has a first forming hole, and a first piercing die which is provided inside the first forming hole and has a first piercing hole come into pressure contact with an inner wall surface of the first wall portion in a state where center axis lines of the first forming hole and the first piercing hole coincide with the first axis line; and a second burring die which is provided in the internal unit and has a second forming hole, and a second piercing die which is provided inside the second forming hole and has a second piercing hole come into pressure contact with an inner wall surface of the second wall portion in a state where center axis lines of the second forming hole and the second piercing hole coincide with the first axis line, and wherein in the second process, one of the prepared holes is formed on the first wall portion by moving the first piercing punch from the outside of the first wall portion to the inside thereof along the first axis line such that the first piercing punch is inserted into the first piercing hole;

the other prepared hole is formed on the second wall portion by moving the second piercing punch from the outside of the second wall portion to the inside thereof along the first axis line such that the second piercing punch is inserted into the second piercing hole;

the peripheral edge portion of the prepared hole of the first wall portion is bent to the inside of the first wall portion to form one of the burring holes by moving the first burring punch from the outside of the first wall portion to the inside thereof along the first axis line such that the first burring punch is inserted into the first forming hole, and the first piercing die is returned to a position close to a center between the first wall portion and the second wall portion;

the peripheral edge portion of the prepared hole of the second wall portion is bent to the inside of the second wall portion to form the other burring hole by moving the second burring punch from the outside of the second wall portion to the inside thereof along the first axis line such that the second burring punch is inserted into the second forming hole, and the second piercing die is returned to a position close to the center between the first wall portion and the second wall portion; and the first burring die and the second burring die are returned to the position close to the center between the first wall portion and the second wall portion after both of the burring holes are formed.

2. The burring method according to claim 1, wherein in the first process, the first burring die comes into pressure contact with the inner wall surface of the first wall portion and the second burring die comes into pressure contact with the inner wall surface of the second wall portion by inserting a first stopper into a portion between the first burring die and the second burring die in the internal unit; and the first piercing die comes into pressure contact with the inner wall surface of the first wall portion and the second piercing die comes into pressure contact with the inner wall surface of the second wall portion by inserting a second stopper into a portion between the first piercing die and the second piercing die, and wherein in the second process, after the second stopper is removed from the portion between the first piercing die and the second piercing die, one of the burring holes is formed on the first wall portion by inserting the first burring punch into the first forming hole, and the other burring hole is formed on the second wall portion by inserting the second burring punch into the second forming hole; and after both of the burring holes are formed, the first stopper is removed from the portion between the first burring die and the second burring die, and the first burring die and the second burring die are returned to the position close to the center between the first wall portion and the second wall portion by applying an external force to the first burring die and the second burring die in a direction approaching each other.

3. A burring method for forming burring holes sharing a first axis line as center axis lines of the burring holes with respect to a first wall portion and a second wall portion facing each other, the burring method comprising:

a first process of disposing an internal unit of a burring apparatus between the first wall portion and the second wall portion, disposing a first external unit of the burring apparatus outside the first wall portion, and disposing a second external unit of the burring apparatus outside the second wall portion;

a second process of, first, forming prepared holes sharing the first axis line as the center axis lines of the burring holes with respect to the first wall portion and the second wall portion using a piercing punch, and thereafter, forming burring holes sharing the first axis line as the center axis lines of the burring holes with respect to the first wall portion and the second wall portion using a burring punch; and a third process of detaching the internal unit, the first external unit, and the second external unit from the first wall portion and the second wall portion, the piercing punch and the burring punch being shaft members sharing the first axis line as the center axis lines of the shaft members provided in at least one of the internal unit, the first external unit, and the second external unit, and are provided so as to be movable along the first axis line, wherein in the second process, after one of the prepared holes is formed on the first wall portion using a first piercing punch provided in the first external unit, one of the burring holes is formed by bending a peripheral edge portion of the prepared hole of the first wall portion to the outside of the first wall portion using a first burring punch which is provided in the internal unit and has the first axis line as the center axis line along with the first piercing punch; and after the other prepared hole is formed on the second wall portion using a second piercing punch provided in the second external unit, the other burring hole is formed by bending a peripheral edge portion of the prepared hole of the second wall portion to the outside of the second wall portion using a second burring punch which is provided in the internal unit and has the first axis line as the center axis line along with the second piercing punch, wherein in the first process, among a first burring die which is provided in the first external unit and has a first forming hole, a first piercing holder which is provided inside the first forming hole and has a first through hole serving as a passage of the first piercing punch, and the first piercing punch which is provided inside the first through hole, the first burring die and the first piercing holder come into pressure contact with an outer wall surface of the first wall portion in a state where center axis lines of the first forming hole, the first through hole, and the first piercing punch coincide with the first axis line;

among a second burring die which is provided in the second external unit and has a second forming hole, a second piercing holder which is provided inside the second forming hole and has a second through hole serving as a passage of the second piercing punch, and the second piercing punch which is provided inside the second through hole, the second burring die and the second piercing holder come into pressure contact with an outer wall surface of the second wall portion in a state where center axis lines of the second forming hole, the second through hole, and the second piercing punch coincide with the first axis line; and after a tubular housing which is provided in the internal unit, includes the first burring punch and the second burring punch, and has both opened ends is disposed between the first wall portion and the second wall portion in a state where center axis lines of the first burring punch, the second burring punch, and the housing coincide with the first axis line, the first burring punch comes into pressure contact with an inner wall surface of the first wall portion, and the second burring punch comes into pressure contact with an inner wall surface of the second wall portion, and wherein in the second process, one of the prepared holes is formed on the first wall portion by moving the first piercing punch from the outside of the first wall portion to the inside thereof along the first axis line such that the first piercing punch is inserted into the first piercing hole provided in the first burring punch;

the other prepared hole is formed on the second wall portion by moving the second piercing punch from the outside of the second wall portion to the inside thereof along the first axis line such that the second piercing punch is inserted into the second piercing hole provided in the first burring punch;

the peripheral edge portion of the prepared hole of the first wall portion is bent to the outside of the first wall portion to form one of the burring holes by moving the first burring punch from the inside of the first wall portion to the outside thereof along the first axis line such that the first burring punch is inserted into the first forming hole;

the peripheral edge portion of the prepared hole of the second wall portion is bent to the outside of the second wall portion to form the other burring hole by moving the second burring punch from the inside of the second wall portion to the outside thereof along the first axis line such that the second burring punch is inserted into the second forming hole; and the first burring punch and the second burring punch are returned to the position close to the center between the first wall portion and the second wall portion after both of the burring holes are formed.

4. The burring method according to claim 3, wherein in the first process, the first burring punch comes into pressure contact with the inner wall surface of the first wall portion and the second burring punch comes into pressure contact with the inner wall surface of the second wall portion by inserting a stopper into a portion between the first burring punch and the second burring punch in the internal unit, and wherein in the second process, the first burring punch moves from the inside of the first wall portion to the outside thereof along the first axis line to form one of the burring holes on the first wall portion and the second burring punch moves from the inside of the second wall portion to the outside thereof along the first axis line to form the other burring hole on the second wall portion by inserting the stopper deeper into the portion between the first burring punch and the second burring punch; and after both of the burring holes are formed, the stopper is removed from the portion between the first burring punch and the second burring punch, and the first burring die and the second burring die are returned to the position close to the center between the first wall portion and the second wall portion by applying an external force to the first burring die and the second burring die in a direction approaching each other.

5. The burring method according to claim 3, wherein in the first process, the first burring punch comes into pressure contact with the inner wall surface of the first wall portion and the second burring punch comes into pressure contact with the inner wall surface of the second wall portion by inserting a stopper into a portion between the first burring punch and the second burring punch in the internal unit, and wherein in the second process, after the prepared hole is formed on each of the first wall portion and the second wall portion using the first piercing punch and the second piercing punch;

by moving the second piercing punch toward the first wall portion along the first axis line in a state where a front end of the second piercing punch comes into contact with a bottom portion of the second piercing hole of the second burring punch, the second burring punch, a separable separation block provided in the stopper, and the first burring punch simultaneously move toward the outside of the first wall portion along the first axis line to form one of the burring holes on the first wall portion;

by moving the first piercing punch toward the second wall portion along the first axis line in a state where a front end of the first piercing punch comes into contact with a bottom portion of the first piercing hole of the first burring punch, the first burring punch, the separation block provided in the stopper, and the second burring punch simultaneously move toward the outside of the second wall portion along the first axis line to form the other burring hole on the second wall portion; and by moving the second piercing punch toward the first wall portion along the first axis line in a state where the front end of the second piercing punch comes into contact with the bottom portion of the second piercing hole of the second burring punch, the separation block is returned into the stopper.

6. A burring method for forming burring holes sharing a first axis line as center axis lines of the burring holes with respect to a first wall portion and a second wall portion facing each other, the burring method comprising:

a first process of disposing an internal unit of a burring apparatus between the first wall portion and the second wall portion, disposing a first external unit of the burring apparatus outside the first wall portion, and disposing a second external unit of the burring apparatus outside the second wall portion;

a second process of, first, forming prepared holes sharing the first axis line as the center axis lines of the burring holes with respect to the first wall portion and the second wall portion using a piercing punch, and thereafter, forming burring holes sharing the first axis line as the center axis lines of the burring holes with respect to the first wall portion and the second wall portion using a burring punch; and a third process of detaching the internal unit, the first external unit, and the second external unit from the first wall portion and the second wall portion, the piercing punch and the burring punch being shaft members sharing the first axis line as the center axis lines of the shaft members provided in at least one of the internal unit, the first external unit, and the second external unit, and are provided so as to be movable along the first axis line, wherein in the second process, after one of the prepared holes is formed on the first wall portion using a first piercing punch provided in the first external unit, one of the burring holes is formed by bending a peripheral edge portion of the prepared hole of the first wall portion to the inside of the first wall portion using a first burring punch which is provided in the first external unit and has the first axis line as the center axis line along with the first piercing punch; and after the other prepared hole is formed on the second wall portion using a second piercing punch provided in the internal unit, the other burring hole is formed by bending a peripheral edge portion of the prepared hole of the second wall portion to the outside of the second wall portion using a second burring punch which is provided in the internal unit and has the first axis line as the center axis line along with the second piercing punch, wherein in the first process, among a first burring holder which is provided in the first external unit and has a first through hole serving as a passage of the first burring punch, the first burring punch which is disposed inside the first through hole, and the first piercing punch which is attached to a front end of the first burring punch, the first burring holder comes into pressure contact with an outer wall surface of the first wall portion in a state where center axis lines of the first through hole, the first burring punch, and the first piercing punch coincide with the first axis line;

a first burring die which is provided in the internal unit and has a first forming hole, and a first piercing die which is provided inside the first forming hole and has a first piercing hole come into pressure contact with an inner wall surface of the first wall portion in a state where center axis lines of the first forming hole and the first piercing hole coincide with the first axis line;

among a second burring holder which is provided in the internal unit and has a second through hole serving as a passage of the second burring punch, the second burring punch which is disposed inside the second through hole, and the second piercing punch which is attached to a front end of the second burring punch, the second burring holder comes into pressure contact with an inner wall surface of the second wall portion in a state where center axis lines of the second through hole, the second burring punch, and the second piercing punch coincide with the first axis line; and a second burring die which is provided in the second external unit and has a second forming hole, and a second piercing die which is provided inside the second forming hole and has a second piercing hole come into pressure contact with an outer wall surface of the second wall portion in a state where center axis lines of the second forming hole and the second piercing hole coincide with the first axis line, and wherein in the second process, one of the prepared holes is formed on the first wall portion by moving the first burring punch and the first piercing punch from the outside of the first wall portion to the inside thereof along the first axis line such that the first piercing punch is inserted into the first piercing hole;

by moving the first burring punch from the outside of the first wall portion to the inside thereof along the first axis line such that the first burring punch is inserted into the first forming hole after the prepared hole is formed on the first wall portion, the peripheral edge portion of the prepared hole of the first wall portion is bent to the inside of the first wall portion to form one of the burring holes;

by moving the first burring punch toward the second wall portion in a state where the front end of the first piercing punch comes into contact with the bottom portion of the first piercing hole, the second burring punch and the second piercing punch move from the inside of the second wall portion to the outside thereof along the first axis line to form the other prepared hole on the second wall portion such that the second piercing punch is inserted into the second piercing hole;

by further moving the first burring punch toward the second wall portion after the prepared hole is formed on the second wall portion, the second burring punch moves from the inside of the second wall portion to the outside thereof along the first axis line such that the second burring punch is inserted into the second forming hole, and a peripheral edge of the prepared hole of the second wall portion is bent to the outside of the second wall portion to form the other burring hole; and by moving the second burring punch to the inside of the second wall portion after the burring hole is formed on the second wall portion, the first burring die and the first piercing die are returned to a position close to the center between the first wall portion and the second wall portion.

7. The burring method according to claim 6, wherein in the first process, by inserting a stopper into a portion between the first burring die and the second burring holder in the internal unit, the first burring die and the first piercing die disposed inside the first burring die come into pressure contact with the inner wall surface of the first wall portion, and the second burring holder and the second piercing punch disposed inside the second burring holder come into pressure contact with the inner wall surface of the second wall portion, and wherein in the second process, after the prepared hole is formed on the first wall portion, by moving the first burring punch toward the second wall portion along the first axis line in a state where a front end of the first piercing punch comes into contact with a bottom portion of the first piercing hole of the first piercing die, the first piercing die, a separable separation block provided in the stopper, and the second burring punch to which the second piercing punch is attached simultaneously move toward the second wall portion along the first axis line, and after the burring hole of the first wall portion and the prepared hole of the second wall portion are simultaneously formed, finally, the burring hole of the second wall portion is formed;

after the separation block is returned into the stopper by moving the first piercing die, the separation block, and the second burring punch to the inside of the second wall portion, the stopper is removed from the portion between the first burring die and the second burring holder; and the first burring die is returned to the position close to the center between the first wall portion and the second wall portion by applying an external force to the first burring die in a direction toward the second wall portion.

8. A burring apparatus for forming burring holes sharing a first axis line as center axis lines of the burring holes with respect to a first wall portion and a second wall portion facing each other, the burring apparatus comprising:

an internal unit which is disposed between the first wall portion and the second wall portion;

a first external unit which is disposed outside the first wall portion; and a second external unit which is disposed outside the second wall portion, wherein at least one of the internal unit, the first external unit, and the second external unit includes a piercing punch and a burring punch which are shaft members sharing the first axis line as the center axis lines and are provided so as to be movable along the first axis line, and wherein the burring punch operates separately from the piercing punch or the piercing punch is attached to a front end of the burring punch, wherein the first external unit includes:

a first piercing punch which forms a prepared hole on the first wall portion; and a first burring punch which has the first axis line as the center axis line along with the first piercing punch, and bends a peripheral edge portion of the prepared hole of the first wall portion to the inside of the first wall portion to form the burring hole, and wherein the second external unit includes:

a second piercing punch which forms a prepared hole on the second wall portion; and a second burring punch which has the first axis line as the center axis line along with the second piercing punch, and bends a peripheral edge portion of the prepared hole of the second wall portion to the inside of the second wall portion to form the burring hole, wherein the first external unit further includes a first burring holder which has a first through hole serving as a passage of the first burring punch and is provided so as to be movable outside the first wall portion in a state where a center axis line of the first through hole coincides with the first axis line, wherein the first burring punch is provided so as to be movable between the outside and the inside of the first wall portion along the first axis line in a state where a center axis line of the first burring punch coincides with the first axis line inside the first through hole of the first burring holder, wherein the first piercing punch is provided so as to be movable between the outside and the inside of the first wall portion along the first axis line in a state where a center axis line of the first piercing punch coincides with the first axis line inside the first burring punch, wherein the second external unit further includes a second burring holder which has a second through hole serving as a passage of the second burring punch and is provided so as to be movable outside the second wall portion in a state where a center axis line of the second through hole coincides with the first axis line, wherein the second burring punch is provided so as to be movable between the outside and the inside of the second wall portion along the first axis line in a state where a center axis line of the second burring punch coincides with the first axis line inside the second through hole of the second burring holder, wherein the second piercing punch is provided so as to be movable between the outside and the inside of the second wall portion along the first axis line in a state where a center axis line of the second piercing punch coincides with the first axis line inside the second burring punch, and wherein the internal unit includes:

a first burring die which has a first forming hole into which the first burring punch is inserted, and is provided so as to be movable inside the first wall portion along the first axis line in a state where a center axis line of the first forming hole coincides with the first axis line;

a first piercing die which has a first piercing hole into which the first piercing punch is inserted, and is provided so as to be movable inside the first wall portion along the first axis line in a state where a center axis line of the first piercing hole coincides with the first axis line inside the first forming hole of the first burring die;

a second burring die which has a second forming hole into which the second burring punch is inserted, and is provided so as to be movable inside the second wall portion along the first axis line in a state where a center axis line of the second forming hole coincides with the first axis line; and a second piercing die which has a second piercing hole into which the second piercing punch is inserted, and is provided so as to be movable inside the second wall portion along the first axis line in a state where a center axis line of the second piercing hole coincides with the first axis line inside the second forming hole of the second burring die.

9. The burring apparatus according to claim 8, wherein in a case where a center position between the first wall portion and the second wall portion on the first axis line is defined as a reference point, the first burring die and the second burring die are disposed so as to face each other in a state where the reference point is interposed therebetween;

the first piercing die and the second piercing die are disposed so as to face each other in a state where the reference point is interposed therebetween;

the internal unit further includes a first stopper and a second stopper which pass through the reference point and are provided so as to be movable along a second axis line orthogonal to the first axis line;

the first stopper has a shape which causes the first burring die to move toward the first wall portion and the second burring die to move toward the second wall portion in a process in which the first stopper passes through the reference point along the second axis line; and the second stopper has a shape which causes the first piercing die to move toward the first wall portion and the second piercing die to move toward the second wall portion in a process in which the second stopper passes through the reference point along the second axis line.

10. The burring apparatus according to claim 9, wherein the internal unit further includes a die return mechanism which separately applies an external force toward the reference point to each of the first burring die and the second burring die.

11. A burring apparatus for forming burring holes sharing a first axis line as center axis lines of the burring holes with respect to a first wall portion and a second wall portion facing each other, the burring apparatus comprising:

an internal unit which is disposed between the first wall portion and the second wall portion;

a first external unit which is disposed outside the first wall portion; and a second external unit which is disposed outside the second wall portion, wherein at least one of the internal unit, the first external unit, and the second external unit includes a piercing punch and a burring punch which are shaft members sharing the first axis line as the center axis lines and are provided so as to be movable along the first axis line, and wherein the burring punch operates separately from the piercing punch or the piercing punch is attached to a front end of the burring punch, wherein the first external unit includes a first piercing punch which forms a prepared hole on the first wall portion, wherein the second external unit includes a second piercing punch which forms a prepared hole on the second wall portion, and wherein the internal unit includes:

a first burring punch which has the first axis line as the center axis line along with the first piercing punch, and bends a peripheral edge portion of the prepared hole of the first wall portion to the outside of the first wall portion to form the burring hole; and a second burring punch which has the first axis line as the center axis line along with the second piercing punch, and bends a peripheral edge portion of the prepared hole of the second wall portion to the outside of the second wall portion to form the burring hole, wherein the first external unit further includes:

a first burring holder which has the first forming hole into which the first burring punch is inserted, and is provided so as to be movable along the first axis line outside the first wall portion in a state where a center axis line of the first forming hole coincides with the first axis line; and a first piercing die which has the first through hole serving as a passage of the first piercing punch and is provided so as to be movable along the first axis line outside the first wall portion in a state where a center axis line of the first through hole coincides with the first axis line inside the first forming hole of the first burring die, wherein the first piercing punch is provided so as to be movable between the outside and the inside of the first wall portion along the first axis line inside the first through hole of the first piercing holder in a state where a center axis line of the first piercing punch coincides with the first axis line, wherein the second external unit further includes:

a second burring die which has the second forming hole into which the second burring punch is inserted, and is provided so as to be movable along the first axis line outside the second wall portion in a state where a center axis line of the second forming hole coincides with the first axis line; and a second piercing holder which has the second through hole serving as a passage of the second piercing punch and is provided so as to be movable along the first axis line outside the second wall portion in a state where a center axis line of the second through hole coincides with the first axis line inside the second forming hole of the second burring die, wherein the second piercing punch is provided so as to be movable between the outside and the inside of the second wall portion along the first axis line inside the second through hole of the second piercing holder in a state where a center axis line of the second piercing punch coincides with the first axis line, wherein the internal unit further includes a tubular housing which includes the first burring punch and the second burring punch and has both opened end surfaces, wherein the housing is configured such that one end surface of the housing comes into surface contact with an inner wall surface of the first wall portion and the other end surface of the housing comes into surface contact with an inner wall surface of the second wall portion, wherein the first burring punch includes a first piercing hole into which the first piercing punch is inserted, and is provided so as to be movable between the outside and the inside of the first wall portion along the first axis line inside the housing in a state where a center axis line of the first piercing hole coincides with the first axis line, and wherein the second burring punch includes a second piercing hole into which the second piercing punch is inserted, and is provided so as to be movable between the outside and the inside of the second wall portion along the first axis line inside the housing in a state where a center axis line of the second piercing hole coincides with the first axis line.

12. The burring apparatus according to claim 11, wherein in a case where a center position between the first wall portion and the second wall portion on the first axis line is defined as a reference point, the first burring punch and the second burring punch are disposed so as to face each other in a state where the reference point is interposed therebetween;

the internal unit further includes a stopper which passes through the reference point and is provided so as to be movable along a second axis line orthogonal to the first axis line; and the stopper has a shape which causes the first burring punch to move to the outside of the first wall portion and the second burring punch to move to the outside of the second wall portion in a process in which the stopper passes through the reference point along the second axis line.

13. The burring apparatus according to claim 12, wherein the internal unit further includes a burring punch return mechanism which separately applies an external force toward the reference point to each of the first burring punch and the second burring punch.

14. The burring apparatus according to claim 11, wherein each of the first piercing hole of the first burring punch and the second piercing hole of the second burring punch includes a bottom portion, wherein in a case where a center position between the first wall portion and the second wall portion on the first axis line is defined as a reference point, the first burring punch and the second burring punch are disposed so as to face each other in a state where the reference point is interposed therebetween;

the internal unit further includes a stopper which passes through the reference point and is provided so as to be movable along a second axis line orthogonal to the first axis line;

the stopper has a shape which causes the first burring punch to move toward the first wall portion and the second burring punch to move toward the second wall portion in a process in which the stopper passes through the reference point along the second axis line; and the stopper includes a separation block which is separated from the stopper when the stopper stops in a state where the first burring punch comes into pressure contact with an inner wall surface of the first wall portion and the second burring punch comes into pressure contact with an inner wall surface of the second wall portion, and which is movable inside the housing along the first axis line along with the first burring punch and the second burring punch.

15. A burring apparatus for forming burring holes sharing a first axis line as center axis lines of the burring holes with respect to a first wall portion and a second wall portion facing each other, the burring apparatus comprising:

an internal unit which is disposed between the first wall portion and the second wall portion;

a first external unit which is disposed outside the first wall portion; and a second external unit which is disposed outside the second wall portion, wherein at least one of the internal unit, the first external unit, and the second external unit includes a piercing punch and a burring punch which are shaft members sharing the first axis line as the center axis lines and are provided so as to be movable along the first axis line, and wherein the burring punch operates separately from the piercing punch or the piercing punch is attached to a front end of the burring punch, wherein the first external unit includes:

a first piercing punch which forms a prepared hole on the first wall portion; and a first burring punch which has the first axis line as the center axis line along with the first piercing punch, and bends a peripheral edge portion of the prepared hole of the first wall portion to the inside of the first wall portion to form the burring hole, and wherein the internal unit includes:

a second piercing punch which forms a prepared hole on the second wall portion; and a second burring punch which has the first axis line as the center axis line along with the second piercing punch, and bends a peripheral edge portion of the prepared hole of the second wall portion to the outside of the second wall portion to form the burring hole, wherein the first external unit further includes a first burring holder which has a first through hole serving as a passage of the first burring punch and is provided so as to be movable outside the first wall portion in a state where a center axis line of the first through hole coincides with the first axis line, wherein the first burring punch is provided so as to be movable along the first axis line inside the first through hole of the first burring holder in a state where a center axis line of the first burring punch coincides with the first axis line, wherein the first piercing punch is attached to a front end of the first burring punch while sharing the first axis line as the center axis line along with the first burring punch, wherein the internal unit further includes:

a first burring die which has a first forming hole into which the first burring punch is inserted, and is provided so as to be movable along the first axis line in a state where a center axis line of the first forming hole coincides with the first axis line;

a first piercing die which has a first piercing hole into which the first piercing punch is inserted, and is provided so as to be movable along the first axis line inside the first forming hole of the first burring die in a state where a center axis line of the first piercing hole coincides with the first axis line; and a second burring holder which has a second through hole serving as a passage of the second burring punch, and is provided so as to be movable along the first axis line in a state where a center axis line of the second through hole coincides with the first axis line, wherein the second burring punch is provided so as to be movable along the first axis line inside the second through hole of the second burring holder in a state where a center axis line of the second burring punch coincides with the first axis line, wherein the second piercing punch is attached to a front end of the second burring punch while sharing the first axis line as the center axis line along with the second burring punch, and wherein the second external unit includes:

a second burring die which has a second forming hole into which the second burring punch is inserted, and is provided so as to be movable outside the second wall portion along the first axis line in a state where a center axis line of the second forming hole coincides with the first axis line; and a second piercing die which has a second piercing hole into which the second piercing punch is inserted, and is provided so as to be movable outside the second wall portion along the first axis line in a state where a center axis line of the second piercing hole coincides with the first axis line inside the second forming hole of the second burring die.

16. The burring apparatus according to claim 15, wherein the first piercing hole of the first piercing die includes a bottom portion, wherein in a case where a center position between the first wall portion and the second wall portion on the first axis line is defined as a reference point, the first burring die and the second burring holder are disposed so as to face each other in a state where the reference point is interposed therebetween;

the first piercing die and the second burring punch are disposed so as to face each other in a state where the reference point is interposed therebetween;

the internal unit further includes a stopper which passes through the reference point and is provided so as to be movable along a second axis line orthogonal to the first axis line;

the stopper has a shape which causes the first burring die and the first piercing die to move toward the first wall portion and the second burring holder and the second burring punch to move toward the second wall portion in a process in which the stopper passes through the reference point along the second axis line; and the stopper includes a separation block which is separated from the stopper when the stopper stops in a state where the first burring die and the first piercing die come into pressure contact with an inner wall surface of the first wall portion, and the second piercing punch attached to front ends of the second burring holder and the second burring punch come into pressure contact with an inner wall surface of the second wall portion, and which is movable along the first axis line along with the first piercing die and the second burring punch.

17. The burring apparatus according to claim 16, wherein the internal unit further includes a die return mechanism which applies an external force toward the reference point to the first burring die.

* * * * *